US007289745B2

(12) United States Patent
Nara et al.

(10) Patent No.: US 7,289,745 B2
(45) Date of Patent: Oct. 30, 2007

(54) IMAGE FORMING APPARATUS WITH POWER SUPPLY SYSTEM

(75) Inventors: Takashi Nara, Tokyo (JP); Norio Joichi, Tokyo (JP); Youbao Peng, Tokyo (JP); Yoshiki Katayama, Tokyo (JP); Atsushi Takahashi, Tokyo (JP); Yoshihito Sasamoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 164 days.

(21) Appl. No.: 11/109,971

(22) Filed: Apr. 20, 2005

(65) Prior Publication Data

US 2005/0231126 A1 Oct. 20, 2005

(30) Foreign Application Priority Data

| | | |
|---|---|---|
| Apr. 20, 2004 | (JP) | 2004-124780 |
| Jul. 15, 2004 | (JP) | 2004-209069 |
| Dec. 8, 2004 | (JP) | 2004-355276 |
| Feb. 20, 2005 | (JP) | 2005-044842 |

(51) Int. Cl.
*G03G 15/00* (2006.01)
*G03G 15/20* (2006.01)

(52) U.S. Cl. ..... 399/88; 219/216; 219/497; 399/69

(58) Field of Classification Search ..... 399/88, 399/67, 69, 320, 328; 219/216, 497; 347/156
See application file for complete search history.

(56) References Cited

U.S. PATENT DOCUMENTS

| | | | | |
|---|---|---|---|---|
| 7,122,767 | B2 * | 10/2006 | Sato et al. | 219/497 |
| 2003/0178410 | A1 * | 9/2003 | Satoh | 219/216 X |
| 2004/0028422 | A1 | 2/2004 | Umezawa et al. | 399/67 |
| 2005/0013626 | A1 * | 1/2005 | Satoh et al. | 399/88 |
| 2005/0063726 | A1 * | 3/2005 | Kinouchi et al. | 399/88 |
| 2005/0123314 | A1 * | 6/2005 | Satoh | 399/69 |

FOREIGN PATENT DOCUMENTS

| | | | |
|---|---|---|---|
| EP | 0 420 523 | A2 | 4/1991 |
| EP | 1 022 623 | A2 | 7/2000 |
| JP | 10-274901 | | 10/1998 |
| JP | 10-285913 | A * | 10/1998 |
| JP | 2002-237377 | A * | 8/2002 |
| JP | 2002-268446 | | 9/2002 |
| JP | 2003-177629 | | 6/2003 |
| JP | 2004-037699 | | 2/2004 |
| JP | 2005-037573 | A * | 2/2005 |

OTHER PUBLICATIONS

European Search Report for Application No. 05106027.5-2209 mailed May 26, 2006.

* cited by examiner

*Primary Examiner*—Sophia S. Chen
(74) *Attorney, Agent, or Firm*—Cantor Colburn LLP

(57) ABSTRACT

An image forming apparatus of the present invention may comprises a power supply system which supplies powers to an image forming unit, a fixing unit, and a general control unit in such a manner that as much power as possible can be supplied to the fixing unit within a limit of a current supplied from an alternating-current power supply, before load fluctuation on a secondary side of a direct-current power supply influences a primary side.

30 Claims, 39 Drawing Sheets

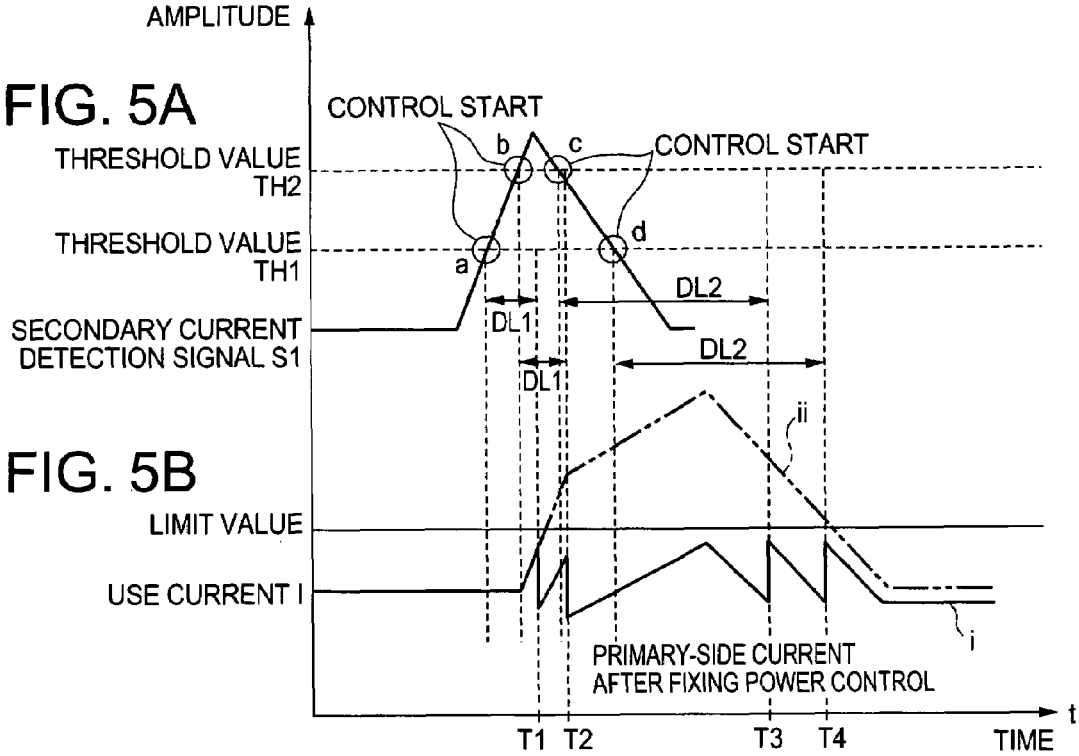
i : STEPWISE SUPPLY CONTROL
ii : NON-CONTROL

AMPLITUDE

CONTROL START
b
c
CONTROL START
THRESHOLD VALUE
TH2
THRESHOLD VALUE
TH1
a
d
DL2
DL1
SECONDARY CURRENT
DETECTION SIGNAL S1
DL2
DL1
ii

LIMIT VALUE
USE CURRENT I
i
PRIMARY-SIDE CURRENT
AFTER FIXING POWER CONTROL
t
T1
T2
T3
T4
Ta

NEW
OLD

POWER INSTRUCTION VALUE STORAGE
TIMER
D [A]
0
0
10

POWER INSTRUCTION VALUE STORAGE
D [B]
6
10
10
6 10
AGREEMENT

DATA D [A] OUTPUT
10
OUTPUT
6
0
6

DATA D [B] OUTPUT
6
6
6
OUTPUT

IMAGE FORMING APPARATUS WITH POWER SUPPLY SYSTEM

This application is based on and claims priorities under 35 U.S.C. §119 from the Japanese Patent Applications Nos. 2004-124780, 2004-209069,2004-355276 and 2005-044842 all filed in Japan on Apr. 20, 2004, Jul. 15, 2004, Dec. 8, 2004 and Feb. 20, 2005, respectively, the entire contents of which are incorporated herein by reference.

BACKGROUND OF THE INVENTION

1. Field of the Invention

The present invention relates to an image forming apparatus preferably applied to a monochromatic or color printer having a function of thermally fixing a toner image formed on a recording medium, a facsimile apparatus of the same type, a digital copying machine of the same type, a complex machine of them or the like.

2. Description of the Related Art

A digital copying machine has heretofore been used in many case, when an image is formed based on original image data obtained by reading an original image. In this type of copying machine, a direct-current motor (hereinafter referred to as the DC motor) which drives a sheet conveying system has been used. For example, when the original image is read by a scanner or the like, a sheet conveying system driven by a DC motor such as a stepping motor conveys an original to an original reading unit, or a sheet having a desired size is conveyed to an image forming unit from a sheet supply cassette.

The original image data read by the scanner is subjected to image processing such as γ correction, zooming, space filter, and image compression. Here the original image data subjected to the image processing is transferred to a printer. The printer forms an image on a predetermined sheet based on the original image data. At this time, an electrostatic latent image based on the original image data is formed on a photosensitive body uniformly charged by a charging unit. This electrostatic latent image is developed by a developing unit. A toner image is formed on the photosensitive body by performing the charging, exposing, and developing, and is transferred onto the sheet by a transfer unit. The toner image transferred onto the desired sheet is thermally fixed by a fixing unit. As a result, the original image can be copied.

Additionally, this type of copying machine is provided with a power supply system for supplying power to the DC motor or the fixing unit which drives the sheet conveying system. FIG. 39 is a block diagram showing a constitution example of a power supply system 10 mounted on a conventional digital copying machine or the like.

In FIG. 39, an alternating-current power supply 1 is connected to a current limiter (LMIT) 2, and a current (user current) I supplied from the alternating-current power supply 1 is limited to, for example, 10 A, 15 A or the like, when a digital copying machine is used. The current limiter 2 is connected to a direct-current power supply 3 and a fixing unit 7 through a current detector 4. The direct-current power supply 3 supplies a direct-current power (current Id) to a direct-current load circuit 5 such as a DC motor. When a primary side and a secondary side are defined by this direct-current power supply 3, the primary side is connected to the alternating-current power supply 1, and the secondary side is connected to the direct-current load circuit 5.

The current detector 4 is connected between the primary side of the direct-current power supply 3 and the current limiter 2, and detects the use current (hereinafter referred to also as a primary-side current) I supplied from the alternating-current power supply 1 to output a primary-side current detection signal SP1. The primary-side current I is obtained by adding up a current of the direct-current power supply 3 on the primary side and a current which flows into the fixing unit 7. The current detector 4 is connected to a power control unit 6, the primary-side current detection signal SP1 is input, and the current detector 4 controls power supply of the fixing unit 7 connected to the alternating-current power supply 1 based on this primary-side current detection signal SP1.

Next, an operation example of the power supply system 10 according to a conventional system will be described.

FIG. 40 is a waveform diagram showing a control example of the primary-side current I supplied from the alternating-current power supply. In FIG. 40, the ordinate indicates an amplitude of the primary-side current I, and the abscissa indicates time t. In FIG. 40, a waveform shown by a bold solid line indicates the primary-side current I at a non-control time, and a waveform shown by a bold broken line indicates the primary-side current I after fixing power control. A thin solid line indicates a limit value which limits the use current supplied from the alternating-current power supply 1. The limit value is set to 10 A, 15 A, 20 A or the like (15 A in Japan). A thin broken line indicates a control threshold value set by the current detector 4. In FIG. 40, M indicates a margin for controlling the primary-side current I, and is given by a difference between the limit value and the control threshold value.

The power supply system 10 of the conventional system relates to a case where the primary-side current I supplied from the alternating-current power supply 1 is limited, and the power supply system 10 executes a supply control of a fixing power based on the limit value to control threshold value. For example, the power control unit 6 monitors the primary-side current I through the current detector 4 in such a manner that the primary-side current I supplied from the alternating-current power supply 1 does not exceed the control value. As a result of the monitoring, when the power control unit 6 detects the primary-side current I exceeding the control threshold value, the power control unit 6 outputs, to the fixing unit 7, a power control signal SP2 for setting the primary-side current I to be not more than the limit value. The fixing unit 7 executes fixing/heating based on the power control signal SP2. Accordingly, the power can be supplied to the direct-current power supply 3, the fixing unit 7 and the like connected to the alternating-current power supply 1.

In a rising portion (direct-current load increase time) of the waveform of the primary-side current I shown in FIG. 40, a time when the waveform crosses the control threshold value corresponds to a control start point of supply of fixing power. In a falling portion (direct-current load decrease time) of the waveform, the time when the waveform crosses the control threshold value corresponds to the control start point of the fixing power supply. In general, when the current Id to the direct-current load circuit 5 fluctuates, the influence is reflected in the primary-side current I. It is known that a time when this influence is propagated to the primary side from the secondary side of the direct-current power supply 3 depends on a power capacity, and requires about 10 ms.

It is to be noted that with regard to the above-described power supply system, a power control device is disclosed in Patent Document 1: Japanese Patent Application Laid-Open No. 10-274901 (see page 3 and FIG. 1). This power control device is mounted on an image forming apparatus having a direct-current power supply and a fixing unit, and is constituted in such a manner as to detect a current input into the image forming apparatus. The fixing power is controlled in such a manner that this current is not more than a certain value. When this device is mounted, power consumed by the image forming apparatus can be efficiently distributed, and rising time of power control can be shortened.

Moreover, an image forming apparatus, a method of controlling the apparatus, and a storage medium are disclosed in Patent Document 2: Japanese Patent Application Laid-Open No. 2002-268446 (see page 3 and FIG. 1). This image forming apparatus comprises a current detection unit, a reader (an original reading unit), and a heater (a fixing unit). The apparatus detects a current which flows into the reader from the alternating-current power supply, and executes power control of the heater based on current detection information. When the apparatus is constituted in this manner, the current consumed by the whole image forming apparatus can be suppressed to be not more than a predetermined value.

Furthermore, a fixing heater energization device has been disclosed in Patent Document 3: Japanese Patent Application Laid-Open No. 2003-177629 (see page 2 and FIG. 1). This fixing heater energization device is mounted on the image forming apparatus having a direct-current power supply, and detects a current input into the image forming apparatus. The fixing heater energization device controls the fixing power in such a manner that this current is not more than a certain value. When the device is constituted in this manner, performance of a load circuit or the like connected to the direct-current power supply is sufficiently usable.

Additionally, according to the digital copying machine on which information conventional power supply system is mounted, there are problems as follows.

(i) The power supply system in which the current detector described in Patent Documents 1 to 3 is disposed on the primary side of the direct-current power supply 3 needs to take much margin of the primary-side current I. This is because a current fluctuation in the direct-current load circuit 5, to be reflected in the primary-side current I, requires about several tens of ms, and a power control range for compensating for this delay time is enlarged. Therefore, since much margin of the primary-side current I is taken, much power cannot be supplied to the fixing unit 7 within a limit of the primary-side current I. Accordingly, since the power that can be supplied fully within the limit value of the primary-side current I cannot be used, an amount of power that can be drawn/assigned to the fixing power is reduced.

(ii) The power control unit 6 cannot start the fixing power supply control from when a current fluctuation is generated in the direct-current load circuit 5 until the primary-side current I exceeds the control threshold value. That is, although the current fluctuation is generated in the direct-current load circuit 5, the primary-side current detection signal SP1 cannot be obtained from the current detector 4, and therefore the power control unit 6 waits for the fixing power control. Therefore, large delay is generated from when the primary-side current I exceeds the control threshold value, and the control is started until an effect of the fixing power control appears. By this constitution, a drop width of the fixing power increases from a power supply state immediately before the control at a time when the primary-side current I exceeds the control threshold value.

SUMMARY

The present invention has been made to solve the above-described problem in the prior art, and may provide an image forming apparatus capable of supplying power as much as possible to a fixing unit within a limit of a current supplied from an alternating-current power supply before a load fluctuation on a secondary side of a direct-current power supply influences a primary side.

To achieve the above-described, according to an embodiment of the present invention, there is provided an image forming apparatus (hereinafter referred to simply as the apparatus) which is usable when connected to an alternating-current power supply, the apparatus comprising: an image forming unit for forming an image on a predetermined recording medium; a fixing unit connected to the alternating-current power supply in such a manner as to thermally fix the image formed on the recording medium by the image forming unit; a general control unit for controlling the whole image forming apparatus including the image forming unit and the fixing unit; and a power supply system which supplies power to the image forming unit, the fixing unit, and the general control unit, the power supply system comprising: a direct-current power supply whose primary side is connected to the alternating-current power supply and whose secondary side is connected to a load and which supplies a direct-current power; a power control unit for controlling power supply of the fixing unit; and a current detector for detecting a current on the secondary side of the direct-current power supply to output a secondary-side current detection signal to the power control unit, the power control unit being constituted in such a manner as to control the power to be supplied to the fixing unit based on the secondary-side current detection signal of the direct-current power supply, output from the current detector.

The invention itself, and attendant advantages, will best be understood by reference to the following detailed description taken in conjunction with accompanying drawings.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 5(A) and (B) are diagrams showing waveform examples of a secondary-side current detection signal S1, and a primary-side current I supplied from an alternating-current power supply 1;

DETAILED DESCRIPTION OF THE PREFERRED EMBODIMENTS

Several preferable embodiments relating to an image forming apparatus of the present invention will be described hereinafter with reference to the accompanying drawings.

Figure 1:
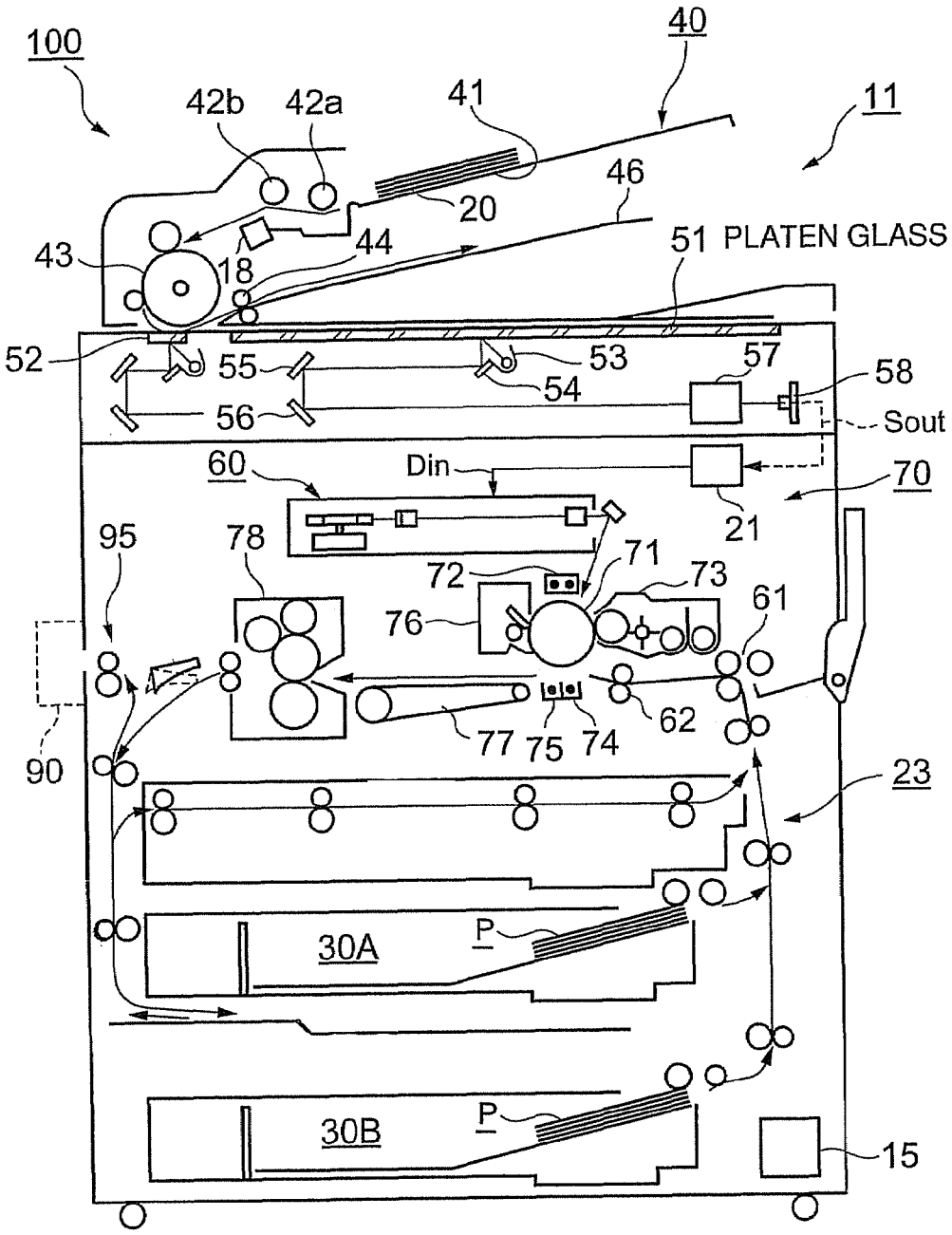
FIG. 1 is a schematic sectional view showing a schematic constitution example of a digital copying machine 100 according to each embodiment of the present invention.

FIG. 1 is a schematic sectional view showing a schematic constitution example of a digital copying machine 100 which is an image forming apparatus of the present invention. The digital copying machine (hereinafter referred to simply as a copying machine) 100 shown in FIG. 1 is one example of the image forming apparatus according to first to seventeenth embodiments. The apparatus is usable when connected to an alternating-current power supply, and constitutes a complex machine or the like which obtains a monochromatic image by a direct transfer system. The copying machine 100 has an apparatus main body.

In the apparatus main body, an original reading unit 11 is disposed. In the apparatus main body, a general control unit 15, sheet supply cassettes 30A, 30B, an image writing unit 60, an image forming unit 70 and the like are disposed. The original reading unit 11 has an automatic original feeder (hereinafter referred to as the ADF) 40, automatically supplies sheets of a desired original 20, and operates in such a manner as to read the original 20 and to output original image data Dout.

The ADF 40 is attached to an upper part of the apparatus main body. The ADF 40 has a original laying portion 41, rollers 42*a*, 42*b*, 43, a conveying roller 44, and a sheet discharge tray 46. These rollers 42*a*, 42*b*, 43 and the conveying roller 44 are driven by a DC motor (not shown).

One or a plurality of originals 20 are laid on the original laying portion 41. The rollers 42*a* and 42*b* are disposed on a downstream side of the original laying portion 41. When an automatic sheet supply mode is selected, the original 20 supplied from the original laying portion 41 is conveyed by the roller 43 on the downstream side in such a manner as to rotate in a U-shape. When the original 20 is reversed in the U-shape by the roller 43. the original 20 is read by the original reading unit 11 to output the original image data Dout. The original 20 is conveyed by the conveying roller 44, and discharged to the sheet discharge tray 46.

On the other hand, in the apparatus main body, first platen glass 51, second platen glass 52, mirrors 54, 55, 56, an optical image forming unit 57, a CCD imaging device 58, and an optical driving unit (not shown) are disposed. In a platen mode, the original (not shown) laid on the platen glass 51 is read. For example, the optical driving unit scans the light source 53 and the mirror 54. Light from the light source 53, with which the original is irradiated, is reflected as read light from the original. The read light is formed into an image by the optical image forming unit 57 through the mirrors 54 to 56, and taken into the CCD imaging device 58.

The CCD imaging device 58 constitutes a reduction type image sensor. Image processing unit 21 is connected to an output stage of the CCD imaging device 58, and digital original image data Din after subjecting an analog original read signal Sout to image processing is output to the image forming unit 70. The image forming unit 70 has an organic photosensitive drum (hereinafter referred to as the photosensitive drum) 71, a charging unit 72, a developing unit 73, a transferring unit 74, a separating unit 75, a cleaning unit 76, a conveying mechanism 77, and fixing unit 78. The photosensitive drum 71, developing unit 73, and conveying mechanism 77 are driven by the DC motor (not shown).

The charging unit 72 is disposed above the photosensitive drum 71, and the photosensitive drum 71 is uniformly charged beforehand based on a predetermined charging potential. For example, the image writing unit 60 is disposed above the photosensitive drum 71 at an angle to the right, the photosensitive drum 71 is exposed based on an exposure potential by image data Din output from the image processing unit 21, and an electrostatic latent image is formed on the photosensitive drum 71.

The developing unit 73 in which toner and carrier (developer) are contained is disposed on the right side of the photosensitive drum 71, and the electrostatic latent image exposed by the image writing unit 60 is developed by the toner. Resist rollers 62, sheet supply cassettes 30A, 30B and the like are disposed under the developing unit 73. Sheets P stored in the sheet supply cassettes 30A, 30B are supplied by feed-out rollers and sheet supply rollers (not shown) disposed in these sheet supply cassettes 30A, 30B, respectively, and conveyed under the photosensitive drum 71 via conveying rollers 61, resist rollers 62 and the like. These feed-out rollers, sheet supply rollers, conveying rollers 61, resist rollers 62 and the like are driven by the DC motor (not shown).

The transferring unit 74 is disposed under the photosensitive drum 71, and the toner image formed on the photosensitive drum 71 through charging, exposing, and developing is transferred to the sheet P whose conveying timing has been controlled by the resist rollers 62. The separating unit 75 is disposed adjacent to the transferring unit 74, and the sheet P onto which the toner image has been transferred is separated from the photosensitive drum 71.

The conveying mechanism 77 is disposed on the downstream side of the separating unit 75, and the fixing unit 78 is disposed in a terminal end portion. The toner image transferred onto the sheet P is thermally fixed by the fixing unit 78. The fixing unit 78 comprises a fixing heater driving circuit 79 and a fixing heater 97 shown in FIG. 2 (see FIG. 2). The sheet P after the fixing is held between sheet discharge rollers 95, and discharged to a sheet discharge tray or the like outside the machine. In the above-described process, the sheet P on which the image has been formed is not limited to the sheet discharge tray, and a finisher unit 90 may sometimes perform stapling or filing.

The cleaning unit 76 is disposed facing the photosensitive drum 71 between the conveying mechanism 77 and the charging unit 72 to clean the toner left on the photosensitive drum 71. Thereafter, the process shifts to the next copy cycle. During the image formation, as the sheet P, about 52.3 to 63.9 kg/m$^2$ (1000 sheets) of thin paper, about 64.0 to 81.4 kg/m$^2$ (1000 sheets) of plain sheet, 83.0 to 130.0 kg/m$^2$ (1000 sheets) of thick paper, or about 150.0 kg/m$^2$ (1000 sheets) of very thick paper are used. A linear speed is set to about 80 to 350 mm/sec. Environment conditions preferably include a temperature of about 5 to 35° C., and humidity of about 15 to 85%. The sheet P having a thickness (paper thickness) of about 0.05 to 0.15 mm is used.

First Embodiment

Figure 2:
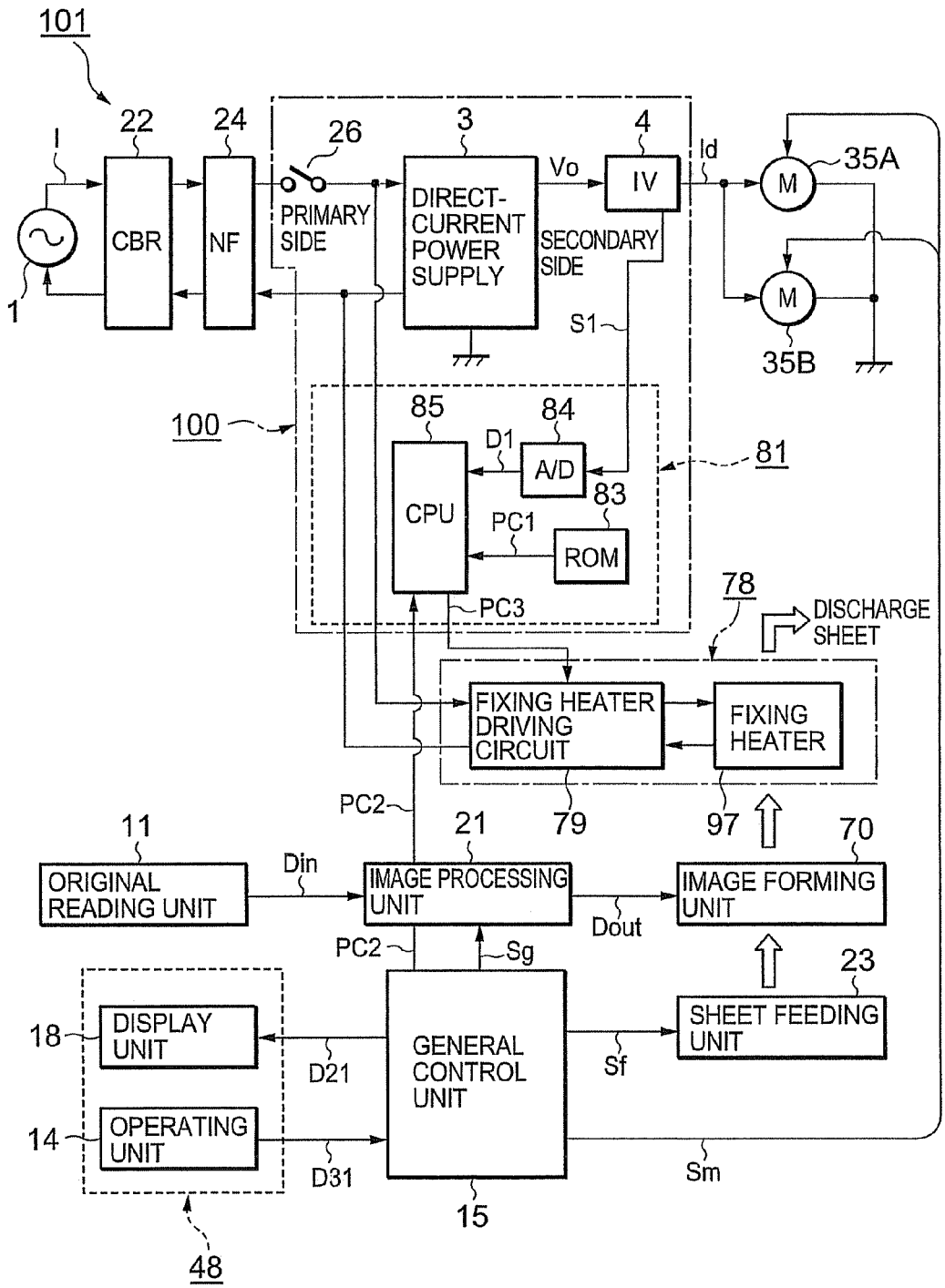
FIG. 2 is a block diagram showing a constitution example of a control system according to a first embodiment of the present invention for a digital copying machine 101.

FIG. 2 is a block diagram showing a constitution example of a control system according to a first embodiment of the present invention for a copying machine 101. The copying machine 101 shown in FIG. 2 comprises: an original reading unit 11; a general control unit 15; an image processing unit 21; a circuit breaker (CBR) 22 with a current limit; a sheet feeding unit 23; a noise filter (NF) 24; DC motors 35A, 35B; an operation panel 48; an image forming unit 70; fixing unit 78; and a first power supply system 100.

The power supply system 100 has a power switch 26, a direct-current power supply 3, current detector 4, and power control unit 81. The power switch 26 is connected to an alternating-current power supply 1 via the circuit breaker 22 and the noise filter 24. The circuit breaker 22 functions in such a manner as to restrict use current (primary-side current) I into the copying machine 101, for example, to 15 A or less. The circuit breaker 22 is constituted in such a manner as to interrupt the circuit after elapse of a predetermined time (unit of several seconds), when the current I exceeding I=15 A flows in. The circuit breaker 22 is connected to the noise filter 24, and the primary-side current I supplied from the alternating-current power supply 1 is filtered.

The power switch 26 is connected to the direct-current power supply 3 and the fixing unit 78. The primary side of the direct-current power supply 3 is connected to the alternating-current power supply 1 via the power switch 26, noise filter 24, and circuit breaker 22, and the secondary side thereof is connected to the DC motors 35A, 35B or the like which correspond to one example of a load to supply a direct-current power. For example, the direct-current power supply 3 converts an alternating-current voltage of AC 100 V into a direct-current voltage Vo=DC 12 V, and the direct-current power is supplied to the DC motors 35A, 35B and the like. The DC motor 35A is attached to, for example, the original reading unit 11, and drives at a direct-current voltage Vo=DC 12 V supplied from the direct-current power supply 3. The DC motor 35B is attached to, for example, the image forming unit 70, and similarly drives at a direct-current voltage Vo=DC 12 V.

The fixing unit 78 thermally fixes a toner image formed on the sheet P by the image forming unit 70. The fixing unit 78 comprises a fixing heater driving circuit 79 and a fixing heater 97. The fixing heater driving circuit 79 is connected to the power switch 26 on one side, and connected to the fixing heater 97 on the other side. In the fixing heater driving circuit 79, an energization control circuit or the like capable of executing a PWM control is used. According to this PWM control, a switch element energizes/controls rising of rectified waveform subjected to full-wave rectification of an alternating-current voltage AC 100 V. In the switch element, a bipolar transistor or a field-effect transistor is used.

For example, when the bipolar transistor is used as the switch element, a collector is connected to a full-wave rectification source, and an emitter is connected to the fixing heater 97. When a base current is controlled, a driving current flowing into the fixing heater 97 is controlled. When the field-effect transistor is used as the switch element, the source is connected to the full-wave rectification source, and the drain is connected to the fixing heater 97. When a gate current is on/off controlled, the driving current flowing into the fixing heater 97 is controlled. A resistance heating element is used in the fixing heater 97, heat is generated based on the driving current controlled by the fixing heater driving circuit 79, and fixing temperature is held, for example, at about 180° C.

Moreover, the current detector 4 detects a current Id on the secondary side of the direct-current power supply 3 to output a secondary-side current detection signal S1 to the power control unit 81. The power control unit 81 controls power supply of the fixing unit 78 connected to the alternating-current power supply 1. For example, the power control unit 81 estimates the primary-side current I supplied from the alternating-current power supply 1 by calculation or with reference to a table, and controls power to be supplied to the fixing unit 78 in such a manner that the primary-side current I estimated here does not exceed a predetermined value. In this case, the primary-side current I supplied from the alternating-current power supply 1 is reduced to a predetermined value, for example, I=15 A or less. Since the primary-side current I supplied from the alternating-current power supply 1 is estimated, a control threshold value for restricting the primary-side current I supplied from the alternating-current power supply 1 does not have to be disposed on the side of the alternating-current power supply as in the conventional system. The primary-side current I supplied from the alternating-current power supply 1 is usable fully up to the limit value. The power control unit 81 controls the power which can be supplied to the fixing unit 78 based on the secondary-side current detection signal S1 of the direct-current power supply 3, output from the current detector 4 (first image forming apparatus).

The power control unit 81 has an analog/digital converter (hereinafter referred to as the A/D converter) 84, CPU 85, and ROM 83. The A/D converter 84 analog/digital converts the secondary-side current detection signal S1 obtained by the current detector 4, and outputs current detection data D1 on the secondary side of the direct-current power supply 3.

The A/D converter 84 is connected to the CPU 85, and determines a first power instruction value PC1 based on the current detection data D1 after the A/D conversion. A power instruction value conversion table is stored in the ROM 83. As to the power instruction value conversion table, the optimum power instruction value PC1 corresponding to the current detection data D1 is obtained beforehand to constitute the table. The CPU 85 reads the optimum power instruction value PC1 using the current detection data D1 as an address to thereby determine the first power instruction value PC1. Accordingly, the CPU 85 can determine the power instruction value PC1 based on the current detection data D1.

The CPU 85 estimates the fluctuation of the primary-side current I supplied from the alternating-current power supply 1 to control the power supply of the fixing unit 78 at the time of direct-current load fluctuation of the DC motors 35A, 35B or the like. In this case, the CPU 85 compares the first power instruction value PC1 determined based on the current detection data D1 with a second power instruction value PC2 set beforehand by the general control unit 15.

For example, as a result of the above-described comparison, the CPU 85 selects a smaller value from the first and second power instruction values PC1, PC2, and controls the power supply of the fixing unit 78 based on the first or second power instruction value PC1, PC2 selected here. When the power instruction value PC1 is smaller than the power instruction value PC2 in this example, the power instruction value PC1 is selected.

Moreover, when the power instruction value PC2 is smaller than the power instruction value PC1, the power instruction value PC2 is selected. In this case, the power supply to the fixing unit 78 can be controlled by a third power instruction value PC3=PC1 or PC3=PC2 based on either the first or second power instruction value PC1, PC2 newly determined by the CPU 85 (comparison determining method of the power instruction value; third image forming apparatus).

It is to be noted that the first power supply system 100 is constituted in such a manner as to supply power to the original reading unit 11, general control unit 15, image processing unit 21, sheet feeding unit 23, operation panel 48 and the like besides the image forming unit 70 and the fixing unit 78.

The original reading unit 11 is connected to the image processing unit 21, and performs image processing on original image data Din obtained by reading the original 20 based on an image processing signal Sg from the general control unit 15 as described with reference to FIG. 1. The original image data Din after the image processing may be once stored in an image memory (not shown). The original image data Din is output to the image forming unit 70 from the image memory.

The general control unit 15 controls the whole copying machine, and controls, for example, input/output of the image processing unit 21, sheet feeding unit 23, image forming unit 70 or the like based on operation data D31 input from the operation panel 48. In this example, the general control unit 15 is constituted in such a manner as to set the power instruction value PC2 to the CPU 85. The general control unit 15 outputs a sheet feed control signal Sf to the sheet feeding unit 23, and executes sheet feed control to feed the sheet P from the sheet supply cassette 30A or 30B shown in FIG. 1. Furthermore, a motor control signal Sm is output to the DC motors 35A, 35B to execute motor driving control.

The operation panel 48 comprises an operating unit 14 and a display unit 18. As the operation panel 48, a combination of a liquid crystal display and a touch sensor panel (not shown) is used. When the image is formed based on original image data Dout, image forming conditions such as the number of sheets to be copied, and image forming concentration are displayed in the display unit 18. The image forming conditions are displayed based on the display data D21. The operating unit 14 is operated in such a manner as to set an automatic sheet feed mode, platen mode or the like. Needless to say, besides the mode setting, the operating unit 14 may be used in setting the power instruction value. The operation data D31 obtained by selection of these image forming conditions is output to the general control unit 15.

The image forming unit 70 is constituted in such a manner as to form an image on a predetermined sheet (recording medium) P based on the original image data Dout obtained by the original reading unit 11. For example, the original image data Dout is read from the image memory (not shown) based on the image forming condition set by the operating unit 14 in the image forming unit 70.

For example, the original image data Dout is extended and decoded by the image processing unit 21. The decoded original image data Dout is transmitted to the image forming unit 70. In the image forming unit 70, the original image data Dout is input into the image writing unit 60 shown in FIG. 1. In the image writing unit 60, an electrostatic latent image is formed on the photosensitive drum 71 based on the original image data Dout. The electrostatic latent image formed on the photosensitive drum 71 is developed by the toner.

In the sheet feeding unit 23, the sheet P based on the setting of the image forming conditions is fed out of the sheet supply cassette 30A or the like based on the sheet feed control signal Sf, and the sheet P is conveyed to the image forming unit 70. The sheet feed control signal Sf is output to the sheet feeding unit 23 from the general control unit 15. In the image forming unit 70, the toner image formed on the photosensitive drum 71 is transferred to the sheet P, and the toner image formed on the sheet P is fixed in the fixing unit 78. The sheet P after the fixing is discharged.

Next, an operation example of the copying machine 101 will be described. According to the copying machine 101 of the present invention, in a case where the primary-side current I supplied from the alternating-current power supply 1 is restricted, the primary side of the direct-current power supply 3 is connected to the alternating-current power supply 1, and the secondary side is connected to the DC motors 35A, 35B to supply a direct-current power. The CPU 85 controls the power supply of the fixing unit 78 connected to the alternating-current power supply 1.

For example, the CPU 85 estimates the fluctuation of the primary-side current I supplied from the alternating-current power supply 1 from the current detection data D1 to control the power supply of the fixing unit 78 at the time of the fluctuations of direct-current loads of the DC motors 35A, 35B and the like. In the power control unit 81, the A/D converter 84 analog/digital converts the secondary-side current detection signal S1 obtained by the current detector 4, and outputs the current detection data D1 relating to a secondary-side current Id of the direct-current power supply 3. The A/D-converted current detection data D1 is output to the CPU 85.

In this example, the first power instruction value PC1 is determined based on the current detection data D1. For example, the power instruction value conversion table stored in the ROM 83 is referred to. At this time, the CPU 85 reads the optimum power instruction value PC1 using the current detection data D1 as the address, and accordingly the first power instruction value PC1 is determined. Consequently, the CPU 85 can determine the power instruction value PC1 based on the current detection data D1. The CPU 85 compares the first power instruction value PC1 determined based on the current detection data D1 with the second power instruction value PC2 set beforehand by the general control unit 15.

As a result of the above-described comparison, for example, the CPU 85 selects a smaller value from the first and second power instruction values PC1, PC2, and controls the power supply of the fixing unit 78 based on either the first or second power instruction value PC1, PC2 selected here. In this example, when the power instruction value PC1 is smaller than the power instruction value PC2, the power instruction value PC1 is selected.

Moreover, when the power instruction value PC2 is smaller than the power instruction value PC1, the power instruction value PC2 is selected. In this case, the power supply to the fixing unit 78 can be controlled by the third power instruction value PC3=PC1 or PC3=PC2 based on either the first or second power instruction value PC1, PC2 newly determined by the CPU 85 (comparison determining method of the power instruction value).

On these assumptions, the power supply system 100 supplies powers to the DC motors 35A, 35B, image forming unit 70, and fixing unit 78. The image forming unit 70 forms an image on the predetermined sheet P. At this time, in the image forming unit 70, the original image data Dout is read from the image memory (not shown) based on the image forming condition set by the operating unit 14.

For example, the original image data Dout is extended and decoded by the image processing unit 21. The decoded original image data Dout is transmitted to the image forming unit 70. In the image forming unit 70, the original image data Dout is input into the image writing unit 60 shown in FIG. 1. In the image writing unit 60, the electrostatic latent image is formed on the photosensitive drum 71 based on the original image data Dout. The electrostatic latent image formed on the photosensitive drum 71 is developed by the toner.

In the sheet feeding unit 23, the sheet P based on the setting of the image forming conditions is fed out of the sheet supply cassette 30A or the like based on the sheet feed control signal Sf, and the sheet P is conveyed to the image forming unit 70. The sheet feed control signal Sf is output to the sheet feeding unit 23 from the general control unit 15. In the image forming unit 70, the toner image formed on the photosensitive drum 71 is transferred to the sheet P, and thereafter the sheet P onto which the toner image has been transferred is transported to the fixing unit 78.

The fixing unit 78 thermally fixes the image formed on the sheet P by the image forming unit 70. At this time, in the fixing unit, the fixing heater driving circuit 79 executes the PWM control with respect to the driving current of the fixing heater 97. According to this PWM control, the rising of rectified waveform subjected to the full-wave rectification of an alternating-current voltage AC 100 V is energized/controlled by the switch element.

For example, when the bipolar transistor is used in the switch element, the base current is controlled by the power instruction value PC3, and the driving current flowing into the fixing heater 97 is controlled. The fixing heater 97 generates heat based on the driving current controlled by the fixing heater driving circuit 79, and the fixing temperature is held, for example, at about 180° C. The sheet P after the fixing is discharged.

Thus, according to the copying machine 101 of the first embodiment, in a case where the primary-side current I supplied from the alternating-current power supply 1 is restricted, the current detector 4 detects the secondary-side current Id of the direct-current power supply 3 to output the secondary-side current detection signal S1 to the CPU 85 through the A/D converter 84.

Therefore, the CPU 85 can instantaneously control the power which can be supplied to the fixing unit 78 by the power instruction value PC3 determined based on the current detection data D1 relating to the secondary-side current Id of the direct-current power supply 3, input from the A/D converter 84, before the load fluctuations of the DC motors 35A, 35B on the secondary side of the direct-current power supply 3 influence the primary side, that is, the alternating-current power supply side connected to the fixing unit 78. Consequently, the power can be supplied as much as possible to the fixing unit 78 within the limit of the primary-side current I supplied from the alternating-current power supply 1.

Second Embodiment

Figure 3:
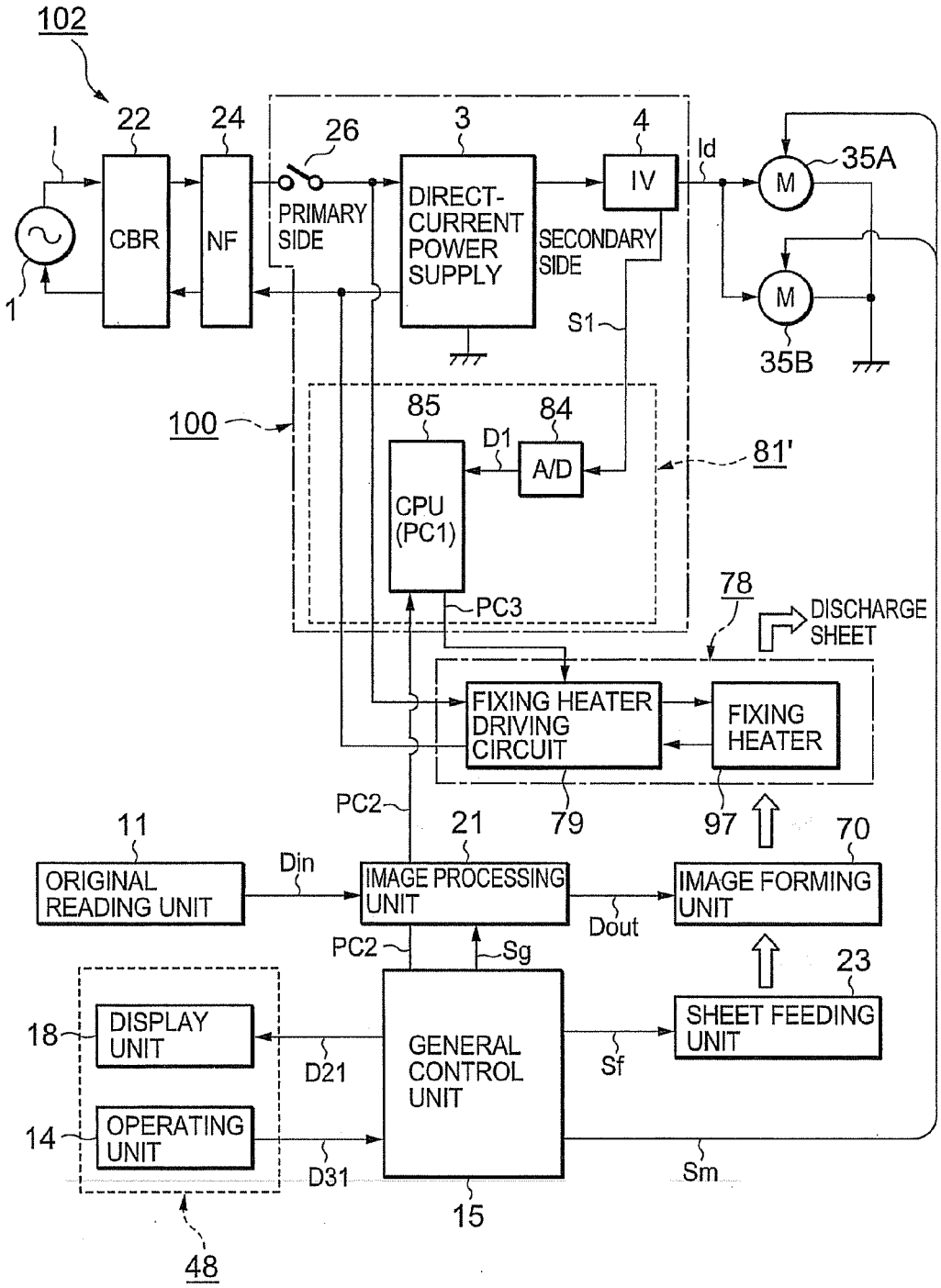
FIG. 3 is a block diagram showing a constitution example of a control system according to a second embodiment of the present invention for a digital copying machine 102.

FIG. 3 is a block diagram showing a constitution example of a control system according to a second embodiment of the present invention for a copying machine 102.

In this second embodiment, a CPU 85 calculates and obtains a power instruction value PC1 in real time. A power supply system 100 is also applied to the copying machine 102 shown in FIG. 3. While the primary-side current I supplied from the alternating-current power supply 1 is restricted, powers are supplied to DC motors 35A, 35B and fixing unit 78, and an image is formed based on original image data Dout.

In this example, power control unit 81' comprises an A/D converter 84 and CPU 85, and the ROM 83 described in the first embodiment is omitted. In the power control unit 81', the A/D converter 84 analog/digital converts a secondary-side current detection signal S1 obtained from current detector 4, and outputs current detection data D1 relating to secondary-side current Id of a direct-current power supply 3. The current detection data D1 after the A/D conversion is output to the CPU 85.

In this example, a first power instruction value PC1 is determined based on the current detection data D1. At this time, assuming that the current detection data D1 is X, calculation coefficients are a, b, and the power instruction value PC1 is Y, the CPU 85 calculates a calculation equation $Y=aX+b$ to obtain an optimum power instruction value PC1, and accordingly the first power instruction value PC1 is determined. Accordingly, the CPU 85 can determine the power instruction value PC1 based on the current detection data D1. The CPU 85 compares the first power instruction value PC1 determined based on the current detection data D1 with the second power instruction value PC2 set beforehand by general control unit 15.

As a result of the above-described comparison, for example, the CPU 85 selects a smaller value from the first and second power instruction values PC1, PC2, and controls the power supply of the fixing unit 78 based on either the first or second power instruction value PC1, PC2 selected here. In this example, when the power instruction value PC1 is smaller than the power instruction value PC2, the power instruction value PC1 is selected.

Moreover, when the power instruction value PC2 is smaller than the power instruction value PC1, the power instruction value PC2 is selected. In this case, the power supply to the fixing unit 78 can be controlled by the third power instruction value PC3=PC1 or PC3=PC2 based on either the first or second power instruction value PC1, PC2 newly determined by the CPU 85 (another comparison determining method of the power instruction value).

It is to be noted that components having the same names and reference numerals as those of the first embodiment have the same functions, and therefore the description is omitted. Since an operation example of the copying machine 102 is similar to that of the copying machine 101 of the first embodiment except that the power control unit 81' calculates the power instruction value PC1 based on the current detection data D1, the description is omitted.

Thus, according to the copying machine 102 of the second embodiment, in a case where the primary-side current I supplied from the alternating-current power supply 1 is restricted, the current detector 4 detects the secondary-side current Id of the direct-current power supply 3 to output the secondary-side current detection signal S1 to the CPU 85 through the A/D converter 84.

Therefore, the CPU 85 can instantaneously control the power which can be supplied to the fixing unit 78 by the power instruction value PC3 calculated based on the current detection data D1 relating to the secondary-side current Id of the direct-current power supply 3, input from the A/D converter 84, before the load fluctuations of the DC motors 35A, 35B on the secondary side of the direct-current power supply 3 influence the primary side, that is, the alternating-current power supply side connected to the fixing unit 78. Consequently, the power can be supplied as much as possible to the fixing unit 78 within the limit of the primary-side current I supplied from the alternating-current power supply 1. Therefore, the fixing unit 78 which generates heat by the PWM control of a full-wave rectification voltage can be maintained at target temperature with good reliability.

Third Embodiment

Figure 4:
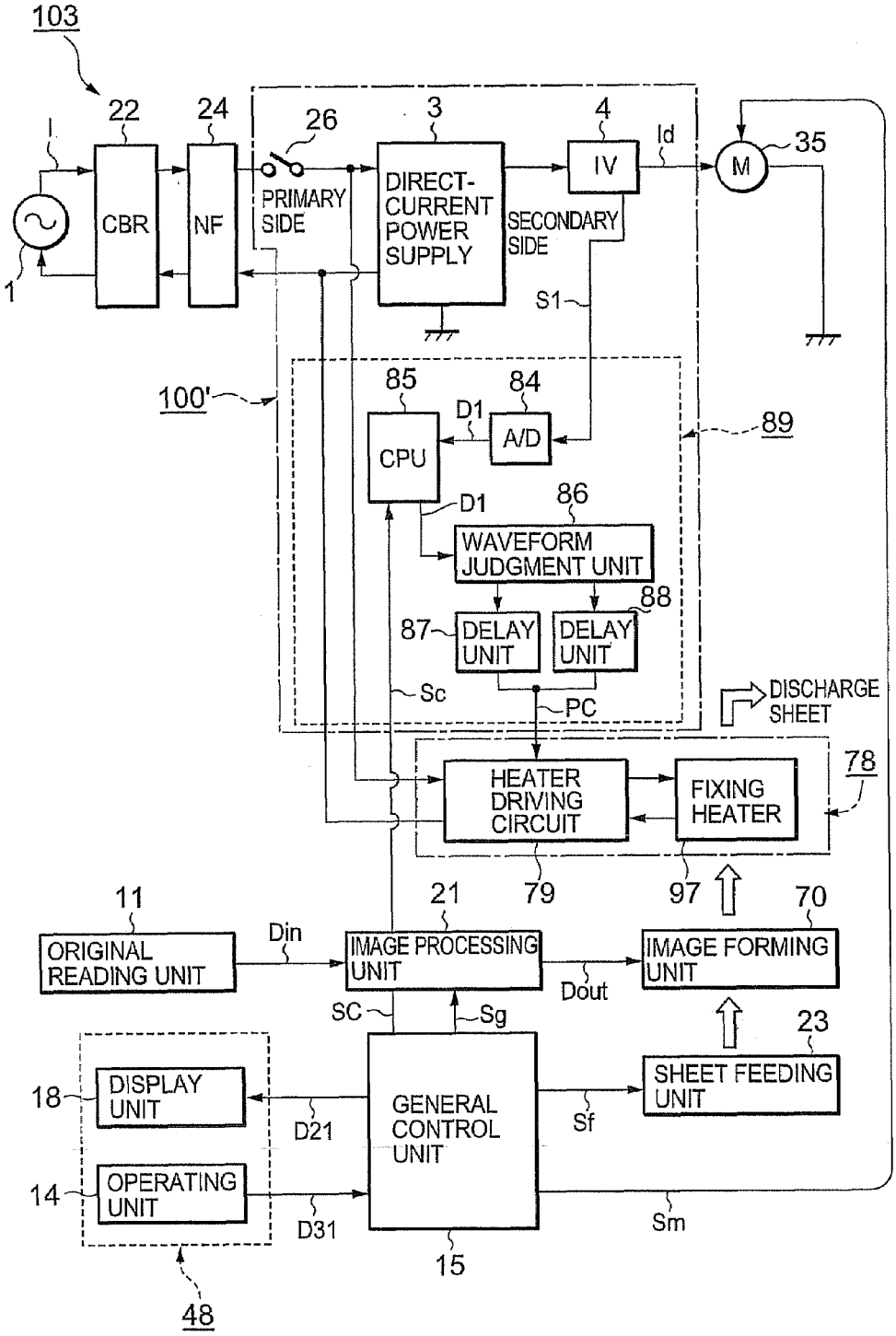
FIG. 4 is a block diagram showing a constitution example of a control system according to a third embodiment of the present invention for a digital copying machine 103.

FIG. 4 is a block diagram showing a constitution example of a control system according to a third embodiment of the present invention for a copying machine 103.

In this third embodiment, a threshold value which determines a control start time is preset with respect to a secondary-side current detection signal S1 obtained from current detector 4. With regard to a rising waveform of the secondary-side current detection signal S1, a predetermined first delay value is set from a time when the waveform crosses the threshold value. With regard to a falling waveform of the secondary-side current detection signal S1, a predetermined second delay value is set from a time when the waveform crosses the threshold value. The first delay value is set to be not more than the second delay value. Thus, an effect of controlling fixing power can be fulfilled at the time of decrease of a primary-side current I supplied from the alternating-current power supply 1 (fifth image forming apparatus).

A power supply system 100' is applied to the copying machine 103 shown in FIG. 4. While the primary-side current I supplied from the alternating-current power supply 1 is restricted, powers are supplied to a DC motor 35 and fixing unit 78, and an image is formed based on original image data Dout.

In this example, in the power supply system 100', power control unit 81 of the power supply system 100 described in the first embodiment is replaced with power control unit 89. The power control unit 89 comprises a waveform judgment unit 86 and delay units 87 and 88 in addition to an A/D converter 84 and CPU 85, and the ROM 83 described in the first embodiment is omitted. The CPU 85 is connected to general control unit 15, and the general control unit 15 outputs, to the CPU 85, a control signal Sc indicating a power instruction value or PWM control command for lamp change lighting.

In the power control unit 89, the A/D converter 84 analog/digital converts the secondary-side current detection signal S1 obtained from the current detector 4, and outputs current detection data D1 relating to a secondary-side current Id of a direct-current power supply 3. The current detection data D1 after the A/D conversion is output to the CPU 85.

The CPU 85 is connected to the waveform judgment unit 86. The current detection data D1 is input, and rising and falling of a waveform of the secondary-side current detection signal S1 are judged. In this judgment, increase tendency and decrease tendency of a direct-current load power are detected to control power which can be supplied to the fixing unit 78. When the direct-current load power has the increase tendency, the fixing power drawn/assigned to the fixing unit 78 is decreased. Conversely, when the direct-current load power has the decrease tendency, the fixing power drawn/assigned to the fixing unit 78 is increased.

In this example, in a case where the direct-current load power has the increase tendency, that is, at the time of the rising of the secondary-side current detection signal S1, two control start points are set. At a falling time, two control start points are set. Four points in total are set, and the supply of the fixing power to the fixing unit 78 is controlled in stages. For this stage supply control, as shown in FIG. 5A, two threshold values TH1 and TH2 are set.

The waveform judgment unit 86 is connected to the delay units 87 and 88. With regard to the rising waveform of the secondary-side current detection signal S1, the delay unit 87 sets a predetermined first delay value DL1 from a time when the waveform crosses the threshold values TH1 and TH2. With regard to the falling waveform of the secondary-side current detection signal S1, the delay unit 88 sets a predetermined second delay value DL2 from a time when the waveform crosses the threshold values TH1 and TH2.

The delay units 87 and 88 are connected to a fixing heater driving circuit 79 of the fixing unit 78, and the delay units 87 and 88 output a power instruction value PC to the fixing heater driving circuit 79. The power instruction value PC is control information which controls an on-period of a switch element disposed in the fixing heater driving circuit 79.

In this example, with regard to the power instruction value PC, in a period in which a direct-current load current is expected to increase, and a use current I is expected to exceed a limit value, the fixing power is lowered at a control start timing based on the delay value DL1 in a stepwise manner. Thereafter, the control is on standby while maintaining a state in which a certain power is supplied. The fixing power is raised in a stepwise manner at a control start timing based on the delay value DL2 from a time when the direct-current load current shifts to the decrease. A state in which the fixing power is supplied is maintained within the limit of the primary-side current I.

It is to be noted that components having the same names and reference numerals as those of the first embodiment have the same functions, and therefore the description is omitted. Since an operation example of the copying machine 103 is similar to that of the copying machine 101 of the first embodiment except that the power control unit 89 determines the power instruction value PC based on the current detection data D1, the description is omitted.

FIGS. 5(A) and (B) are diagrams showing waveform examples of the secondary-side current detection signal S1, and the primary-side current I supplied from the alternating-current power supply 1. In either of FIGS. 5(A) and (B), the ordinate indicates an amplitude of a signal or a current, and the abscissa indicates time t.

A triangular waveform shown by a solid line in FIG. 5(A) indicates the secondary-side current detection signal S1, and a signal which reflects the current on the secondary side of the direct-current power supply. A rising portion of the waveform indicates an increase tendency of the secondary-side current Id to the DC motor 35, and a falling portion of the waveform indicates a decrease tendency of the direct-current current Id to the DC motor 35.

In this example, two threshold values TH1 and TH2 are set which define four control start points a to d. The threshold value TH1 is set, for example, to approximately ½ of the amplitude of the secondary-side current detection signal S1, or to be slightly lower. The threshold value TH2 is set, for example, to approximately twice the threshold value TH1, or to be slightly lower. That is, a relation of TH1<TH2 is set to two threshold values TH1 and TH2.

In this example, at the waveform rising time of the secondary-side current detection signal S1, a time to separate the threshold values TH1 and TH2 is the control start point, but actual control start timings are times T1, T2 after the intentionally disposed delay value DL1. At the waveform falling time, a time to separate the threshold values TH1 and TH2 is the control start point, but actual control start timings are times T3, T4 after the intentionally disposed delay value DL2.

Moreover, the waveform shown by the solid line in FIG. 5(B) indicates the primary-side current I supplied from the alternating-current power supply 1, and indicates a case where stepwise supply control i according to the present invention is carried out. The primary-side current I does not indicates a so-called sinusoidal wave ($i=a\times \sin \omega t$), and indicates, for example, an effective value which can be observed with an AC ammeter, digital ammeter or the like. In the figure, a waveform shown by a two-dot chain line indicates the primary-side current I supplied from the alternating-current power supply 1 at the time of non-control ii, and indicates a case where the current exceeds the limit value.

In a case where the stepwise supply control i according to the present invention is carried out, in a period in which the primary-side current I supplied from the alternating-current power supply 1 at the time of the non-control ii exceeds the limit value, that is, in a period in which the use current I is expected to exceed the limit value in the present invention, the fixing power is lowered in a stepwise manner at the control start timing (times T1, T2) based on the delay value DL1. Thereafter, while maintaining the state in which the certain power is supplied, the control is withheld (on standby). The fixing power is raised in the stepwise manner at the control start timing (times T3, T4) based on the delay value DL2 from a time when the direct-current load current shifts to the decrease. The state in which the fixing power is supplied can be maintained within the limit of the use current I.

Figures 6A, 6B:
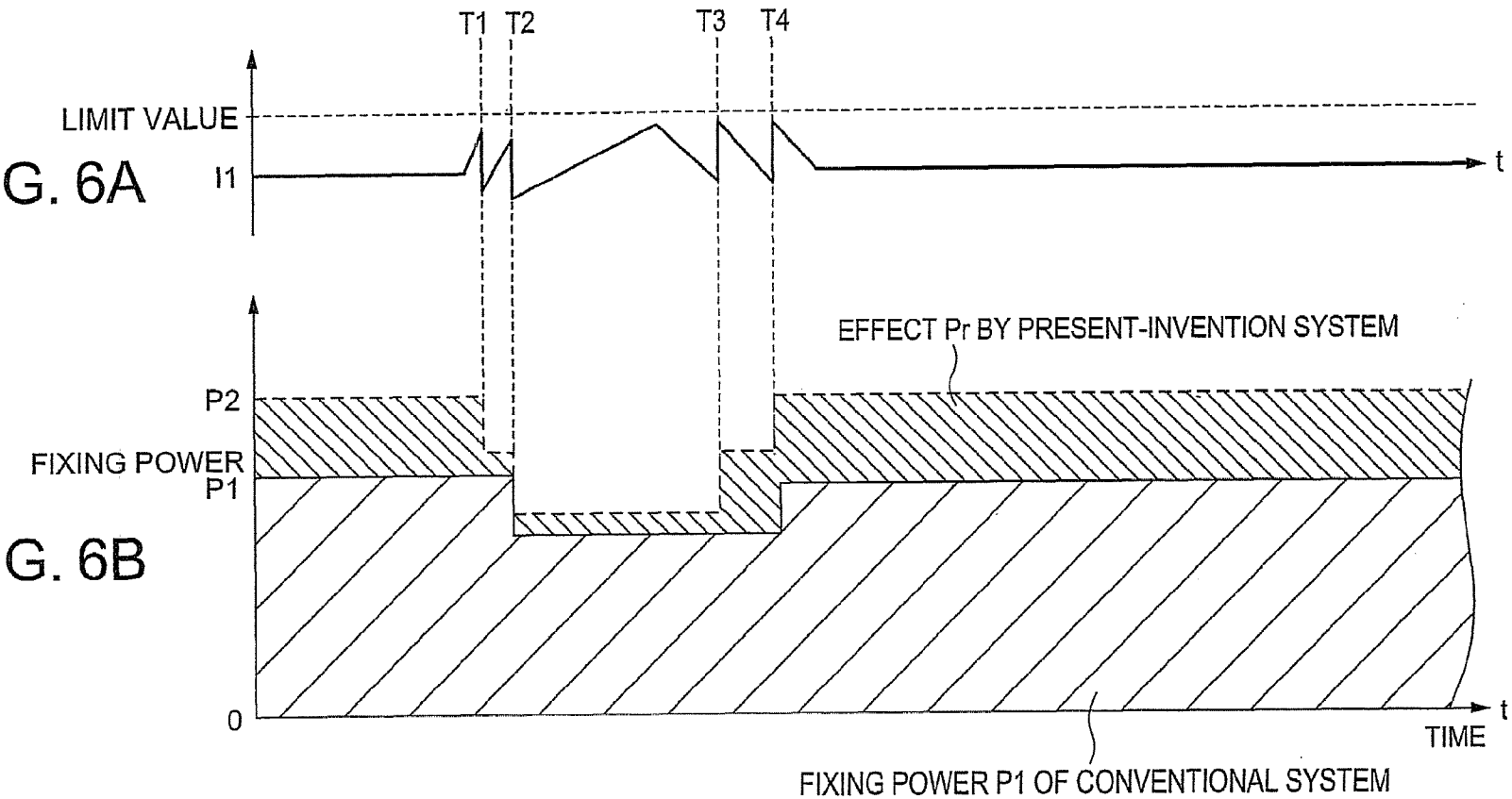
FIGS. 6A and 6B are graphs showing a comparative example of a conventional system and a system of the present invention relating to fixing power supply control.

FIGS. 6A and B are diagrams showing a comparative example of a conventional system and a system of the present invention relating to fixing power supply control. FIG. 6A shows the waveform of the primary-side current I supplied from the alternating-current power supply 1 according to the present invention, and the waveform of the use current I is extracted from FIG. 5(B). In FIG. 6A, the ordinate indicates an amplitude, and the abscissa indicates time t.

FIG. 6B shows a comparative example of the conventional system and the system of the present invention concerning a fixing power. In FIG. 6B, the ordinate indicates the fixing power, and the abscissa indicates time t. P1 indicates a fixing power according to the conventional system. P2 indicates a fixing power according to the system of the present invention, and P2=P1+PR, where PR indicates an increase (effect by the present invention) of the fixing power by the stepwise supply control i of the present invention. According to the system of the present invention, with regard to the fixing power which can be supplied in the conventional system, a power in which a control margin has been considered is usable.

According to the power supply system of the conventional system, in a case where the fixing power P1 is supplied, and the direct-current load power turns to the increase tendency, the power control unit detects a state in which the primary-side current I supplied from the alternating-current power supply 1 exceeds the limit value, and thereafter the supply control of the fixing power P1 is performed. Additionally, the fixing power P1 is decreased all at once at the control start timing T2. Thereafter, the state in which the certain power is supplied is maintained, and the direct-current load current shifts to the decrease. On detecting a state in which the primary-side current I supplied from the alternating-current power supply 1 is below the limit value, the power control unit executes the supply control of the fixing power. Additionally, the fixing power is increased at once at the control start timing T4.

On the other hand, according to the stepwise supply control (system) i of the present invention, in a case where a fixing power P2 (=P1+PR) is supplied, and the direct-current load power turns to the increase tendency, at a control start timing (time) T1 based on the delay value DL1, the power control unit 89 outputs a power instruction value PC to the fixing heater driving circuit 79, controls the switch element, and lowers the supply of the fixing power by one stage. Thereafter, at the control start timing (time) T2 based on the delay value DL1, the power control unit outputs the power instruction value PC to the fixing heater driving circuit 79, controls the switch element, and further lowers the supply of the fixing power by another stage.

Thereafter, while maintaining the state in which the certain power is supplied, the control is withheld (on standby), and the power instruction value PC is output to the fixing heater driving circuit 79 at a control start timing (time) T3 based on the delay value DL2 from the time when the direct-current load current shifts to the decrease. The switch element is controlled, and the supply of the fixing power is raised by one stage. Thereafter, at the control start timing (time) T4 based on the delay value DL2, the power instruction value PC is output to the fixing heater driving circuit 79, the switch element is controlled, and the fixing power is controlled in such a manner as to be raised by another stage.

Thus, the copying machine 103 of the third embodiment comprises the power supply system 100' in which the power control unit 81 of the power supply system 100 described in the first embodiment has been replaced with the power control unit 89.

Therefore, by the stepwise supply control system by the power control unit 89, the supply of the fixing power can be controlled in the stepwise manner. Moreover, the primary-side current I supplied from the alternating-current power supply 1 is usable fully up to the limit value, and more fixing power can be supplied to the fixing heater 97 as compared with the conventional system.

Fourth Embodiment

Figure 7:
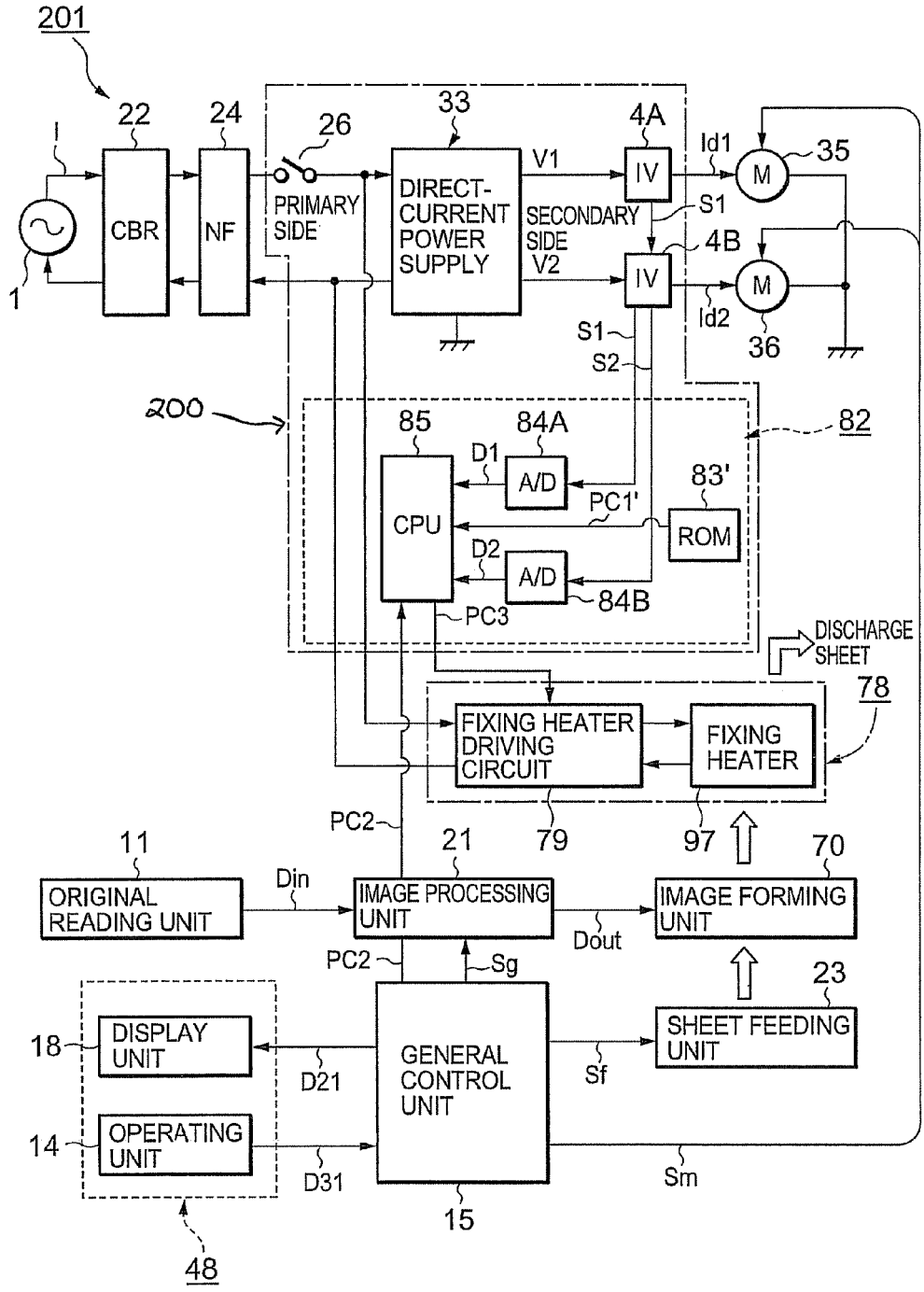
FIG. 7 is a block diagram showing a constitution example of a control system according to a fourth embodiment of the present invention for a digital copying machine 201.

FIG. 7 is a block diagram showing a constitution example of a control system according to a fourth embodiment of the present invention for a copying machine 201.

In this fourth embodiment, a direct-current power supply 33 is connected to a direct-current load circuit of DC motors 35, 36 having different driving voltages. Direct-current powers are individually supplied to the direct-current load circuits, current detector 4 is disposed for each of the DC motors 35, 36 connected to the direct-current power supply 33. Secondary-side current detection signals S1, S2 are obtained by individually detecting currents Id1 and Id2 on a secondary side of the direct-current power supply 33, and are output to a CPU 85 through A/D converters 84A, 84B. The CPU 85 is constituted in such a manner as to control power supply of fixing unit 78 based on two current detection data D1, D2.

A power supply system 200 is applied to the copying machine 201 shown in FIG. 7. While a primary-side current I supplied from an alternating-current power supply 1 is restricted, powers are supplied to the DC motors 35, 36 and the like, and the fixing unit 78, so that an image is formed based on original image data Dout. In FIG. 7, the alternating-current power supply 1 is connected to a circuit breaker 22 described in the first embodiment, and this circuit breaker 22 is connected to the direct-current power supply 33 via a noise filter 24 and a power switch 26. Even in this example, the primary-side current I supplied from the alternating-current power supply 1 is restricted, for example, to 10 A, 15 A, 20 A . . . , and used. The power switch 26 is connected to the fixing unit 78 in addition to the direct-current power supply 33.

In this example, an AC-DC converter for DC voltage multiple outputs is used in the direct-current power supply 33. The primary side of the direct-current power supply 33 is connected to the alternating-current power supply 1, and a secondary side thereof is connected to the DC motor 35 of a 12 V driving system (series), and the DC motor 36 of a 24 V driving system. In the direct-current power supply 33, for example, an alternating-current voltage is converted into two types of direct-current voltages V1=12 V, V2=24 V, and direct-current powers are supplied to the DC motor 35 of the 12 V driving system, and the DC motor 36 of the 24 V driving system, respectively.

Current detection units 4A, 4B are connected between the direct-current power supply 33 and each of the DC motors 35, 36. The respective current detectors 4A, 4B are connected to power control unit 82. The power control unit 82 comprises an ROM 83', A/D converters 84A, 84B, CPU 85 and the like. The current detector 4A is constituted in such a manner as to detect the current Id1 on the secondary side of the direct-current power supply 33 and to output the secondary-side current detection signal S1 to the A/D converter 84A. The current detector 4B is constituted in such a manner as to detect the current Id2 on the secondary side of the direct-current power supply 33 and to output the secondary-side current detection signal S2 to the A/D converter 84B.

In this case, fluctuations of direct-current loads of the DC motors 35, 36 and the like are instantaneously found by the secondary-side current detection signals S1, S2. Current-voltage (IV) converters which convert the currents Id1 and Id2 into voltages are used in the current detectors 4A, 4B. These two current detectors 4A, 4B are connected to the power control unit 82. Two types of secondary-side current detection signals S1, S2 are input, and the power supply to the fixing unit 78 connected to the alternating-current power supply 1 is controlled based on the secondary-side current detection signals S1, S2. It is to be noted that components having the same names and reference numerals as those of the second embodiment have the same functions, and therefore the description is omitted.

Next, an operation example of the copying machine 201 will be described. The copying machine 201 according to the fourth embodiment relates to a case where the primary-side current I supplied from the alternating-current power supply 1 is restricted. The primary side of the direct-current power supply 33 is connected to the alternating-current power supply 1, and the secondary side thereof is connected to the DC motors 35, 36 to supply the direct-current power. The CPU 85 of the power control unit 82 controls the power supply of the fixing unit 78 connected to the alternating-current power supply 1. A power instruction value conversion table is stored beforehand in the ROM 83'. As to the power instruction value conversion table, an optimum power instruction value PC1' corresponding to current detection data D1 is obtained beforehand to constitute the table.

For example, the CPU 85 controls the power which can be supplied to the fixing unit 78 based on the secondary-side current detection signals S1, S2 of the direct-current power supply 33, output from two current detectors 4A, 4B. At a fluctuation time of the DC motors 35, 36, the CPU 85 estimates the primary-side current I supplied from the alternating-current power supply 1, and controls the power supply of the fixing unit 78. In the power control unit 82, the A/D converter 84A analog/digital converts the secondary-side current detection signal S1 obtained from the current detector 4A, and outputs the current detection data D1 based on the secondary-side current Id1 of the direct-current power supply 33 to the CPU 85. The A/D converter 84B analog/digital converts the secondary-side current detection signal S2 obtained from the current detector 4B, and outputs the current detection data D2 based on the secondary-side current Id2 of the direct-current power supply 33 to the CPU 85.

The CPU 85 determines a first power instruction value PC1' based on the current detection data D1, D2 after the A/D conversion. At this time, the CPU 85 obtains current detection data D1 based on secondary-side current added value Id1+Id2 from the current detection data D1, D2. Thereafter, the power instruction value conversion table of the ROM 83' is referred to based on the current detection data D1', and an optimum power instruction value PC1' is read from the power instruction value conversion table using the current detection data D1 as an address. Accordingly, the CPU 85 can determine the power instruction value PC1 based on the current detection data D1'.

Moreover, the CPU 85 compares the first power instruction value PC1' determined based on the current detection data D1 with the second power instruction value PC2 set beforehand by general control unit 15. As a result of the above-described comparison, for example, the CPU 85 selects a smaller value from the first and second power instruction values PC1', PC2, and controls the power supply of the fixing unit 78 based on either the first or second power instruction value PC1', PC2 selected here. In this example, when the power instruction value PC1' is smaller than the power instruction value PC2, the power instruction value PC1' is selected.

Moreover, when the power instruction value PC2 is smaller than the power instruction value PC1', the power instruction value PC2 is selected. In this case, the power supply to the fixing unit 78 can be controlled by the third power instruction value PC3=PC1' or PC3=PC2 based on either the first or second power instruction value PC1', PC2 newly determined by the CPU 85 (another comparison determining method of the power instruction value).

On these assumptions, the power supply system 200 supplies powers to the DC motors 35, 36, image forming unit 70, and fixing unit 78, respectively. The image forming unit 70 forms an image on a predetermined sheet P. In the sheet feeding unit 23, the sheet P based on the setting of image forming conditions is fed out of a sheet supply cassette 30A or the like based on a sheet feed control signal Sf, and the sheet P is conveyed toward the image forming unit 70. In the image forming unit 70, a toner image formed on a photosensitive drum 71 is transferred to the sheet P, and thereafter the sheet P onto which the toner image has been transferred is transported to the fixing unit 78.

The fixing unit 78 thermally fixes the image formed on the sheet P by the image forming unit 70. At this time, in the fixing unit 78, a fixing heater driving circuit 79 executes a PWM control with respect to a driving current of a fixing heater 97. According to this PWM control, in a case where a field-effect transistor is used as a switch element, the gate voltage is on/off-controlled by a power instruction value PC3, and accordingly a driving current flowing into the fixing heater 97 is controlled. The fixing heater 97 is constituted in such a manner as to generate heat based on the driving current controlled by the fixing heater driving circuit 79, so that fixing temperature is held, for example, at about 180° C. The fixed sheet P is discharged.

Thus, the copying machine 201 of the fourth embodiment relates to a case where the primary-side current I supplied from the alternating-current power supply 1 is restricted. Two current detectors 4A, 4B detect the secondary-side currents Id1, Id2 of the direct-current power supply 33 at the time of fluctuations of the DC motors 35, 36. After the A/D conversion, the secondary-side current detection signals S1, S2 are output as the current detection data D1, D2 to the CPU 85. The CPU 85 is constituted in such a manner as to obtain current detection data D1 based on the secondary-side current added value Id1+Id2 from the current detection data D1, D2.

Therefore, the CPU 85 can instantaneously control the power which can be supplied to the fixing unit 78 based on the current detection data D1 based on the secondary-side currents Id1, Id2 of the direct-current power supply 33, input from two current detectors 4A, 4B, before the fluctuations of the DC motors 35, 36 on the secondary side of the direct-current power supply 33 influence the primary side, that is, the alternating-current power supply side connected to the fixing unit 78. Consequently, the power can be supplied as much as possible to the fixing unit 78 within the limit of the primary-side current I supplied from the alternating-current power supply 1. Therefore, the fixing unit 78 which generates heat by the PWM control of a full-wave rectification voltage can be maintained at target temperature with good reliability.

Fifth Embodiment

Figure 8:
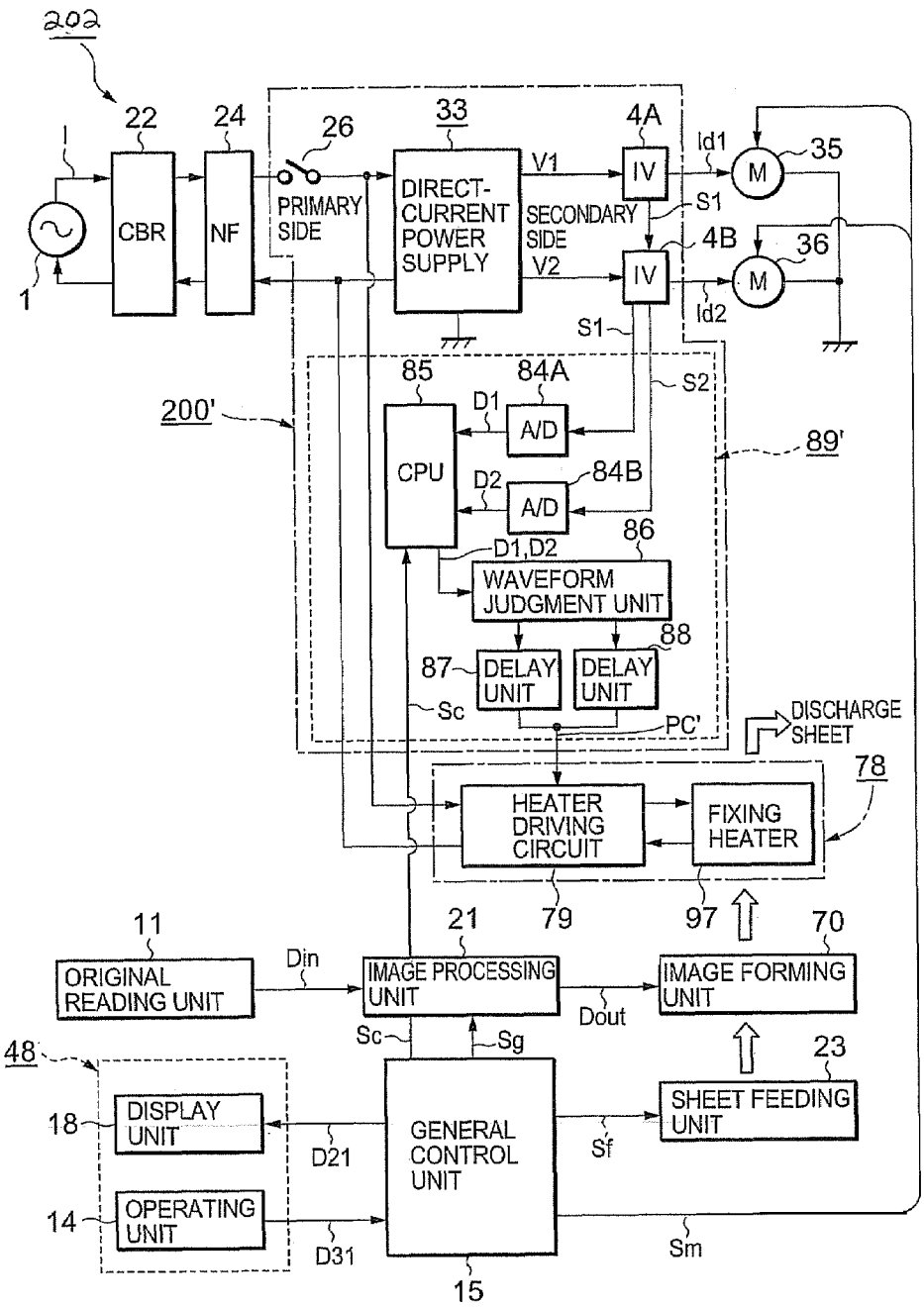
FIG. 8 is a block diagram showing a constitution example of a control system according to a fifth embodiment of the present invention for a digital copying machine 202.

FIG. 8 is a block diagram showing a constitution example of a control system according to a fifth embodiment of the present invention for a copying machine 202.

In the fifth embodiment, the power control unit 89 described in the third embodiment is modified and combined with the copying machine 201 described in the fourth embodiment, and power control unit 89' calculates and obtains a power instruction value PC in real time.

A power supply system 200' is applied to the copying machine 202 shown in FIG. 8. While a primary-side current I supplied from the alternating-current power supply 1 is restricted, powers are supplied to DC motors 35, 36 and fixing unit 78, so that an image is formed based on original image data Dout.

In this example, in the power supply system 200', the power control unit 82 of the power supply system 200 described in the fourth embodiment has been replaced with the power control unit 89'. The power control unit 89' comprises a waveform judgment unit 86 and delay units 87 and 88 in addition to A/D converters 84A, 84B and CPU 85, and the ROM 83 described in the fourth embodiment is omitted.

In the power control unit 89', the A/D converter 84A analog/digital converts a secondary-side current detection signal S1 obtained from current detector 4A, and outputs current detection data D1 relating to a secondary-side current Id1 of a direct-current power supply 33. Similarly, the A/D converter 84B analog/digital converts a secondary-side current detection signal S2 obtained from current detector 4B, and outputs current detection data D2 relating to a secondary-side current Id2 of the direct-current power supply 33. The current detection data D1, D2 after the A/D conversion are output to the CPU 85.

The CPU 85 is connected to the waveform judgment unit 86. The current detection data D1, D2 are input, and rising and falling of waveforms of the secondary-side current detection signals S1, S2 are judged. In this judgment, increase tendency and decrease tendency of a direct-current load power are detected to control power which can be supplied to the fixing unit 78. When the direct-current load power has the increase tendency, the fixing power drawn/assigned to the fixing unit 78 is decreased. Conversely, when the direct-current load power has the decrease tendency, the fixing power drawn/assigned to the fixing unit 78 is increased.

In this example, in a case where the direct-current load powers of the DC motors 35, 36 and the like have the increase tendency, that is, at the time of the rising of the secondary-side current detection signal S1 or S2, two control start points are set. At a falling time, two control start points are set. Four points in total are set, and the supply of the fixing power to the fixing unit 78 is controlled in stages. For this stage supply control, as shown in FIG. 5A, two threshold values TH1 and TH2 are set.

The waveform judgment unit 86 is connected to the delay units 87 and 88. With regard to the rising waveform of the secondary-side current detection signal S1 or S2, the delay unit 87 sets a predetermined first delay value DL1 from a time when the waveform crosses the control threshold values TH1 and TH2. With regard to the falling waveform of the secondary-side current detection signal S1, the delay unit 88 sets a predetermined second delay value DL2 from a time when the waveform crosses the threshold values TH1 and TH2.

The delay units 87 and 88 are connected to a fixing heater driving circuit 79 of the fixing unit 78, and the delay units 87 and 88 output a power instruction value PC' to the fixing heater driving circuit 79. The power instruction value PC' is control information which controls an on-period of a switch element disposed in the fixing heater driving circuit 79.

In this example, with regard to the power instruction value PC', in a period in which a direct-current load current of the DC motor 35, 36 or the like is expected to increase, and a primary-side current I is expected to exceed a limit value, the fixing power is lowered at a control start timing based on the delay value DL1 in a stepwise manner. Thereafter, the control is on standby while maintaining a state in which a certain power is supplied. The fixing power is raised in a stepwise manner at a control start timing based on the delay value DL2 from a time when the direct-current load current of the DC motor 35, 36 or the like shifts to the decrease. A state in which the fixing power is supplied is maintained within the limit of the use current I.

It is to be noted that components having the same names and reference numerals as those of the fourth embodiment have the same functions, and therefore the description is omitted. Since an operation example of the copying machine 202 is similar to that of the copying machine 101 of the first embodiment except that the power control unit 89' determines the power instruction value PC' based on the current detection data D1, D2, the description is omitted.

Thus, the copying machine 202 of the fifth embodiment comprises the power supply system 200', and relates to a case where the primary-side current I supplied from the alternating-current power supply 1 is restricted. At the time of fluctuations of the DC motors 35, 36, two current detectors 4A, 4B detect the secondary-side currents Id1, Id2 of the direct-current power supply 33. After the A/D conversion, the secondary-side current detection signals S1, S2 are output as the current detection data D1, D2 to the CPU 85. The CPU 85 outputs the current detection data D1, D2 to the waveform judgment unit 86.

The waveform judgment unit 86 inputs the current detection data D1, D2, and judges the rising and falling of the waveforms of the secondary-side current detection signals S1, S2. When the direct-current load power of the DC motor 35, 36 or the like has the increase tendency, the fixing power drawn/assigned to the fixing unit 78 is decreased. Conversely, when the direct-current load powers have the decrease tendency, the fixing power drawn/assigned to the fixing unit 78 is increased.

Therefore, the CPU 85 can instantaneously control the power which can be supplied to the fixing unit 78 based on the current detection data D1 based on the secondary-side currents Id1, Id2 of the direct-current power supply 33, input from two current detectors 4A, 4B, before the fluctuations of the DC motors 35, 36 on the secondary side of the direct-current power supply 33 influence the primary side, that is, the alternating-current power supply side connected to the fixing unit 78. Moreover, by the stepwise supply control system by the power control unit 89, the supply of the fixing power can be controlled in the stepwise manner. Moreover, the current I supplied from the alternating-current power supply 1 is usable fully up to the limit value, and more fixing power can be supplied to a fixing heater 97 as compared with the conventional system.

Sixth Embodiment

Figure 9:
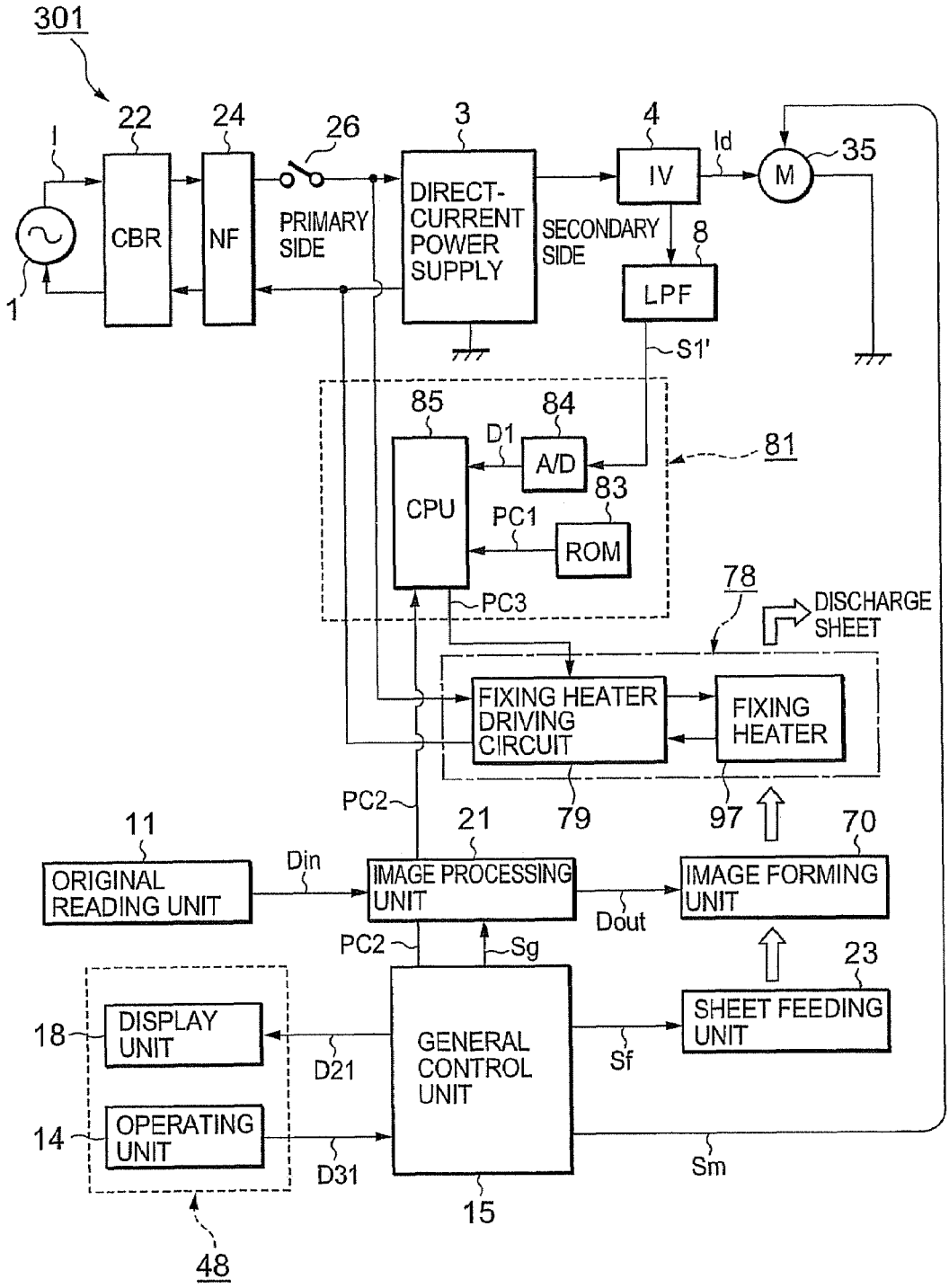
FIG. 9 is a block diagram showing a constitution example of a control system according to a sixth embodiment of the present invention for a digital copying machine 301.

FIG. 9 is a block diagram showing a constitution example of a control system according to a sixth embodiment of the present invention for a copying machine 301. In this fifth embodiment, a noise reducing unit is combined with the copying machine 101 described in the first embodiment to constitute the copying machine 301.

The copying machine 301 shown in FIG. 9 is constituted in such a manner as to supply powers to a DC motor 35 and fixing unit 78, while a primary-side current I supplied from an alternating-current power supply 1 is restricted, so that an image is formed based on original image data Dout.

In this example, a low pass filter (LPF) 8 which is one example of the noise reducing unit is connected between current detector 4 and an A/D converter 84 of power control unit 81. After filtering a secondary-side current detection signal S1 output from the current detector 4, a secondary-side current detection signal S1' is output to the power control unit 81. In the power control unit 81, the A/D converter 84 A/D-converts the secondary-side current detection signal S1' after the noise reduction. A CPU 85 is constituted in such a manner as to read a power instruction value PC1 from an ROM 83 using A/D-converted current detection data D1 an address. The CPU 85 is constituted in such a manner as to control power supply to the fixing unit 78 connected to the alternating-current power supply 1 based on a comparison result of the power instruction value PC1 with a power instruction value PC2 from general control unit 15.

It is to be noted that components having the same names and reference numerals as those of the first embodiment have the same functions, and therefore the description is omitted. Since an operation example of the copying machine 301 is similar to that of the copying machine 101 of the first embodiment except that the CPU 85 controls the power supply to the fixing unit 78 based on the current detection data D1 after the noise reduction, description is omitted.

Thus, the copying machine 301 according to the sixth embodiment relates to a case where the primary-side current I supplied from the alternating-current power supply 1 is restricted, the low pass filter (LPF) 8 is connected between the current detector 4 and the power control unit 81. The secondary-side current detection signal S1' is obtained after filtering the secondary-side current detection signal S1 output from the current detector 4, and is output to the power control unit 81.

Therefore, the CPU 85 can instantaneously control the power which can be supplied to the fixing unit 78 based on the current detection data D1 after the noise reduction before the direct-current load fluctuation on the secondary side of the direct-current power supply 3 influences the primary side, that is, an alternating-current power supply side connected to the fixing unit 78.

Consequently, the power can be supplied as much as possible to the fixing unit 78 within the limit of the primary-side current I supplied from the alternating-current power supply 1 in the same manner as in the first embodiment. Therefore, the fixing unit 78 which generates heat by PWM control of a full-wave rectification voltage can be maintained at target temperature with good reliability.

Seventh Embodiment

Figure 10:
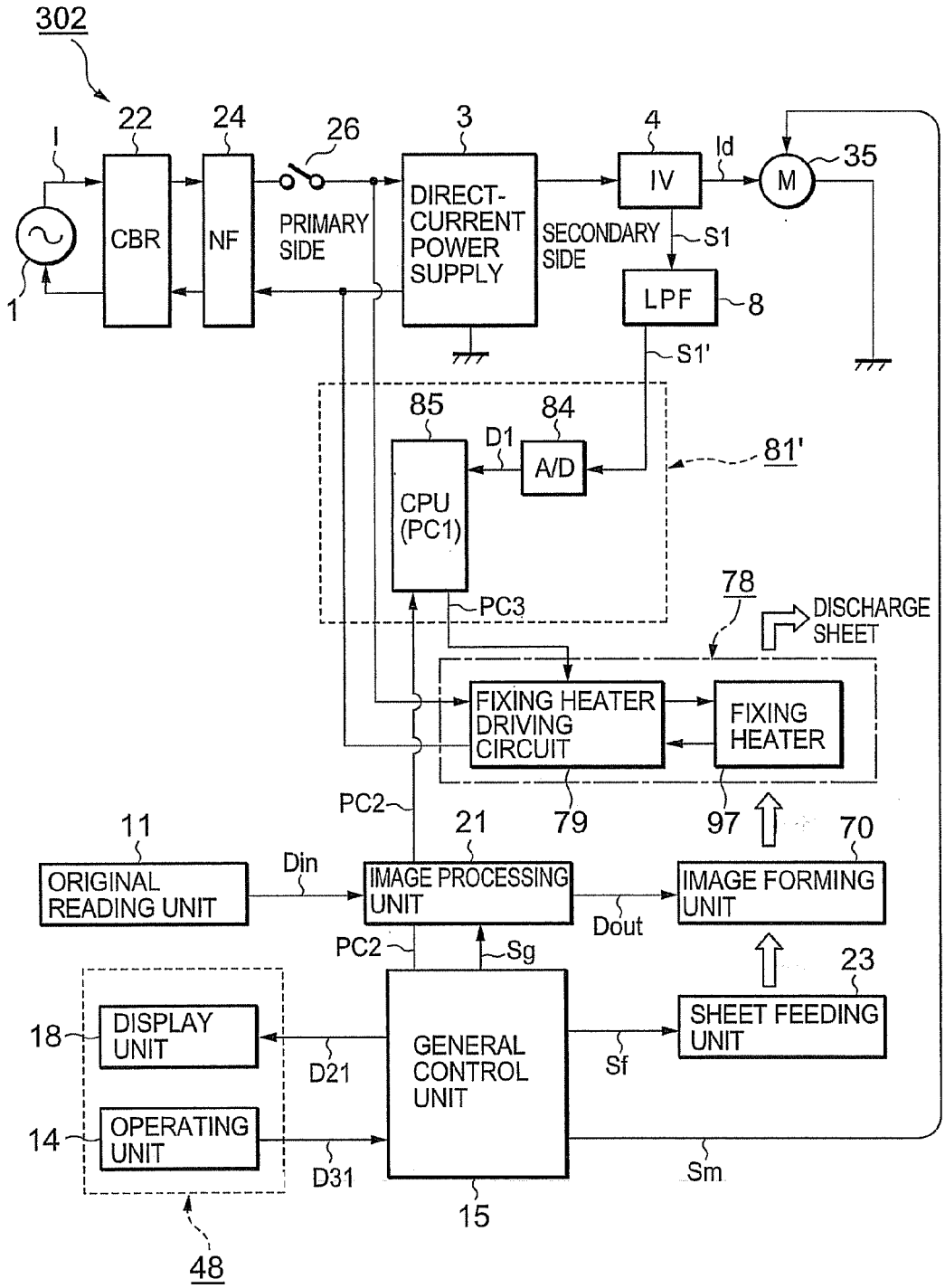
FIG. 10 is a block diagram showing a constitution example of a control system according to a seventh embodiment of the present invention for a digital copying machine 302.

FIG. 10 is a block diagram showing a constitution example of a control system according to a seventh embodiment of the present invention for a copying machine 302. In this seventh embodiment, the noise reducing unit is combined with the copying machine 102 described in the second embodiment to constitute the copying machine 302. In power control unit 81', a CPU 85 of such a type that a power instruction value PC1 is calculated in real time is used.

The copying machine 302 shown in FIG. 10 is constituted in such a manner as to supply powers to a DC motor 35 and fixing unit 78, while a primary-side current I supplied from an alternating-current power supply 1 is restricted, so that an image is formed based on original image data Dout.

In this example, the copying machine 302 comprises the power control unit 81'. A low pass filter (LPF) 8 is connected between current detector 4 and an A/D converter 84 of the power control unit 81'. After filtering a secondary-side current detection signal S1 output from the current detector 4, a secondary-side current detection signal S1' is output to the power control unit 81'. In the power control unit 81', the A/D converter 84 A/D-converts the secondary-side current detection signal S1' after the noise reduction to output current detection data D1. The CPU 85 is constituted in such a manner as to calculate the power instruction value PC1 based on the current detection data D1 subjected to the A/D conversion. The CPU 85 is constituted in such a manner as to control power supply to the fixing unit 78 connected to the alternating-current power supply 1 based on a comparison result of the calculated power instruction value PC1 with a power instruction value PC2 from general control unit 15.

It is to be noted that components having the same names and reference numerals as those of the second embodiment have the same functions, and therefore the description is omitted. Since an operation example of the copying machine 302 is similar to that of the copying machine 102 of the second embodiment except that the power control unit 81' controls the power supply to the fixing unit 78 based on the secondary-side current detection signal S1' after the noise reduction, description is omitted.

Thus, the copying machine 302 according to the seventh embodiment relates to a case where the primary-side current I supplied from the alternating-current power supply 1 is restricted, the low pass filter (LPF) 8 is connected between the current detector 4 and the power control unit 81'. The secondary-side current detection signal S1' is obtained after filtering the secondary-side current detection signal S1 output from the current detector 4, and is output to the power control unit 81'.

Therefore, the CPU 85 can instantaneously control the power which can be supplied to the fixing unit 78 based on the secondary-side current detection signal S1' after the noise reduction before the direct-current load fluctuation on the secondary side of the direct-current power supply 3 influences the primary side, that is, an alternating-current power supply side connected to the fixing unit 78.

Consequently, the power can be supplied as much as possible to the fixing unit 78 within the limit of the primary-side current I supplied from the alternating-current power supply 1 in the same manner as in the second embodiment. Therefore, the fixing unit 78 which generates heat by PWM control of a full-wave rectification voltage can be maintained at target temperature with good reliability.

Eighth Embodiment

Figure 11:
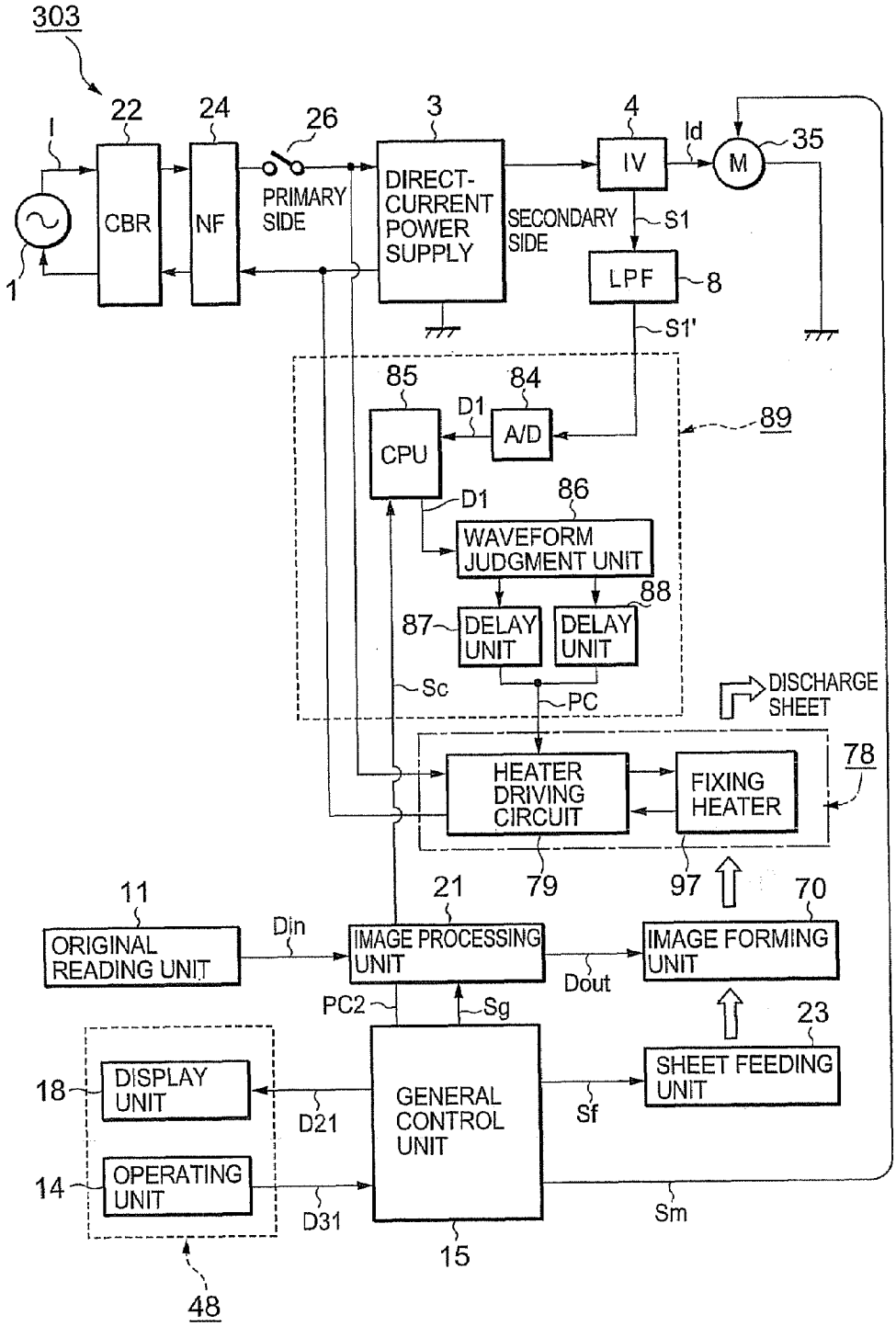
FIG. 11 is a block diagram showing a constitution example of a control system according to an eighth embodiment of the present invention for a digital copying machine 303.

FIG. 11 is a block diagram showing a constitution example of a control system according to an eighth embodiment of the present invention for a digital copying machine 303. In this eighth embodiment, the noise reducing unit is combined with the copying machine 103 described in the third embodiment to constitute the digital copying machine 303. Power control unit 89 comprises a waveform judgment unit 86, and a CPU 85 of such a type that a power instruction value PC is calculated in real time is used.

The copying machine 303 shown in FIG. 11 is constituted in such a manner as to supply powers to a DC motor 35 and fixing unit 78, while a primary-side current I supplied from an alternating-current power supply 1 is restricted, so that an image is formed based on original image data Dout.

In this example, the digital copying machine 303 comprises the power control unit 89. A low pass filter (LPF) 8 is connected between current detector 4 and an A/D converter 84 of the power control unit 89. A secondary-side current detection signal S1' is obtained after filtering a secondary-side current detection signal S1 output from the current detector 4, and is output to the power control unit 89.

In the power control unit 89, the A/D converter 84 A/D-converts the secondary-side current detection signal S1' after the noise reduction, and outputs current detection data D1. The CPU 85 transmits the A/D-converted current detection data D1 to the waveform judgment unit 86. The waveform judgment unit 86 outputs a power instruction value PC based on control start timings T1 to T4 described in the third embodiment to a fixing heater driving circuit 79, and controls power supply to the fixing unit 78 connected to the alternating-current power supply 1.

It is to be noted that components having the same names and reference numerals as those of the third embodiment have the same functions, and therefore the description is omitted. Since an operation example of the copying machine 303 is similar to that of the copying machine 103 of the third embodiment except that the power control unit 89 controls the power supply to the fixing unit 78 based on the secondary-side current detection signal S1' after the noise reduction, the description is omitted.

Thus, the copying machine 303 according to the eighth embodiment relates to a case where the primary-side current I supplied from the alternating-current power supply 1 is restricted. The low pass filter (LPF) 8 is connected between the current detector 4 and the power control unit 89. The secondary-side current detection signal S1' is obtained after filtering the secondary-side current detection signal S1 output from the current detector 4, and is output to the power control unit 89.

Therefore, the CPU 85 can instantaneously control the power which can be supplied to the fixing unit 78 based on the secondary-side current detection signal S1' after the noise reduction, before the direct-current load fluctuations of the DC motor 35 or the like on the secondary side of the direct-current power supply 3 influence the primary side, that is, the alternating-current power supply side connected to the fixing unit 78.

Consequently, the power can be supplied as much as possible to the fixing unit 78 within the limit of the primary-side current I supplied from the alternating-current power supply 1 in the same manner as in the third embodiment. Therefore, the fixing unit 78 which generates heat by PWM control of a full-wave rectification voltage can be maintained at target temperature with good reliability.

Ninth Embodiment

Figure 12:
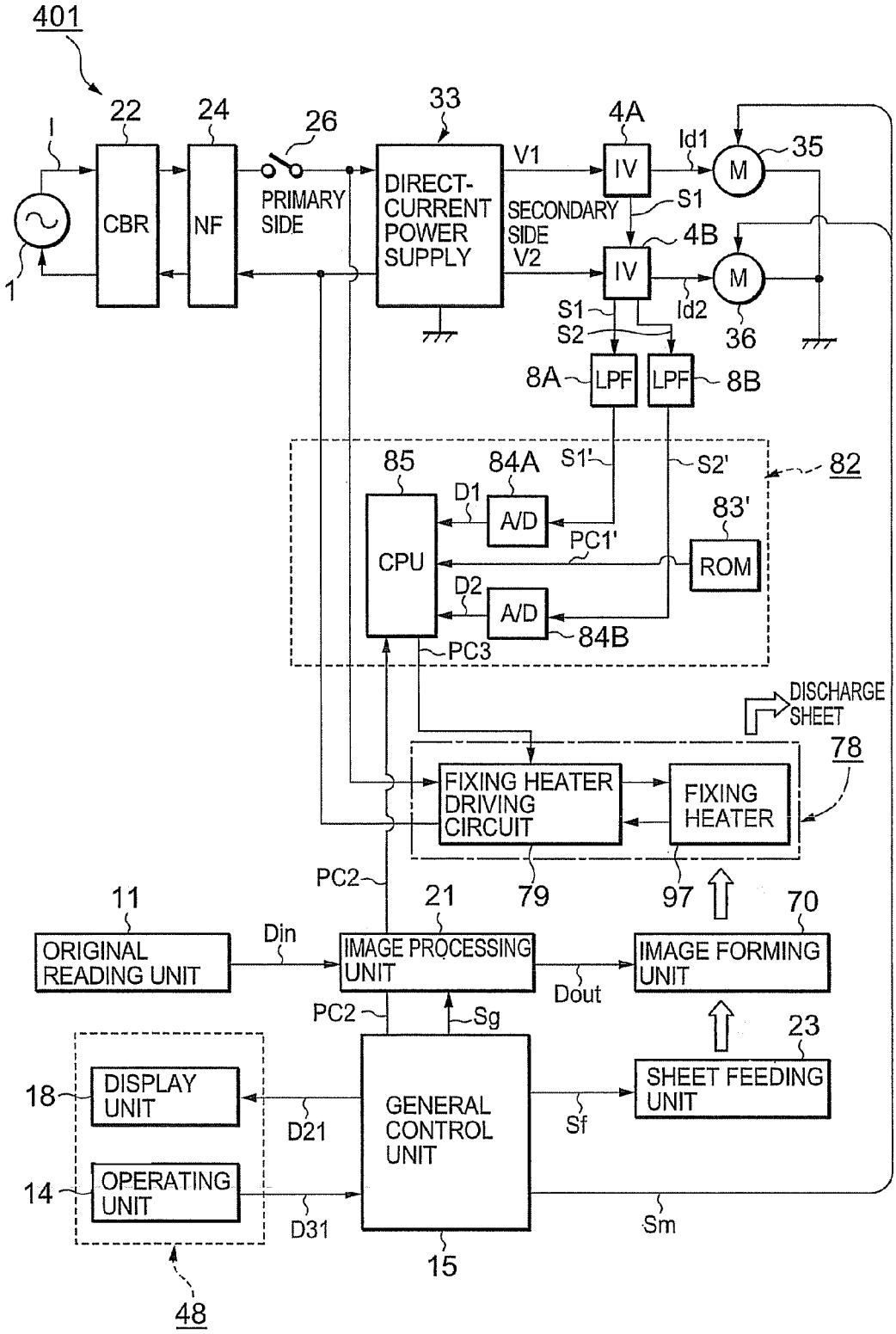
FIG. 12 is a block diagram showing a constitution example of a control system according to a ninth embodiment of the present invention for a digital copying machine 401.

FIG. 12 is a block diagram showing a constitution example of a control system according to a ninth embodiment of the present invention for a copying machine 401. In this ninth embodiment, the copying machine 201 described in the fourth embodiment is combined with the noise reducing unit to constitute the copying machine 401. Power control unit 82 comprises an ROM 83. A CPU 85 is constituted in such a manner as to read an optimum power instruction value PC1 from the ROM 83 based on current detection data D1, D2.

The copying machine 401 shown in FIG. 12 is constituted in such a manner that a primary-side current I supplied from an alternating-current power supply 1 is restricted, while powers are supplied to DC motors 35, 36 and fixing unit 78 to form an image based on original image data Dout.

In this example, the copying machine 401 comprises the power control unit 82. A first low pass filter (LPF) 8A is connected between current detector 4A and an A/D converter 84A of the power control unit 82. A secondary-side current detection signal S1' is obtained after filtering a secondary-side current detection signal S1 output from the current detector 4A, and is output to the power control unit 82. A second low pass filter (LPF) 8B is connected between current detector 4B and an A/D converter 84B of the power control unit 82. A secondary-side current detection signal S2' is obtained after filtering a secondary-side current detection signal S2 output from the current detector 4B, and is output to the power control unit 82.

The A/D converter 84A in the power control unit 82 A/D-converts the secondary-side current detection signal S1' after the noise reduction to output the current detection data D1. The A/D converter 84B A/D-converts a secondary-side current detection signal S2' after the noise reduction to output the current detection data D2. The CPU 85 is constituted in such a manner as to read an optimum power instruction value PC1 from the ROM 83 based on the current detection data D1, D2 after this A/D conversion. The CPU 85 is constituted in such a manner as to control power supply to the fixing unit 78 connected to the alternating-current power supply 1 based on a comparison result of the power instruction value PC1 with the power instruction value PC2 from general control unit 15.

It is to be noted that components having the same names and reference numerals as those of the fourth embodiment have the same functions, and therefore the description is omitted. Since an operation example of the copying machine 401 is similar to that of the copying machine 201 of the fourth embodiment except that the power control unit 82 controls the power supply to the fixing unit 78 based on the secondary-side current detection signal S1' after the noise reduction, the description is omitted.

Thus, the copying machine 401 according to the ninth embodiment relates to a case where the primary-side current I supplied from the alternating-current power supply 1 is restricted. Low pass filters (LPF) 8A, 8B are connected between the current detectors 4A, 4B and the power control unit 82. The secondary-side current detection signals S1', S2' are obtained after filtering the secondary-side current detection signals S1, S2 output from the current detectors 4A, 4B, respectively, and are output to the power control unit 82.

Therefore, the CPU 85 of the power control unit 82 can instantaneously control the power which can be supplied to the fixing unit 78 based on the current detection data D1, D2 after the noise reduction before the direct-current load fluctuations of the DC motors 35, 36 and the like on the secondary side of a direct-current power supply 33 influence the primary side, that is, the alternating-current power supply side connected to the fixing unit 78.

Consequently, the power can be supplied as much as possible to the fixing unit 78 within the limit of the primary-side current I supplied from the alternating-current power supply 1 in the same manner as in the fourth embodiment. Therefore, the fixing unit 78 which generates heat by PWM control of a full-wave rectification voltage can be maintained at target temperature with good reliability.

Tenth Embodiment

Figure 13:
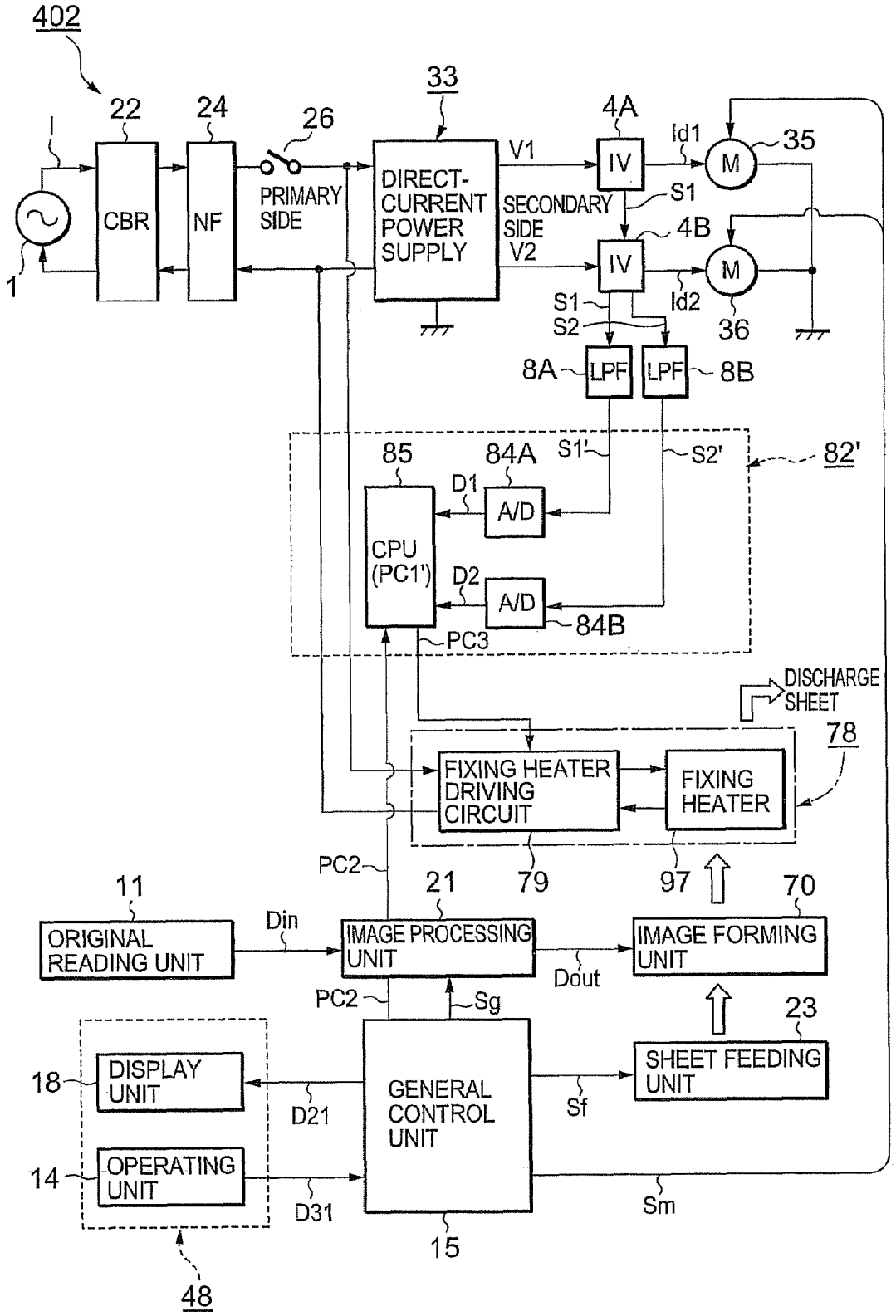
FIG. 13 is a block diagram showing a constitution example of a control system according to a tenth embodiment of the present invention for a digital copying machine 402.

FIG. 13 is a block diagram showing a constitution example of a control system according to a tenth embodiment of the present invention for a copying machine 402. In the tenth embodiment, a modification of the copying machine 201 according to the fourth embodiment is combined with the noise reducing unit to constitute the copying machine 402. An ROM 83 is omitted from power control unit 82', and a CPU 85 is constituted in such a manner as to calculate an optimum power instruction value PC1 based on current detection data D1, D2.

The copying machine 402 shown in FIG. 13 is constituted in such a manner as to supply powers to DC motors 35, 36 and fixing unit 78, while a primary-side current I supplied from an alternating-current power supply 1 is restricted, so that an image is formed based on original image data Dout.

In this example, the copying machine 402 comprises the power control unit 82'. A first low pass filter (LPF) 8A is connected between current detector 4A and an A/D converter 84A of the power control unit 82'. A secondary-side current detection signal S1' is obtained after filtering a secondary-side current detection signal S1 output from the current detector 4A, and is output to the power control unit 82'. A second low pass filter (LPF) 8B is connected between current detector 4B and an A/D converter 84B of the power control unit 82'. A secondary-side current detection signal S2' is obtained after filtering a secondary-side current detection signal S2 output from the current detector 4B, and is output to the power control unit 82'.

The A/D converter 84A in the power control unit 82' A/D-converts the secondary-side current detection signal S1' after the noise reduction to output the current detection data D1. The A/D converter 84B A/D-converts the secondary-side current detection signal S2' after the noise reduction to output the current detection data D2. The CPU 85 is constituted in such a manner as to calculate an optimum power instruction value PC1 based on the current detection data D1, D2 after this A/D conversion in real time. The CPU 85 is constituted in such a manner as to control power supply to the fixing unit 78 connected to the alternating-current power supply 1 based on a comparison result of the power instruction value PC1 with the power instruction value PC2 from general control unit 15.

It is to be noted that components having the same names and reference numerals as those of the fourth embodiment have the same functions, and therefore the description is omitted. Since an operation example of the copying machine 402 is similar to that of the copying machine 201 of the fourth embodiment except that the power control unit 82' controls the power supply to the fixing unit 78 based on the secondary-side current detection signal S1' after the noise reduction, the description is omitted.

Thus, the copying machine 402 according to the tenth embodiment relates to a case where the primary-side current I supplied from the alternating-current power supply 1 is restricted. The low pass filters (LPF) 8A, 8B are connected between the current detectors 4A, 4B and the power control unit 82'. The secondary-side current detection signals S1', S2' are obtained after filtering the secondary-side current detection signals S1, S2 output from the current detectors 4A, 4B, respectively, and are output to the power control unit 82'.

Therefore, the CPU 85 of the power control unit 82' can instantaneously control the power which can be supplied to the fixing unit 78 based on the current detection data D1, D2 after the noise reduction, before the direct-current load fluctuations of the DC motors 35, 36 and the like on the secondary side of a direct-current power supply 33 influence the primary side, that is, the alternating-current power supply side connected to the fixing unit 78.

Consequently, the power can be supplied as much as possible to the fixing unit 78 within the limit of the primary-side current I supplied from the alternating-current power supply 1 in the same manner as in the fourth embodiment. Therefore, the fixing unit 78 which generates heat by PWM control of a full-wave rectification voltage can be maintained at target temperature with good reliability.

Eleventh Embodiment

Figure 14:
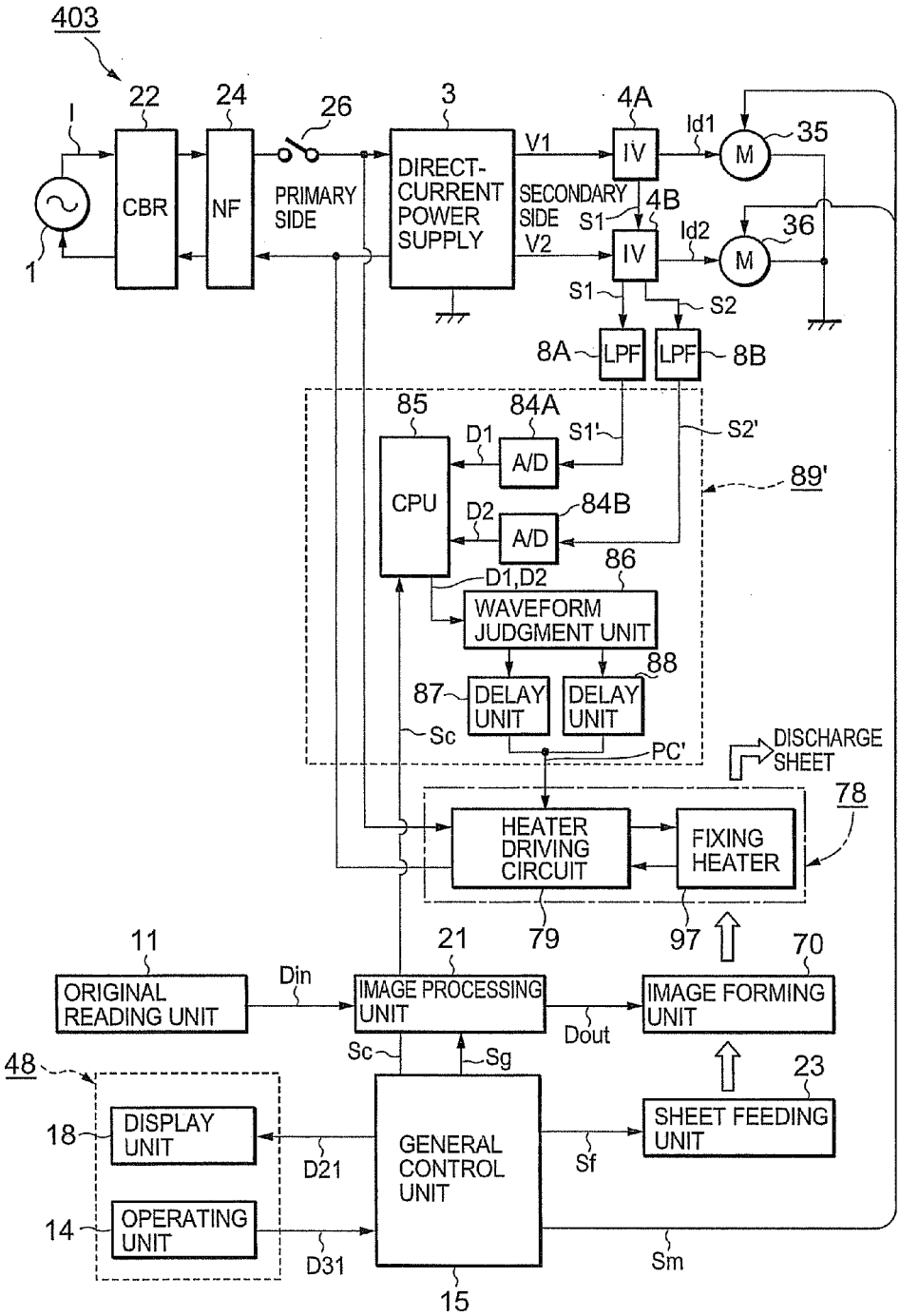
FIG. 14 is a block diagram showing a constitution example of a control system according to an eleventh embodiment of the present invention for a digital copying machine 403.

FIG. 14 is a block diagram showing a constitution example of a control system according to an eleventh embodiment of the present invention for a copying machine 403. In the eleventh embodiment, the copying machine 202 according to the fifth embodiment is combined with the noise reducing unit to constitute the copying machine 403. Power control unit 89' comprises a waveform judgment unit 86, and delay units 87 and 88. The waveform judgment unit 86 is constituted in such a manner as to set an optimum power instruction value PC to a fixing heater driving circuit 79 based on current detection data D1, D2.

The copying machine 403 shown in FIG. 14 is constituted in such a manner as to supply powers to DC motors 35, 36 and fixing unit 78, while a primary-side current I supplied from an alternating-current power supply 1 is controlled, so that an image is formed based on original image data Dout.

In this example, the copying machine 403 comprises the power control unit 89'. A first low pass filter (LPF) 8A is connected between current detector 4A and an A/D converter 84A of the power control unit 89'. A secondary-side current detection signal S1' is obtained after filtering a secondary-side current detection signal S1 output from the current detector 4A, and is output to the power control unit 89'. A second low pass filter (LPF) 8B is connected between current detector 4B and an A/D converter 84B of the power control unit 89'. A secondary-side current detection signal S2' is obtained after filtering a secondary-side current detection signal S2 output from the current detector 4B, and is output to the power control unit 89'.

The A/D converter 84A in the power control unit 89' A/D-converts the secondary-side current detection signal S1' after the noise reduction to output current detection data D1. The A/D converter 84B A/D-converts the secondary-side current detection signal S2' after the noise reduction to output current detection data D2. The CPU 85 transmits the A/D-converted current detection data D1, D2 to the waveform judgment unit 86. The waveform judgment unit 86 outputs a power instruction value PC' based on control start timings T1 to T4 described in the third embodiment to the fixing heater driving circuit 79, and controls power supply to the fixing unit 78 connected to the alternating-current power supply 1.

It is to be noted that components having the same names and reference numerals as those of the fifth embodiment have the same functions, and therefore the description is omitted. Since an operation example of the copying machine 403 is similar to that of the copying machine 202 of the fifth embodiment except that the power control unit 89' controls the power supply to the fixing unit 78 based on the secondary-side current detection signal S1' after the noise reduction, the description is omitted.

Thus, the copying machine 403 according to the eleventh embodiment relates to a case where the primary-side current I supplied from the alternating-current power supply 1 is restricted. The low pass filters (LPF) 8A, 8B are connected between the current detectors 4A, 4B and the power control unit 89'. The secondary-side current detection signals S1', S2' are obtained after filtering the secondary-side current detection signals S1, S2 output from the current detectors 4A, 4B, respectively, and are output to the power control unit 89'.

Therefore, the CPU 85 of the power control unit 89' can instantaneously control the power which can be supplied to the fixing unit 78 based on the current detection data D1, D2 after the noise reduction, before the direct-current load fluctuations of the DC motors 35, 36 and the like on the secondary side of a direct-current power supply 3 influence the primary side, that is, the alternating-current power supply side connected to the fixing unit 78.

Consequently, the power can be supplied as much as possible to the fixing unit 78 within the limit of the primary-side current I supplied from the alternating-current power supply 1 in the same manner as in the fifth embodiment. Therefore, the fixing unit 78 which generates heat by PWM control of a full-wave rectification voltage can be maintained at target temperature with good reliability.

Twelfth Embodiment

Figure 15:
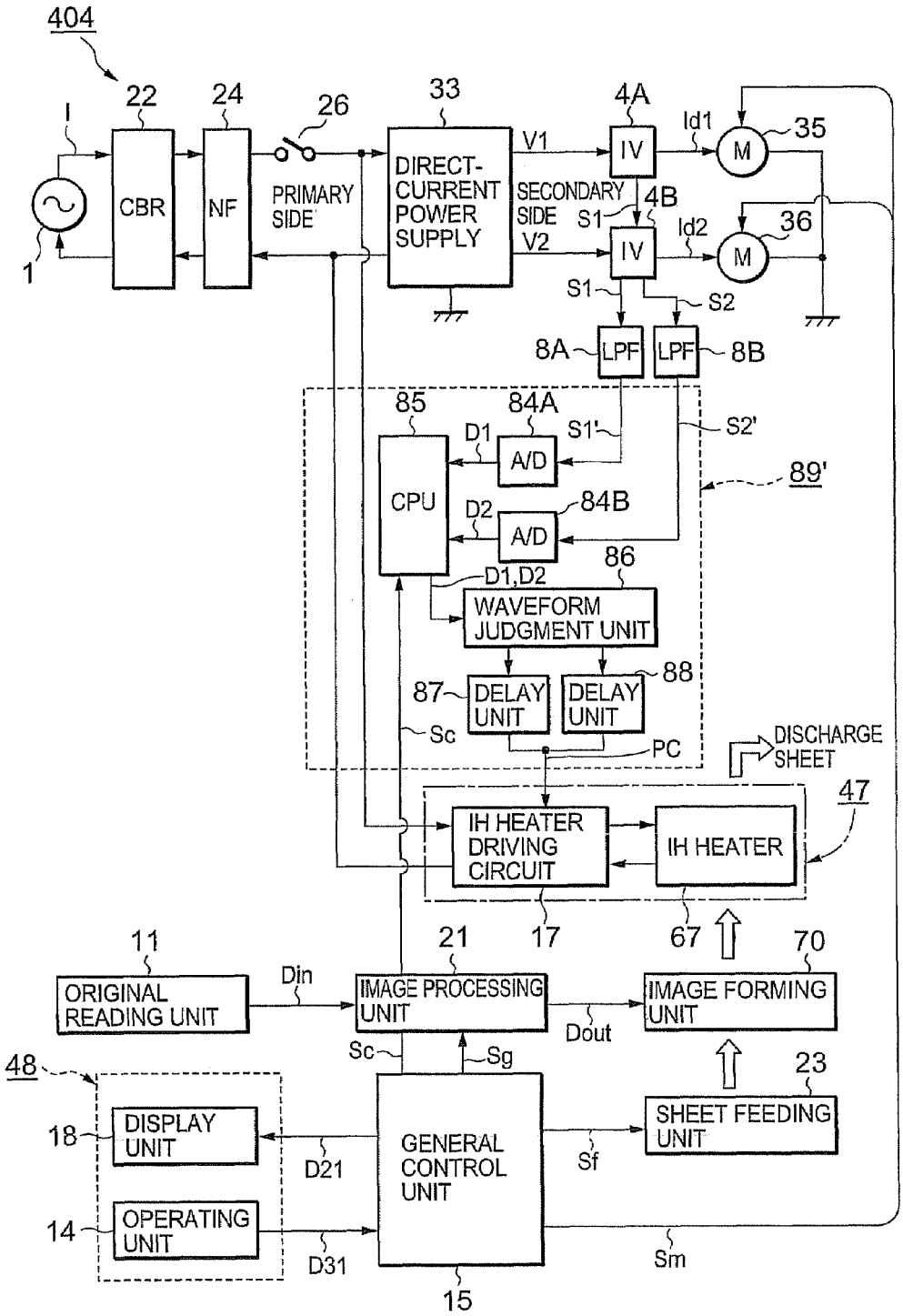
FIG. 15 is a block diagram showing a constitution example of a control system according to a twelfth embodiment of the present invention for a digital copying machine 404.

FIG. 15 is a block diagram showing a constitution example of a control system according to a twelfth embodiment of the present invention for a copying machine 404. In this twelfth embodiment, the fixing unit of the copying machine 403 described in the eleventh embodiment is replaced with an IH heater driving system to constitute the copying machine 404.

The copying machine 404 shown in FIG. 15 is constituted in such a manner as to supply powers to DC motors 35, 36 and fixing unit 47, while a primary-side current I supplied from an alternating-current power supply 1 is restricted, so that an image is formed based on original image data Dout. The fixing unit 47 comprises an IH heater driving circuit 17 and an IH heater (electromagnetic induction heater) 67. The IH heater driving circuit 17 is constituted in such a manner as to drive the IH heater 67 based on a power instruction value PC from power control unit 89'. For example, a waveform judgment unit 86 in the power control unit 89' outputs, to the IH heater driving circuit 17, a power instruction value PC' based on control start timings T1 to T4 described in the third embodiment, and controls power supply to the IH heater 67 connected to the alternating-current power supply 1.

It is to be noted that components having the same names and reference numerals as those of the eleventh embodiment have the same functions, and therefore the description is omitted. Since an operation example of the copying machine 404 is similar to that of the copying machine 202 according to the eleventh embodiment except that the power control unit 89' controls power supply to the IH heater 67 based on a secondary-side current detection signal S1' after noise reduction, the description is omitted.

Thus, the copying machine 404 according to the twelfth embodiment relates to a case where the primary-side current I supplied from the alternating-current power supply 1 is restricted. Low pass filters (LPF) 8A, 8B are connected between current detectors 4A, 4B and the power control unit 89'. Secondary-side current detection signals S1', S2' are obtained after filtering secondary-side current detection signals S1, S2 output from the current detectors 4A, 4B, respectively, and are output to the power control unit 89'.

Therefore, the waveform judgment unit 86 of the power control unit 89' can efficiently control the power which can be supplied to the IH heater 67 based on current detection data D1, D2 after the noise reduction, before direct-current load fluctuations of the DC motors 35, 36 and the like on the secondary side of a direct-current power supply 33 influence the primary side, that is, the alternating-current power supply side connected to the IH heater 67 via the driving circuit 17.

Consequently, the power can be supplied as much as possible to the IH heater 67 within the limit of the primary-side current I supplied from the alternating-current power supply 1 in the same manner as in the fifth embodiment. Therefore, the fixing unit 47 which generates heat by PWM control of a full-wave rectification voltage can be maintained at target temperature with good reliability.

Thirteenth Embodiment

Figure 16:
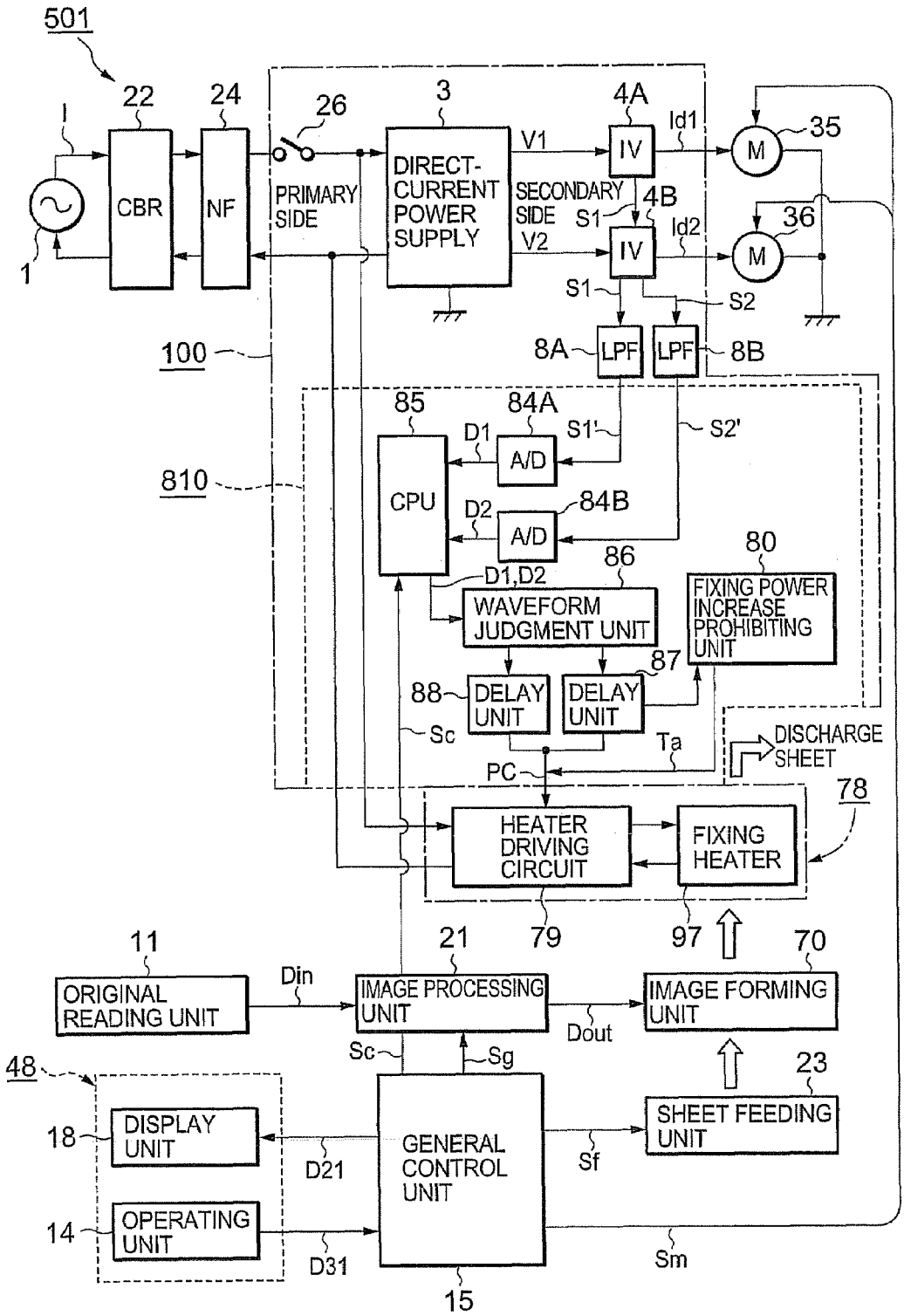
FIG. 16 is a block diagram showing a constitution example of a control system according to a thirteenth embodiment of the present invention for a digital copying machine 501.

FIG. 16 is a block diagram showing a constitution example of a control system according to a thirteenth embodiment of the present invention for a copying machine 501.

In the copying machine 501 shown in FIG. 16, the power control unit 89' described in the eleventh embodiment is replaced with power control unit 810. The power control unit 810 controls power which can be supplied to fixing unit 78 based on a secondary-side current detection signal S1' of a direct-current power supply 3, output from current detector 4A through an LPF 8A, and a secondary-side current detection signal S2' of the direct-current power supply 3, output from current detector 4B through an LPF 8B. The power control unit has, for example, analog/digital converters (hereinafter referred to as the A/D converters) 84A, 84B, a CPU 85, a waveform judgment unit 86, delay units 87 and 88, and a fixing power increase prohibiting unit 80. It is to be noted that components having the same names and reference numerals as those of the eleventh embodiment have the same functions, and therefore the description is omitted.

The A/D converter 84A analog/digital converts a filtered secondary-side current detection signal S1 obtained from the current detector 4A, and outputs current detection data D1 on the secondary side of the direct-current power supply 3. The current detection data D1 is detection information relating to a secondary-side current Id1 of the direct-current power supply 3.

The A/D converter 84B analog/digital converts a filtered secondary-side current detection signal S2 obtained from the current detector 4B, and outputs current detection data D2 on the secondary side of the direct-current power supply 3. The current detection data D2 is detection information relating to a secondary-side current Id2 of the direct-current power supply 3.

The A/D converters 84A and 84B are connected to the CPU 85, and the CPU 85 is further connected to the waveform judgment unit 86. The CPU 85 transmits the A/D-converted current detection data D1, D2 to the waveform judgment unit 86. The waveform judgment unit 86 inputs the current detection data D1, D2, and judges rising and falling with respect to waveforms of the secondary-side current detection signals S1, S2.

In this judgment, increase tendency and decrease tendency of a direct-current load power are detected to control a power which can be supplied to the fixing unit 78 for the fixing. When the direct-current load power has the increase tendency, the fixing power drawn/assigned to the fixing unit 78 is decreased. Conversely, when the direct-current load power has the decrease tendency, the fixing power drawn/assigned to the fixing unit 78 is increased.

Figures 17A, 17B:
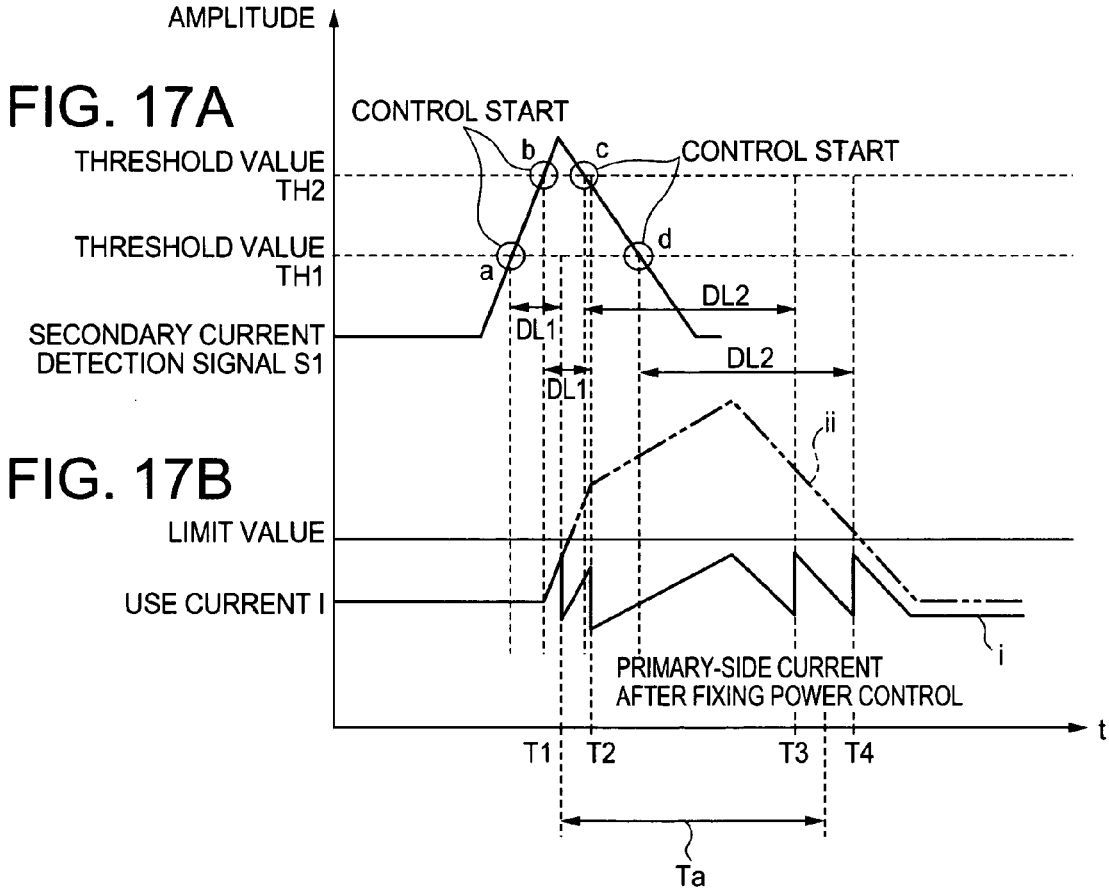
FIGS. 17(A) and (B) are diagrams showing waveform examples of a secondary-side current detection signal S1 and a use current (current on the primary side) from an alternating-current power supply 1.

In this example, to decrease fixing power, the CPU 85 continuously permits the decrease. After the fixing power is decreased, the CPU restricts increase control of the fixing power until a predetermined time elapses. For example, in a case where the direct-current load powers of the DC motors 35, 36 have the increase tendency, that is, at the time of the rising of the secondary-side current detection signal S1, two control start points are set. At a falling time, two control start points are set. Four points in total are set, and the supply of the fixing power to the fixing unit 78 is controlled in stages. For this stage supply control, as shown in FIG. 17A, two threshold values TH1 and TH2 are set.

The waveform judgment unit 86 is connected to the delay units 87 and 88 and the fixing power increase prohibiting unit 80. With regard to the rising waveform of the secondary-side current detection signal S1, the delay unit 87 sets a predetermined first delay period DL1 from a time when the waveform crosses the threshold values TH1 and TH2. With regard to the falling waveform of the secondary-side current detection signal S1, the delay unit 88 sets a predetermined second delay period DL2 from a time when the waveform crosses the threshold values TH1 and TH2.

In this example, the fixing power increase prohibiting unit 80 is connected between the delay unit 87, and an output stage of the delay units 87 and 88. When the direct-current load power has the increase tendency, and after the fixing power is decreased, the prohibiting unit operates in such a manner as to restrict the increase control of the fixing power until a predetermined time elapses. For example, a fixing power increase prohibiting period Ta is set between ends of the delay periods DL1 and DL2, preferably between midpoints of two delay periods DL2. The fixing power increase prohibiting unit 80 comprises, for example, a timer counter. The prohibiting unit is designed in such a manner as to start in the end of the delay period DL1, count a reference clock signal and the like, and have a time-up in the midpoint of the delay period DL2 (sixth image forming apparatus).

The output stage of the above-described delay units 87 and 88 and fixing power increase prohibiting unit 80 is connected to the fixing unit 78. The fixing unit 78 operates in such a manner as to thermally fix a toner image formed on a sheet P by image forming unit 70. The fixing unit 78 comprises a fixing heater driving circuit 79 and a fixing heater 97.

In this example, a power instruction value PC is output to the fixing heater driving circuit 79 from the delay units 87 and 88 and the fixing power increase prohibiting unit 80. The power instruction value PC is control information which controls an on-period of a switch element disposed in the fixing heater driving circuit 79. With regard to the power instruction value PC, in a period in which a direct-current load current of the DC motor 35, 36 or the like is expected to increase, and the primary-side current I is expected to exceed a limit value, the fixing power is lowered at a control start timing based on the delay period DL1 in a stepwise manner. After decreasing the fixing power, the control is on standby while maintaining a state in which a certain power is supplied.

Moreover, the increase control of the fixing power is restricted until the fixing power increase prohibiting period Ta elapses. This is because when the fixing power increase control is executed in a case where the secondary-side current Id1 or Id2 rapidly fluctuates, the current is presumed to exceed the primary-side use current I in some case. Therefore, after the fixing power increase prohibiting period Ta elapses, and when the direct-current load current of the DC motor 35, 36 or the like shifts to the decrease, the fixing power is raised in the stepwise manner at the control start timing based on the delay period DL2. A state in which the fixing power is supplied is maintained within the limit of the use current I (second image forming apparatus).

FIGS. 17(A) and (B) are diagrams showing waveform examples of the secondary-side current detection signal S1 and a use current (current on the primary side) I from an alternating-current power supply 1. They show that the fixing power increase prohibiting period Ta is set to the waveform example shown in FIGS. 5(A) and (B). In FIGS. 17(A) and (B), the same names and reference numerals as those of the waveform example shown in FIGS. 5(A) and (B) indicate the same functions and operations, and therefore the description is omitted.

The waveform shown by the solid line in FIG. 17(B) indicates the primary-side current (use current) I supplied from the alternating-current power supply 1, and indicates a case where stepwise supply control i according to the present invention is carried out. In the figure, a waveform shown by a two-dot chain line indicates the primary-side current I supplied from the alternating-current power supply 1 at the time of non-control ii, and indicates a case where the current exceeds the limit value.

In a case where the stepwise supply control i according to the present invention is carried out, in a period in which the primary-side current I supplied from the alternating-current power supply 1 at the time of the non-control ii exceeds the limit value, that is, in a period in which the use current I is expected to exceed the limit value in the present invention, the fixing power is lowered in a stepwise manner at the control start timing (times T1, T2) based on the delay period DL1. Thereafter, while maintaining the state in which the certain power is supplied, the control is withheld (on standby). The fixing power is raised in the stepwise manner at the control start timing (times T3, T4) based on the delay period DL2 from a time when the direct-current load current shifts to the decrease. The state in which the fixing power is supplied can be maintained within the limit of the use current I.

Furthermore, in this example, the fixing power increase prohibiting period Ta shown in FIG. 17(B) is set in consideration of a case where the secondary-side current Id1 or Id2 fluctuates rapidly. The fixing power increase prohibiting period Ta is set, for example, between the time T1 which is a control start timing based on the delay period DL1 relating to the threshold value TH1, and a middle time of the times T3 and T4 which are control start timings based on the delay period DL2 relating to the threshold values TH1 and TH2.

Figures 18A, 18B, 18C:
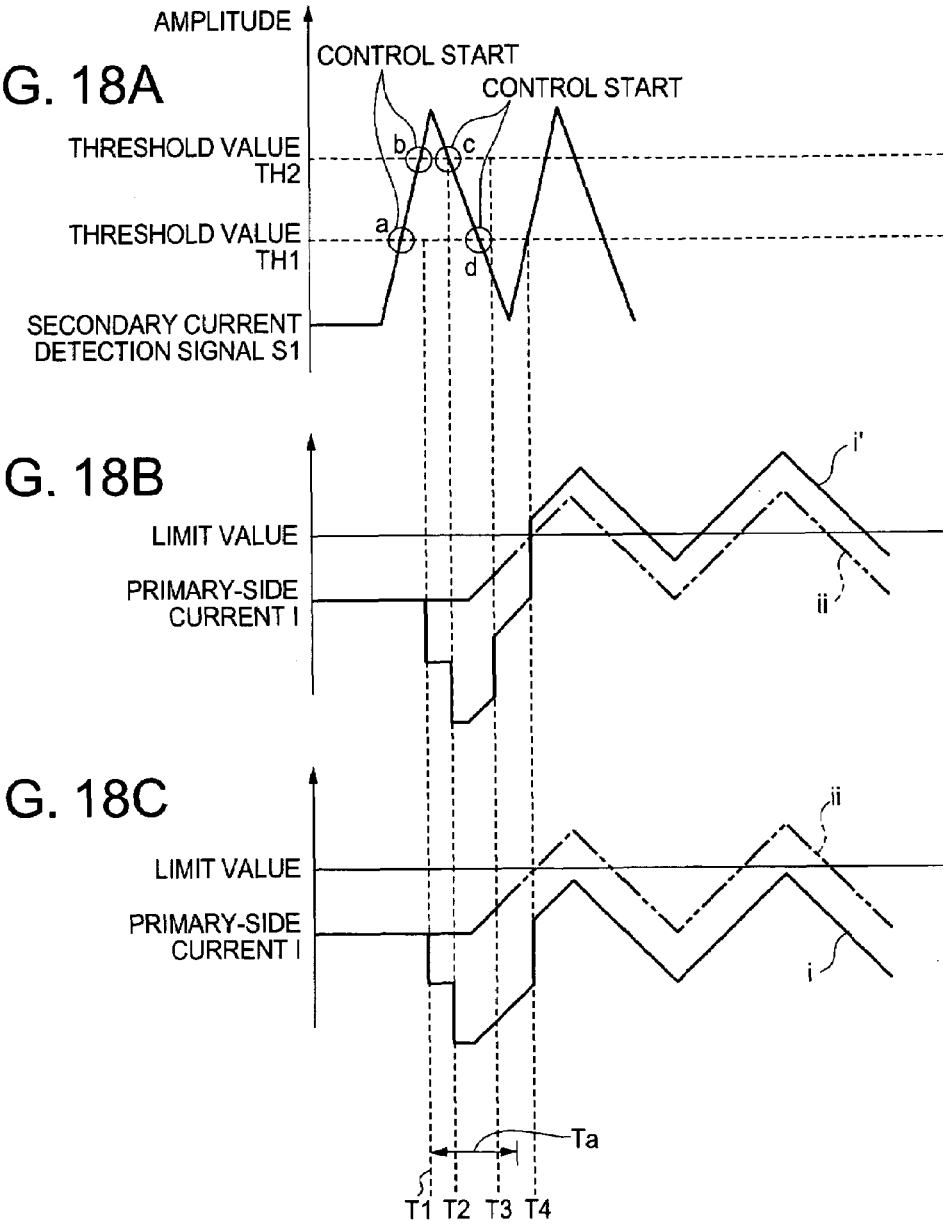
FIGS. 18A to 18C are waveform diagrams showing comparative examples relating to presence of setting of a fixing power increase prohibiting period Ta.

FIGS. 18A to 18C are waveform diagrams showing comparative examples relating to presence of setting of the fixing power increase prohibiting period Ta.

FIG. 18A is a diagram showing a waveform example of the secondary-side current detection signal S1 involving fluctuations. The secondary-side current detection signal S1 shown in FIG. 18A has, for example, two serrated waveforms. Threshold values TH1 and TH2 are set to the serrated waveform. This is an example in which four control start points a to d exist.

FIG. 18B shows a waveform example in a case where a fixing power increase prohibiting period Ta is not set. In FIG. 18B, a solid line i' shows a waveform of a primary-side current I at a stepwise supply control time, and indicates a case where the fixing power increase prohibiting period Ta is not set, and accordingly the value exceeds the limit value. A two-dot chain line ii shows a waveform of the primary-side current I in case of non-control.

FIG. 18C shows a waveform example in a case where the fixing power increase prohibiting period Ta is set. In FIG. 18C, a solid line i shows a waveform of the primary-side current I in which the fixing power increase prohibiting period Ta is set, and a situation in which the limit value is exceeded is avoided. A two-dot chain line ii shows a waveform of the primary-side current I in case of non-control, and has the same waveform as that of FIG. 18B In this example, the fixing power increase prohibiting period Ta is set between a control start timing T1 and a middle time of control start timings T3 and T4.

Figure 19A:
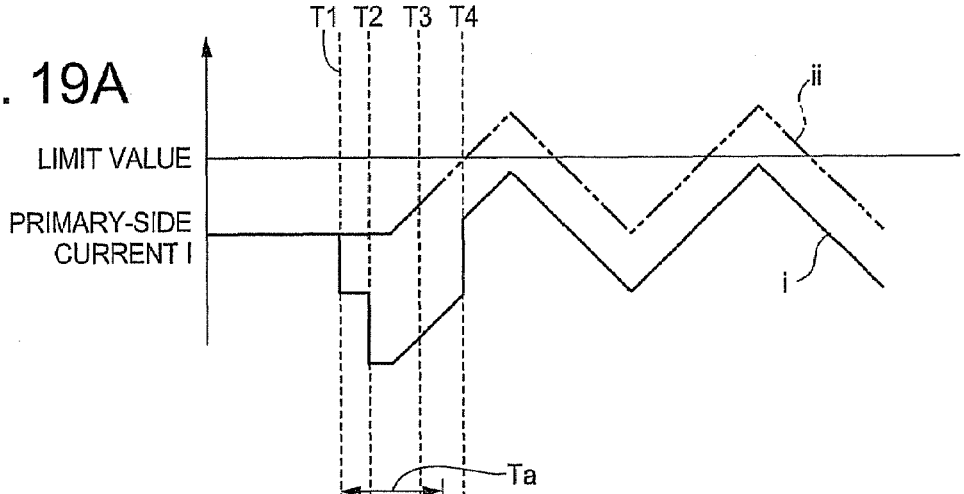
FIGS. 19A and 19B are graphs showing operation examples at a time when the fixing power increase prohibiting period Ta is set.
Figure 19B:
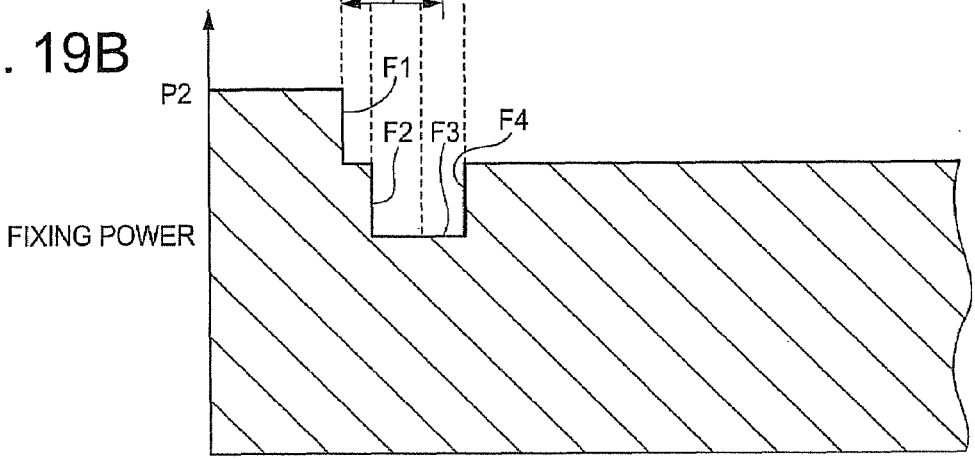

FIGS. 19A and 19B are diagrams showing operation examples at a time when the fixing power increase prohibiting period Ta is set. FIG. 19A shows a waveform example of the primary-side current I, and the waveform example of the use current I is extracted from FIG. 18B. In FIG. 19A, the ordinate indicates an amplitude, and the abscissa indicates time t.

FIG. 19B shows a supply control example of a fixing power. In FIG. 19B, the ordinate indicates the fixing power. and the abscissa indicates time t. P2 indicates a fixing power according to the present-invention system. In this example, in the fixing power increase prohibiting period Ta, fixing power increase control is prohibited even in a case where time reaches a control start timing T3 of F3, after decreasing the fixing power P2 at F1 and F2 in the figure. Even when the direct-current load current of the DC motor 35, 36 or the like shifts to the decrease, it is predicted that the secondary-side current Id1 or Id2 rapidly shifts to the increase for a certain cause. When fixing power increase control is executed in this fluctuation state in the fixing power increase prohibiting period Ta, it is predicted that the current exceeds the use current I on the primary side.

In this example, the fixing power increase control is executed at a control start timing T4 of F4 past the control start timing T3 of F3. When the fixing power increase prohibiting period Ta elapses, and the power control is executed at the control start timing T4 of F4, it is possible to avoid a situation in which the current exceeds the limit value (15 A in Japan) of the primary-side current I even in a case where the secondary-side current Id1 or Id2 rapidly fluctuates. The power can be supplied as much as possible to the fixing unit 78 within the limit of the current I supplied from the alternating-current power supply 1.

Next, an operation example of the copying machine 501 will be described. The copying machine 501 according to the present invention relates to a case where the primary-side current I supplied from the alternating-current power supply 1 is restricted. As shown in FIG. 16, the primary side of the direct-current power supply 3 is connected to the alternating-current power supply 1, and the secondary side is connected to the DC motors 35, 36 to supply a direct-current power. The CPU 85 controls the power supply of the fixing unit 78 connected to the alternating-current power supply 1.

For example, at the time of the fluctuation of the direct-current load of the DC motor 35, 36 or the like, the CPU 85 estimates the fluctuation of the primary-side current I supplied from the alternating-current power supply 1 from the current detection data D1, D2, and controls the power supply of the fixing unit 78. In the power control unit 810, the A/D converter 84A analog/digital converts a filtered secondary-side current detection signal S1' obtained from the current detector 4A, and outputs current detection data D1 relating to the secondary-side current Id1 of the direct-current power supply 3. The A/D-converted current detection data D1 is output to the CPU 85.

The A/D converter 84B analog/digital converts a filtered secondary-side current detection signal S2' obtained from the current detector 4B, and outputs current detection data D2 relating to the secondary-side current Id2 of the direct-current power supply 3. The A/D-converted current detection data D2 is output to the CPU 85.

On these assumptions, a power supply system 100 supplies powers to the DC motors 35, 36, image forming unit 70, and fixing unit 78. The image forming unit 70 forms an image on a predetermined sheet P. At this time, in the image forming unit 70, original image data Dout is read from an image memory (not shown) based on image forming conditions set by the operating unit 14.

For example, the original image data Dout is extended and decoded by the image processing unit 21. The decoded original image data Dout is transmitted to the image forming unit 70. In the image forming unit 70, the original image data Dout is input into the image writing unit 60 shown in FIG. 1. In the image writing unit 60, an electrostatic latent image is formed on a photosensitive drum 71 based on the original image data Dout. The electrostatic latent image formed on the photosensitive drum 71 is developed by toner.

In the sheet feeding unit 23, the sheet P based on the setting of the image forming conditions is fed out of a sheet supply cassette 30A or the like based on a sheet feed control signal Sf, and the sheet P is conveyed toward the image forming unit 70. The sheet feed control signal Sf is output to the sheet feeding unit 23 from general control unit 15. In the image forming unit 70, the toner image formed on the photosensitive drum 71 is transferred to the sheet P, and thereafter the sheet P onto which the toner image has been transferred is transported to the fixing unit 78.

The fixing unit 78 thermally fixes the image formed on the sheet P by the image forming unit 70. At this time, in the fixing unit 78, the fixing heater driving circuit 79 executes PWM control with respect to a driving current of the fixing heater 97. According to this PWM control, the switch element energizes/controls rising of a rectified waveform subjected to the full-wave rectification of an alternating-current voltage AC 100 V.

For example, when a bipolar transistor is used in the switch element of the fixing heater driving circuit 79, the base current is controlled by the power instruction value PC, and the driving current flowing into the fixing heater 97 is controlled. In this case, according to the stepwise supply control (system) i of the present invention, as shown in FIG. 19B, when the fixing power P2 is supplied, and the direct-current load power shifts to the increase tendency, the power control unit 810 outputs the power instruction value PC to the fixing heater driving circuit 79 at a control start timing (time) T1 based on the delay period DL1 in a period in which the primary-side current I is expected to exceed the limit value. The control unit controls the switch element, lowers the supply of the fixing power at F1 of FIG. 19B, and thereafter outputs the power instruction value PC to the fixing heater driving circuit 79 at the control start timing (time) T2 based on the delay period DL1. The control unit controls the switch element, and lowers the supply of the fixing power by another stage at F2 of FIG. 19B.

Thereafter, while maintaining the state in which the certain power is supplied, the control is withheld (on standby). In this example, even when reaching the control start timing (time) T3 based on the delay period DL2 at F3 of FIG. 19B from a time when the direct-current load current shifts to the decrease, the power instruction value PC is not output to the fixing heater driving circuit 79. The fixing power increase control is prohibited. Thereafter, the power instruction value PC is output to the fixing heater driving circuit 79 at the control start timing (time) T4 based on the delay period DL2, the switch element is controlled, and the supply of the fixing power is first controlled to rise by one step at F4 of FIG. 19B. Under this control, the fixing heater 97 generates heat based on the driving current controlled by the fixing heater driving circuit 79, and the fixing temperature is held, for example, at about 180° C. The sheet P after fixed is discharged.

Thus, the copying machine 501 according to the thirteenth embodiment relates to a case where the primary-side current I supplied from the alternating-current power supply 1 is restricted. The current detector 4A detects the secondary-side current Id1 of the direct-current power supply 3 to output the secondary-side current detection signal S1 to the A/D converter 84A. The current detector 4B detects the secondary-side current Id2 of the direct-current power supply 3 to output the secondary-side current detection signal S2 to the A/D converter 84B.

The A/D converter 84A analog/digital converts the filtered secondary-side current detection signal S1' obtained by the current detector 4A to output the current detection data D1 to the CPU 85. The A/D converter 84B analog/digital converts the filtered secondary-side current detection signal S2' obtained by the current detector 4B to output the current detection data D2 to the CPU 85. The CPU 85 continuously permits decrease at a time when the fixing power is decreased based on the secondary-side current detection signals S1, S2 of the direct-current power supply 3, output from the current detectors 4A, 4B. The CPU restricts the increase control of the fixing power until a predetermined time elapses after the fixing power is decreased.

Therefore, the increase control of the fixing power is prohibited until the fixing power increase prohibiting period Ta elapses after once decreasing the fixing power accompanying the increase of the secondary-side current Id1, Id2 or the like of the direct-current power supply 3. Consequently, even in a case where the secondary-side current Id rapidly fluctuates, a situation can be avoided in which the current exceeds the limit value (15 A in Japan) of the primary-side current I. The power can be supplied as much as possible to the fixing unit 78 within the limit of the current I supplied from the alternating-current power supply 1.

Fourteenth Embodiment

Figure 20:
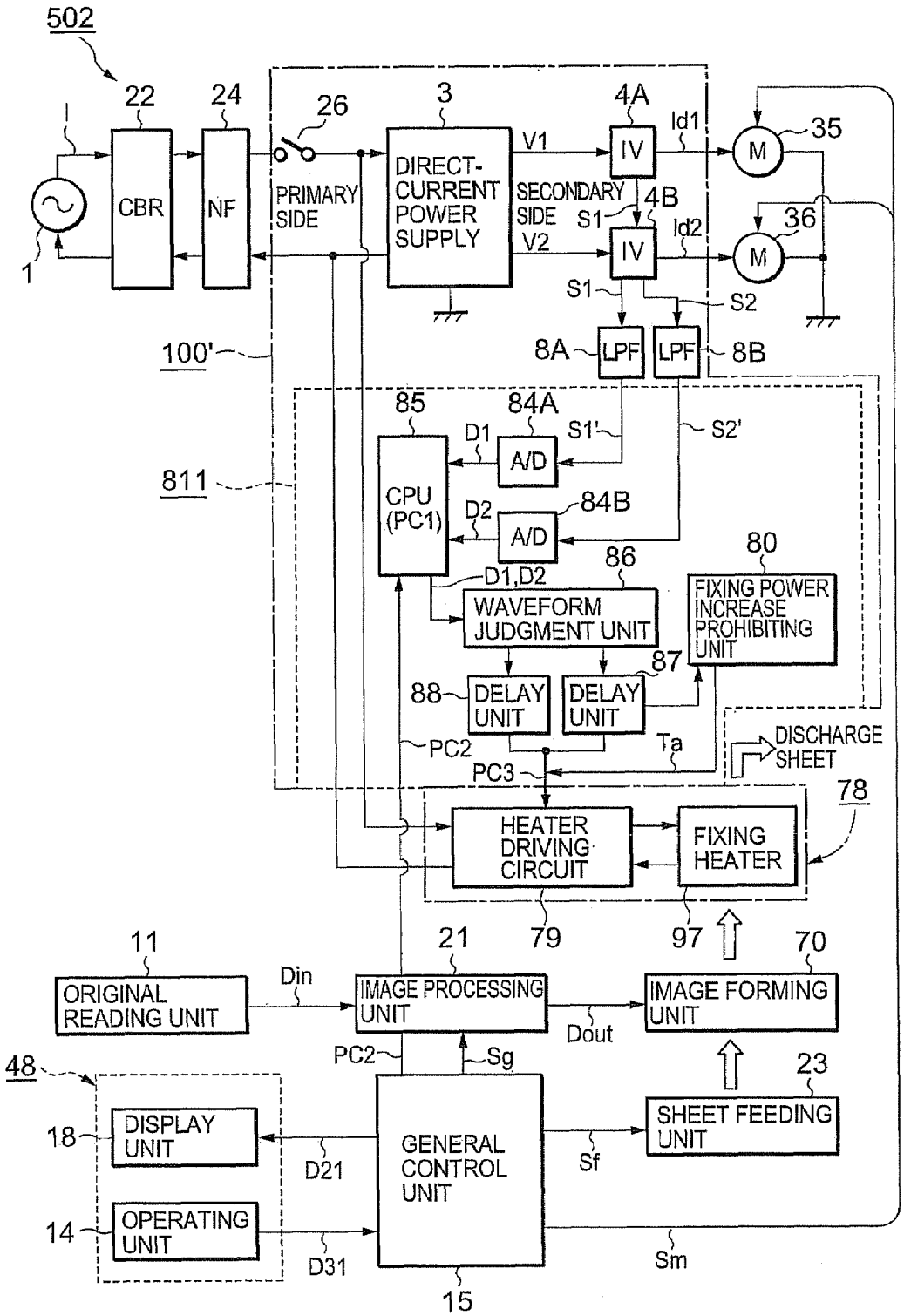
FIG. 20 is a block diagram showing a constitution example of a control system according to a fourteenth embodiment of the present invention for a digital copying machine 502.

FIG. 20 is a block diagram showing a constitution example of a control system according to a fourteenth embodiment of the present invention for a copying machine 502.

In the fourteenth embodiment, a CPU 85 calculates and obtains a power instruction value PC1 in real time. The copying machine 502 shown in FIG. 20 comprises a power supply system 100'. While a primary-side current I supplied from an alternating-current power supply 1 is restricted, powers are supplied to DC motors 35, 36 and fixing unit 78, and an image is formed based on original image data Dout. It is to be noted that components having the same names and reference numerals as those of the thirteenth embodiment have the same functions, and therefore the description is omitted.

In this example, power control unit 811 comprises A/D converters 84A and 84B, the CPU 85, a waveform judgment unit 86, delay units 87 and 88, and a fixing power increase prohibiting unit 80. Even in the copying machine 502, current detector 4A detects a secondary-side current Id1 of a direct-current power supply 3 to output a secondary-side current detection signal S1 to the A/D converter 84A. Current detector 4B detects a secondary-side current Id2 of the direct-current power supply 3 to output a secondary-side current detection signal S2 to the A/D converter 84B.

The A/D converter 84A analog/digital converts a filtered secondary-side current detection signal S1' obtained from the current detector 4A, and outputs, to the CPU 85, current detection data D1 relating to the secondary-side current Id1 of the direct-current power supply 3. The A/D converter 84B analog/digital converts a filtered secondary-side current detection signal S2' obtained from the current detector 4B, and outputs, to the CPU 85, current detection data D2 relating to the secondary-side current Id2 of the direct-current power supply 3.

In this example, the CPU 85 is constitute in such a manner as to determine a first power instruction value PC1 based on the current detection data D1 at the time of fluctuation of a direct-current load of the above-described DC motor 35, 36 or the like. For example, a power instruction value conversion table (not shown) is referred to. Assuming that the current detection data D1 is X, calculation coefficients are a, b, and the power instruction value PC1 is Y, the CPU 85 calculates a calculation equation Y=aX+b to obtain an optimum power instruction value PC1. As a result of this calculation, the first power instruction value PC1 is determined. Accordingly, the CPU 85 can determine the power instruction value PC1 based on the current detection data D1. The CPU 85 compares the first power instruction value PC1 determined based on the current detection data D1 with the second power instruction value PC2 set beforehand by general control unit 15.

As a result of the above-described comparison, for example, the CPU 85 selects a smaller value from the first and second power instruction values PC1, PC2, and controls the power supply of the fixing unit 78 based on either the first or second power instruction value PC1, PC2 selected here. In this example, when the power instruction value PC1 is smaller than the power instruction value PC2, the power instruction value PC1 is selected.

Moreover, when the power instruction value PC2 is smaller than the power instruction value PC1, the power instruction value PC2 is selected. In this case, the power supply to the fixing unit 78 can be controlled by the third power instruction value PC3=PC1 or PC3=PC2 based on either the first or second power instruction value PC1, PC2 newly determined by the CPU 85 (comparison determining method of the power instruction value).

Next, an operation example of the copying machine 502 will be described. A part different from that of the thirteenth embodiment will be described. The fourteenth embodiment is similar to the operation example of the copying machine 501 of the thirteenth embodiment except that the CPU 85 of the power control unit 811 calculates and obtains the power instruction value PC1 in real time, and compares the value with a preset power instruction value PC2, and therefore the description is omitted.

For example, when a bipolar transistor is used in the switch element of a fixing heater driving circuit 79, the base current is controlled by a power instruction value PC3, and a driving current flowing into a fixing heater 97 is controlled. In this case, according to a stepwise supply control (system) i of the present invention, as shown in FIG. 19B, when a fixing power P2 is supplied, and a direct-current load power shifts to an increase tendency, the power control unit 811 outputs the power instruction value PC3 to the fixing heater driving circuit 79 at a control start timing (time) T1 based on a delay period DL1 in a period in which the primary-side current I is expected to exceed the limit value. The control unit controls the switch element, lowers the supply of the fixing power at F1 of FIG. 19B, and thereafter outputs the power instruction value PC3 to the fixing heater driving circuit 79 at the control start timing (time) T2 based on the delay period DL1. The control unit controls the switch element, and lowers the supply of the fixing power by another step at F2 of FIG. 19B.

Thereafter, while maintaining the state in which the certain power is supplied, the control is withheld (on standby). In this example, even when reaching the control start timing (time) T3 based on the delay period DL2 at F3 of FIG. 19B from a time when the direct-current load current shifts to the decrease, the power instruction value PC3 is not output to the fixing heater driving circuit 79. The fixing power increase control is prohibited. Thereafter, the power instruction value PC3 is output to the fixing heater driving circuit 79 at the control start timing (time) T4 based on the delay period DL2, the switch element is controlled, and the supply of the fixing power is first controlled to rise by one step at F4 of FIG. 19B. Under this control, the fixing heater 97 generates heat based on the driving current controlled by the fixing heater driving circuit 79, and the fixing temperature is held, for example, at about 180° C.

Thus, according to the copying machine 502 of the fourteenth embodiment, the power supply system 100' having the power control unit 811 is disposed in the power supply system 100 described in the thirteenth embodiment. Even when reaching the control start timing (time) T3 based on the delay period DL2 at F3 of FIG. 19B from a time when the direct-current load current shifts to the decrease, fixing power increase control is prohibited without outputting the power instruction value PC3 to the fixing heater driving circuit 79. Thereafter, the power instruction value PC3 is output to the fixing heater driving circuit 79 at the control start timing (time) T4 based on the delay period DL2.

Therefore, to decrease the fixing power, the CPU continuously permits decrease. After once decreasing the fixing power by either the power instruction value PC1 determined based on the secondary-side current detection signals S1, S2 of the direct-current power supply 3 or the power instruction value PC2 determined by the general control unit 15, the increase control of the fixing power can be prohibited until the fixing power increase prohibiting period Ta elapses. Even when the secondary-side current Id1, Id2 or the like rapidly fluctuates, the fixing power increase control can be prohibited to thereby avoid a situation in which the current exceeds the limit value (15 A in Japan) of the primary-side current I. The power can be supplied as much as possible to the fixing unit 78 within the limit of the current I supplied from the alternating-current power supply 1.

Fifteenth Embodiment

Figure 21:
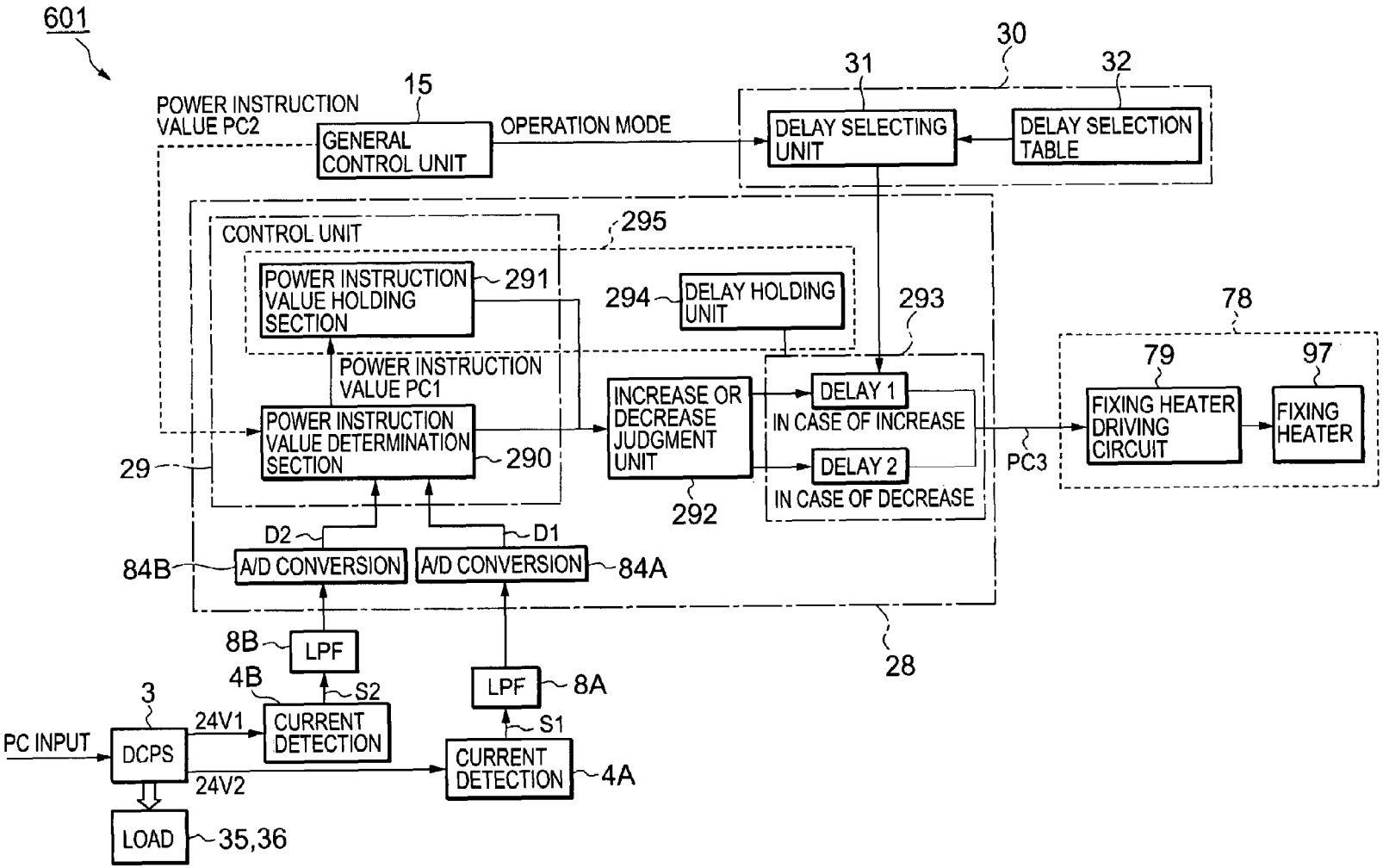
FIG. 21 is a block diagram showing a constitution example of a power control system according to a fifteenth embodiment of the present invention for a digital copying machine 601.

FIG. 21 is a block diagram showing a constitution example of a power control system according to a fifteenth embodiment of the present invention for a copying machine 601.

In the fifteenth embodiment, threshold values TH1, TH2 are set beforehand which determine control start times with respect to a secondary-side current detection signal S1. With regard to a rising waveform of the secondary-side current detection signal S1, a predetermined first delay DL1 is set from a time when the waveform crosses the threshold values TH1, TH2. With regard to a falling waveform of the secondary-side current detection signal S1, a predetermined second delay DL2 is set from a time when the waveform crosses the threshold value TH2. The delay DL1 is set to be not more than the delay DL2. This appropriately controls power use in the whole copying machine in consideration of a timing at which a secondary-side load fluctuation influences the primary side based on a characteristic of a DC power supply.

Specifically, the delays DL1, DL2 are adjusted referring to storage unit 295 for a waiting data row in accordance with fluctuation of a secondary-side current Id of a direct-current power supply 3, and a power can be efficiently supplied to fixing unit 78 so that an average power to be supplied for the fixing can be increased. As to one or both of the delays DL1, DL2, the delay DL1 is set to be comparatively long in a case where a secondary-side current increase is slow, and the delay DL2 is set to be comparatively short in a case where the current decrease is rapid. When adjusting/setting length of either or both of these delays DL1, DL2 in accordance with magnitude of a secondary-side current fluctuation, a power supply time to the fixing unit 78 is further lengthened, and power can be efficiently used.

For example, when the secondary-side current Id increases slowly, the primary-side current also fluctuates slowly. Therefore, the delay DL1 is lengthened in such a manner as to delay a time to decrease the fixing power. On the other hand, when the secondary-side current Id decreases rapidly, the primary-side current also fluctuates rapidly. Therefore, the delay DL2 is shortened in such a manner as to advance a time to increase the fixing power.

A power control system of the copying machine 601 shown in FIG. 21 comprises: a direct-current power supply (DCPS) 3; current detectors 4A, 4B; low pass filters 8A, 8B; power control unit 28; general control unit 15; and delay determining unit 30. A secondary side of the direct-current power supply (DCPS) 3 is connected to DC motors 35, 36 via the current detectors 4A, 4B. A primary side of the direct-current power supply (DCPS) 3 is connected to the fixing unit 78 having a fixing heater driving circuit 79 and a fixing heater 97. The fixing unit 78 is connected to the power control unit 28 as described above in the respective embodiments.

In the fifteenth embodiment, the power control unit 28 comprises: a control unit 29; A/D converters 84A and 84B; an increase or decrease judgment unit 292; a delay unit 293; and storage unit 295 for a waiting data row. The control unit 29 has a power instruction value determining section 290 and a power instruction value holding section 291. The power instruction value determining section 290 receives current detection data D1, D2 output from A/D converters 84A and 84B to determine a power instruction value with respect to the fixing unit 78. A CPU is used in the power instruction value determining section 290.

Moreover, a power instruction value PC1 can be set based on current detection data D1, D2 in the power instruction value determining section 290. This avoids a situation in which the current exceeds the limit value of the primary-side current, even in a case where the secondary-side current detection signal S1 reflecting the secondary-side current rapidly fluctuates.

The power instruction value holding section 291 holds a plurality of power instruction values even in a case where the power instruction value determining section 290 issues a command to change the power instruction value during the delay for outputting the power instruction value. In this example, a base time to determine the power change of the power instruction value can be set to a time when a secondary-side current value based on the secondary-side current detection signal S1 indicates a predetermined set current value. The set current values are disposed corresponding to increase and decrease times of the secondary-side current. Furthermore, even when the fluctuation tendency of the secondary-side current detection signal S1 is the same, a plurality of set values can be disposed. The power instruction value holding section 291 may comprise storage unit capable of writing and reading data of RAM, HDD or the like as needed.

Moreover, in the general control unit 15, a power which can be supplied to the fixing unit 78 is set in accordance with a load constitution of the copying machine 601, and the power instruction value PC2 concerning the power can be output to the power instruction value determining section 290. When the power instruction value PC2 is input from the general control unit 15, the power instruction value determining section 290 compares the power instruction value PC2 with the power instruction value PC1 preset in accordance with the current detection data D1, D2 from the A/D converters 84A, 84B to determine a smaller value as the power instruction value PC3. It is to be noted that in the present invention, without comparing the power instruction value PC2 with PC1, the current detection data D1, D2 are received from the A/D converters 84A, 84B, and a preset power amount may be set as a power instruction value PC3=PC1.

The power instruction value determining section 290 is capable of outputting the power instruction value PC1 and the current detection data D1, D2 to the increase or decrease judgment unit 292. The increase or decrease judgment unit 292 judges whether the secondary-side current of the direct-current power supply 3 is increasing or decreasing based on the current detection data D1, D2. A judgment result is output to the delay unit 293. When the secondary-side current is increasing, the delay DL1 is selected as a delay. When the current is decreasing, the delay DL2 is selected as the delay.

The delay determining unit 30 for handling the delays DL1, DL2 is connected to the general control unit 15. The delay determining unit 30 comprises a delay selecting unit 31 and a delay selection table 32. In the delay selection table 32, the delay associated with an operation mode is stored as data. In this example, values of the delays DL1, DL2 are determined in accordance with the operation mode of the digital copying machine 601. When the delays DL1, DL2 corresponding to load currents are determined in order to indicate the inherent load currents in each operation mode, the fixing power can be more appropriately controlled.

The delay selection table 32 may comprise storage unit such as a ROM and a flash memory. The delay selecting unit 31 is capable of selecting and reading the data associated with the operation mode from the delay selection table 32. In the delay determining unit 30, operation mode information is input from the general control unit 15 so that the operation mode can be recognized. It is possible to output, to the delay unit 293 described later, data concerning the delays DL1, DL2 read by the delay determining unit 30. Table 1 shows data rows in the delay selection table 32.

TABLE 1

| Operation mode | | | Delay 1 (initial | Delay 2 (initial |
|---|---|---|---|---|
| Original | Output | Staple | setting) | setting) |
| One-faced | One-faced | None | 10 ms | 19 ms |
| One-faced | Double-faced | None | 12 ms | 20 ms |
| Double-faced | One-faced | None | 10 ms | 19 ms |
| Double-faced | Double-faced | None | 12 ms | 20 ms |
| One-faced | One-faced | Present | 10 ms | 18 ms |
| One-faced | Double-faced | Present | 11 ms | 20 ms |

TABLE 1-continued

| Operation mode | | | Delay 1 (initial | Delay 2 (initial |
|---|---|---|---|---|
| Original | Output | Staple | setting) | setting) |
| Double-faced | One-faced | Present | 10 ms | 18 ms |
| Double-faced | Double-faced | Present | 11 ms | 20 ms |

According to the data rows shown in Table 1, operation modes are sorted out by a combination of three elements such as one-faced, double-faced, presence of stable. It is to be noted that other examples of the operation mode elements include punch, sort, ADF, tray stage and the like. In Table 1, the values of the delays DL1, DL2 are set corresponding to the respective operation modes.

Figure 22:
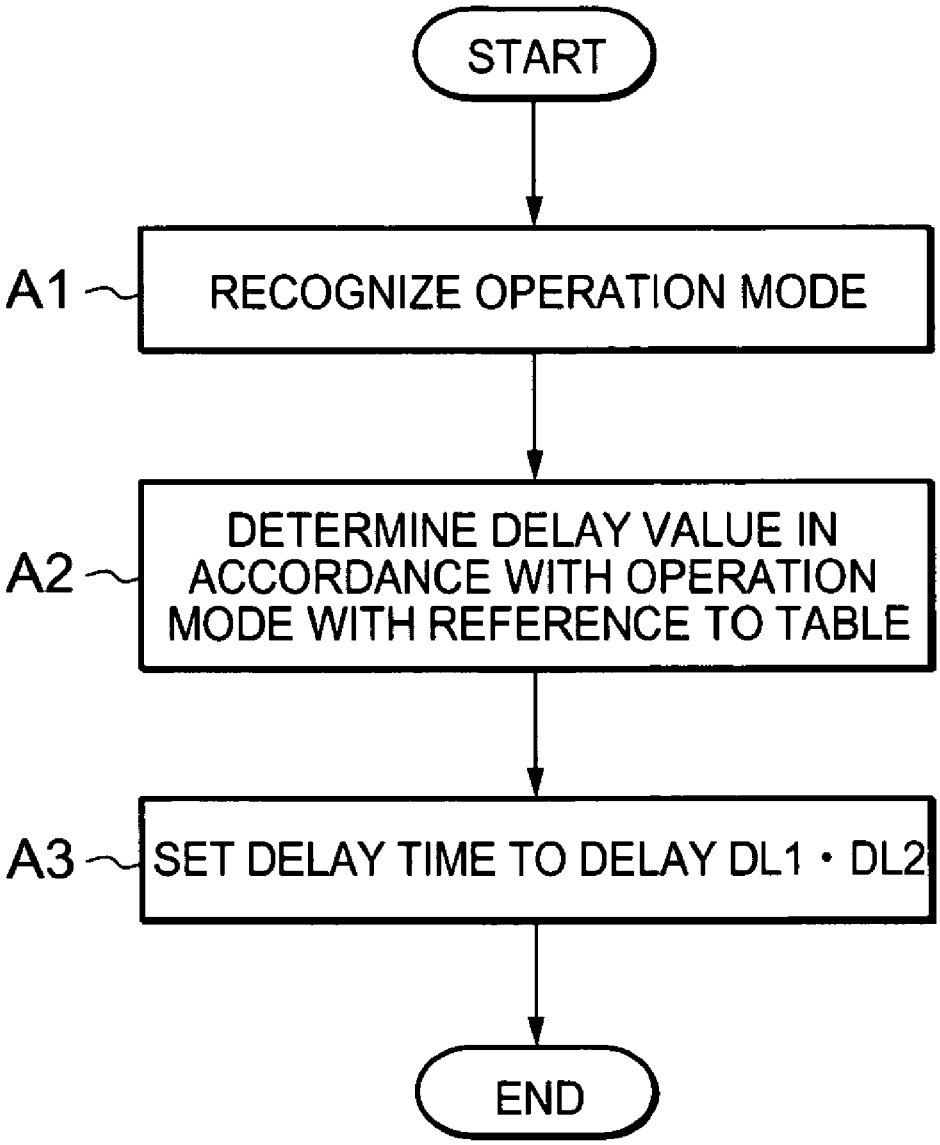
FIG. 22 is a flowchart showing a delay selection example in a delay determining unit 30.

FIG. 22 is a flowchart showing a delay selection example in the delay determining unit 30. In step A1 of the flowchart shown in FIG. 22, the delay determining unit 30 first recognizes the operation mode by the information from the general control unit 15. Next, in step A2, the delay determining unit 30 refers to the delay selection table 32 based on a result of the recognition of the delay selecting unit 31, and determines the delay value in accordance with the operation mode. Subsequently, in step A3, the determined delay is output to the delay unit 293 to set the delay time (period).

The delay unit 293 includes a delay holding unit 294 in order to hold a plurality of delay times in a case where the power instruction value determining section 290 issues a command to change the power instruction value PC1 or PC2 during the delay in outputting the power instruction value PC3.

It is to be noted that the power instruction value holding section 291 and the delay holding unit 294 constitute the storage unit 295 for the waiting data row, and mutual data are associated with each other.

In this example, in the storage unit 295 for the waiting data row, the power instruction values PC1, PC2, and the delays DL1, DL2 are stored as data. When determining the output change of the power instruction value PC1 or PC2, the data is successively stored in the storage unit 295 concerning the power instruction values PC1, PC2, and the delays DL1, DL2 subjected to the output change. After elapse of the delay DL1 or DL2 stored in the storage unit 295, the storage unit outputs the power instruction value PC3 associated with the delay DL1 or DL2 with respect to the fixing unit 78.

After the elapse of the delay based on the operation of the timer, the delay unit 293 outputs a predetermined power instruction value PC3 to the fixing heater driving circuit 79 (seventh image forming apparatus). In this case, to change the power instruction value PC1 or PC2 accompanying the fluctuation of the secondary-side current Id of the direct-current power supply 3, the smoothly changed power instruction value PC3 can be output to control the fixing power.

Next, an operation will be described to hold and output a plurality of power instruction values PC1, PC2 and the delay in a case where the power instruction value determining section 290 issues the command to change the power instruction value PC1 or PC2 during the delay in outputting the power instruction value.

Figures 23A, 23B, 23C, 23D:
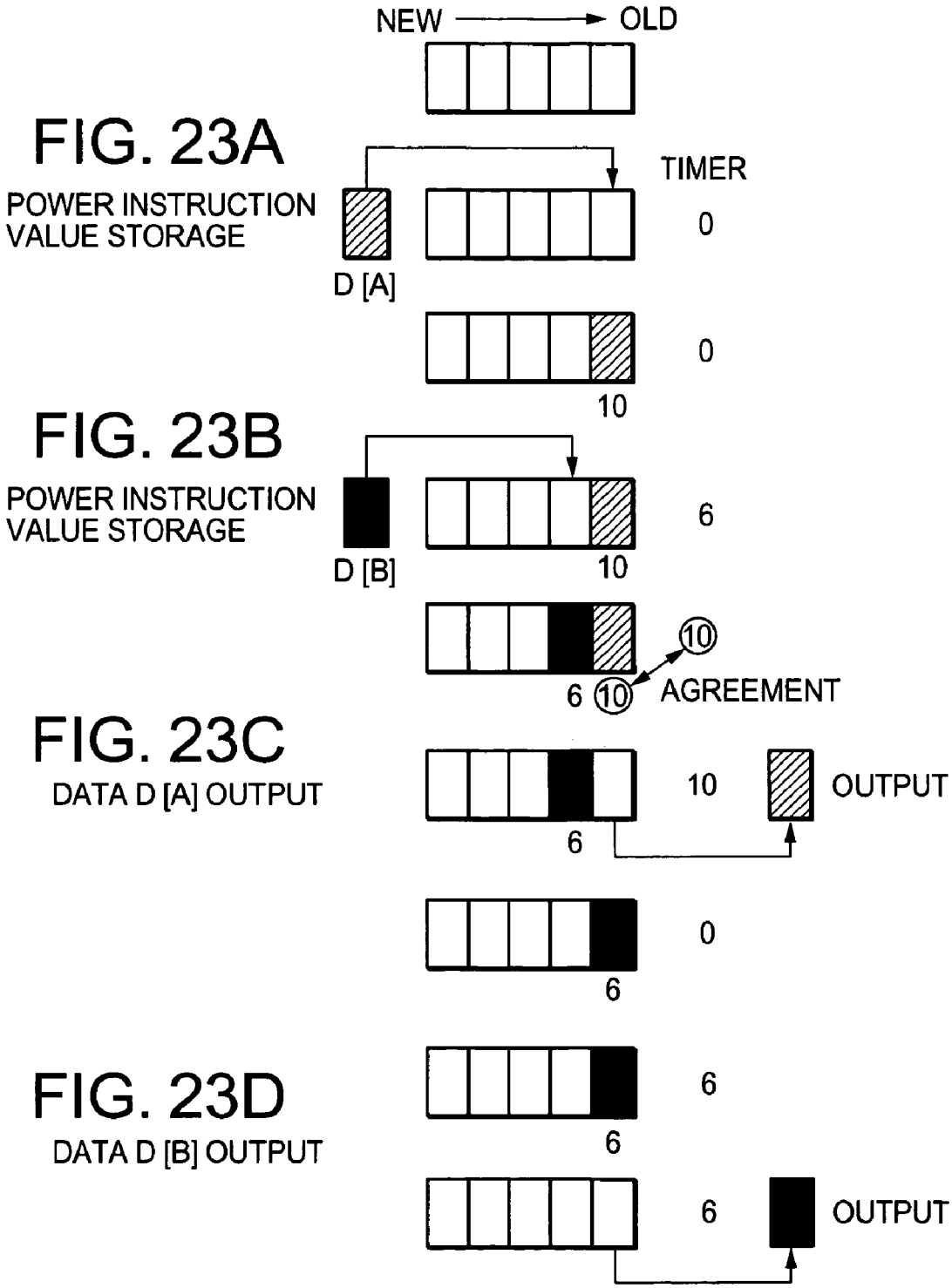
FIGS. 23A to 23D are schematic diagrams showing storage and output examples of power instruction values in storage unit 295.
Figure 24:
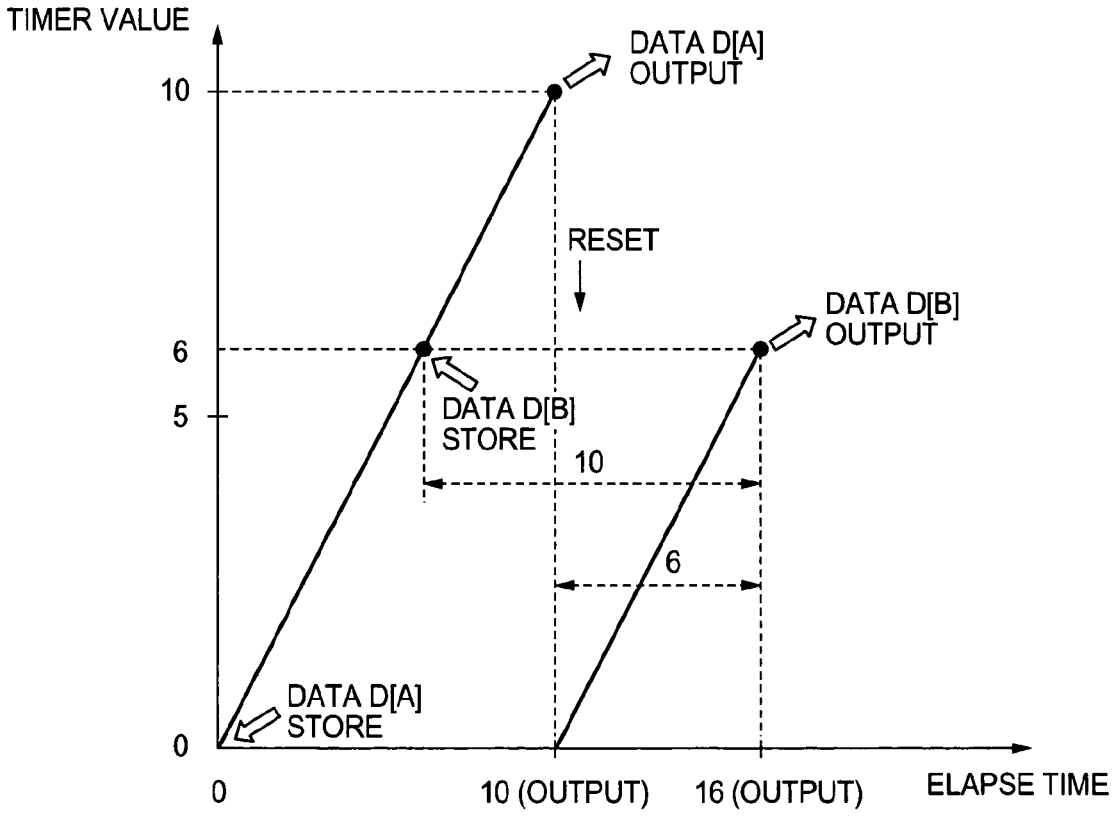
FIG. 24 is a timing chart showing a timer operation example.

FIG. 23A show schematic diagrams of storage examples and output examples of the power instruction values in the storage unit 295. FIG. 24 is a timing chart showing a timer operation example. In this example, the delay DL1 (=10 ms)

will be described. According to the storage example of the power instruction value shown in FIG. 23, a waiting data row is shown in which newer data is stored on the left side, and the data is successively stored on the left side.

First, when the power instruction value determining section 290 determines the first power instruction value PC2, as shown in FIG. 23A, data D[A] is stored in the rightmost row, and delay "10" is set. Thereafter, when determining the change of the new power instruction value PC after the elapse of a timer time 6 shown in FIG. 24, data D[B] is stored in a row behind the data D[A] shown in FIG. 23B.

Next, the data D[A] shown in FIG. 23C is converted into the delay after the output, and delay "6" is stored. Thereafter, when reaching timer time 10 shown in FIG. 24, the time agrees with a delay time of the data D[A] shown in FIG. 23C. Therefore, the power instruction value PC2 of the data D[A] is output, the timer is reset, and the rear data D[B] is shifted forwards to continue counting of the timer. Thereafter, after the elapse of the timer time 6 shown in FIG. 24, the power instruction value PC1 of the data D[B] is output as shown in FIG. 23D, and the timer is reset.

Next, a control example of the fixing power will be described by the output of a power instruction value PC1 involving the delay. FIGS. 25(A) to (G) are waveform diagrams showing control examples of the fixing power in the copying machine 601.

Figures 25A, 25B, 25C, 25D, 25E, 25F, 25G:
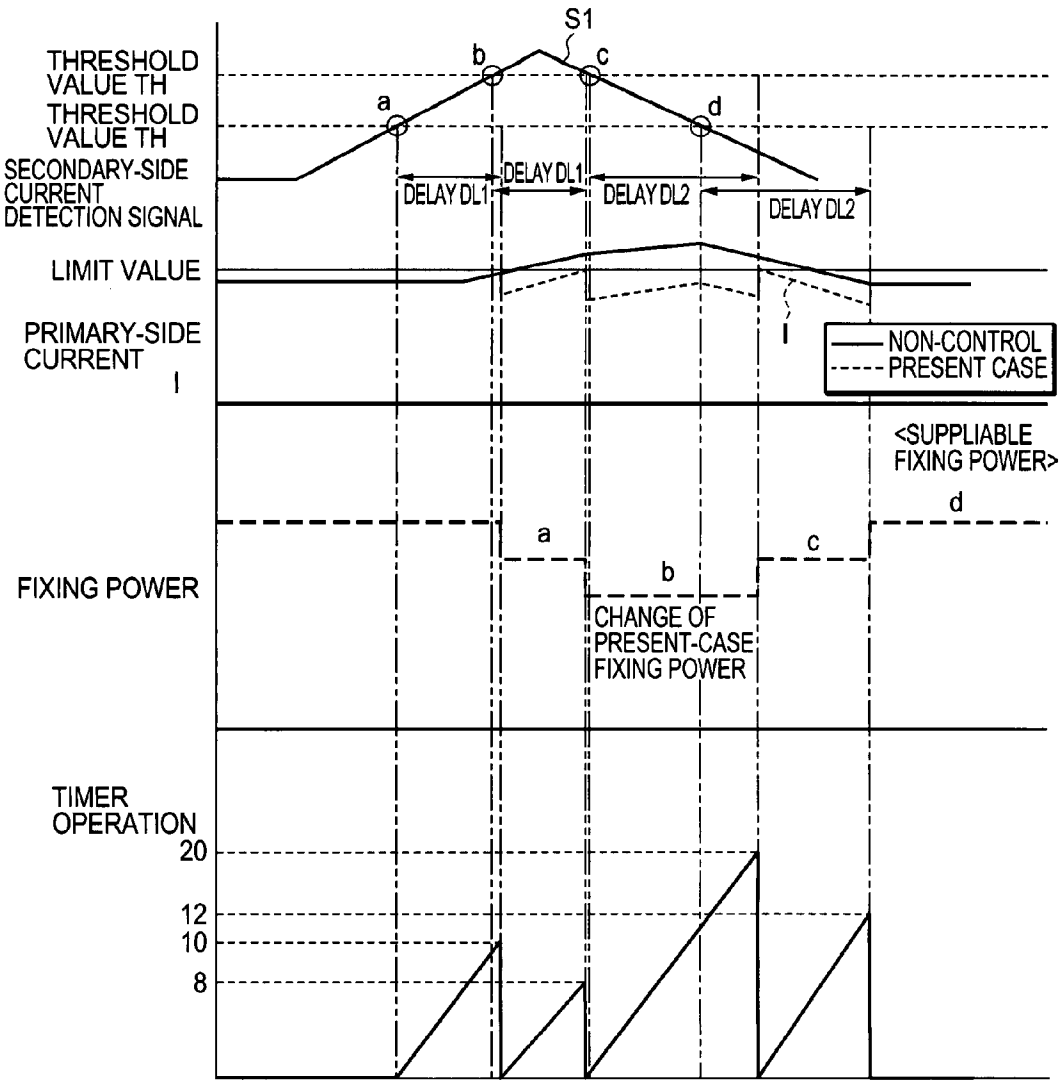
FIGS. 25(A) to (G) are waveform diagrams showing control examples of a fixing power in a digital copying machine 601.

In FIG. 25(C), a solid line indicates a change of the secondary-side current detection signal S1 reflecting a secondary-side current change. A solid line in FIG. 25(E) indicates a change of the primary-side current I. A broken line in FIG. 5(F) shows a change of the fixing power, and a solid line in FIG. 25(G) indicates a timer operation. In this example, it is assumed that the delay DL1 is "10", and the delay DL2 is "20". A thin line in FIG. 25(D) shows the limit value of the primary-side current I, for example, 15 A.

It is to be noted that the threshold values TH1, TH2 are set beforehand as shown in FIGS. 25(A) and (B) in order to control a fixing current with respect to the secondary-side current detection signal S1. When the secondary-side current detection signal S1 reaches the threshold values TH1, TH2, the fixing current is changed/adjusted. When the secondary-side current detection signal S1 increases to reach the threshold value TH1 (point a), a power instruction value a and delay DL1 are set based on the secondary-side current detection signal S1. When the secondary-side current detection signal S1 increases to reach the threshold value TH2 (point b), a power instruction value b and delay DL1 are set based on the secondary-side current detection signal S1. Thereafter, with the elapse of the delay concerning the point a, the fixing power is set to a, and the timer is reset. Thereafter, with the elapse of the delay concerning the point b, the fixing power is set to b, and the timer is reset.

Thereafter, when the secondary-side current detection signal S1 peaks out, starts decreasing, and reaches the threshold value TH2 (point c), a power instruction value c and delay DL2 are set based on the secondary-side current detection signal S1. When the secondary-side current detection signal S1 increases to reach the threshold value TH1 (point d), a power instruction value d and delay DL2 are set based on the secondary-side current detection signal S1. Thereafter, with the elapse of the delay concerning point c, the fixing power is set to c, and the timer is reset. Thereafter, with the elapse of the delay concerning point d, the fixing power is set to d, and the timer is reset.

Thus, according to the power control system of the copying machine 601 of the fifteenth embodiment, the fixing power is controlled based on the delays DL1, DL2 determined in accordance with the operation mode. In this example, the threshold values TH1, TH2 are set beforehand which determine the control start times with respect to the secondary-side current detection signal S1. As to the rising waveform of the secondary-side current detection signal S1, a predetermined first delay DL1 is set from a time when the waveform crosses the threshold values TH1, TH2. As to the falling waveform of the secondary-side current detection signal S1, a predetermined second delay DL2 is set from a time when the waveform crosses the threshold value TH2, and the delay DL1 is set to be not more than the delay DL2.

Therefore, with the elapse of the delay, the fixing power instruction values can be successively output to control the fixing power. The storage unit 295 is referred to for the fluctuation of the current on the secondary side of the direct-current power supply 3, the delays DL1, DL2 are adjusted, and the power is efficiently supplied to the fixing unit 78 so that the average power supplied to the fixing can be increased. As seen in the primary-side current I shown in FIG. 25(E), the primary-side current I exceeds the limit value in a case where the power control is not performed according to the present invention. When executing the control method according to the present invention, it is possible to efficiently use the power within the limit value.

Sixteenth Embodiment

Figure 26:
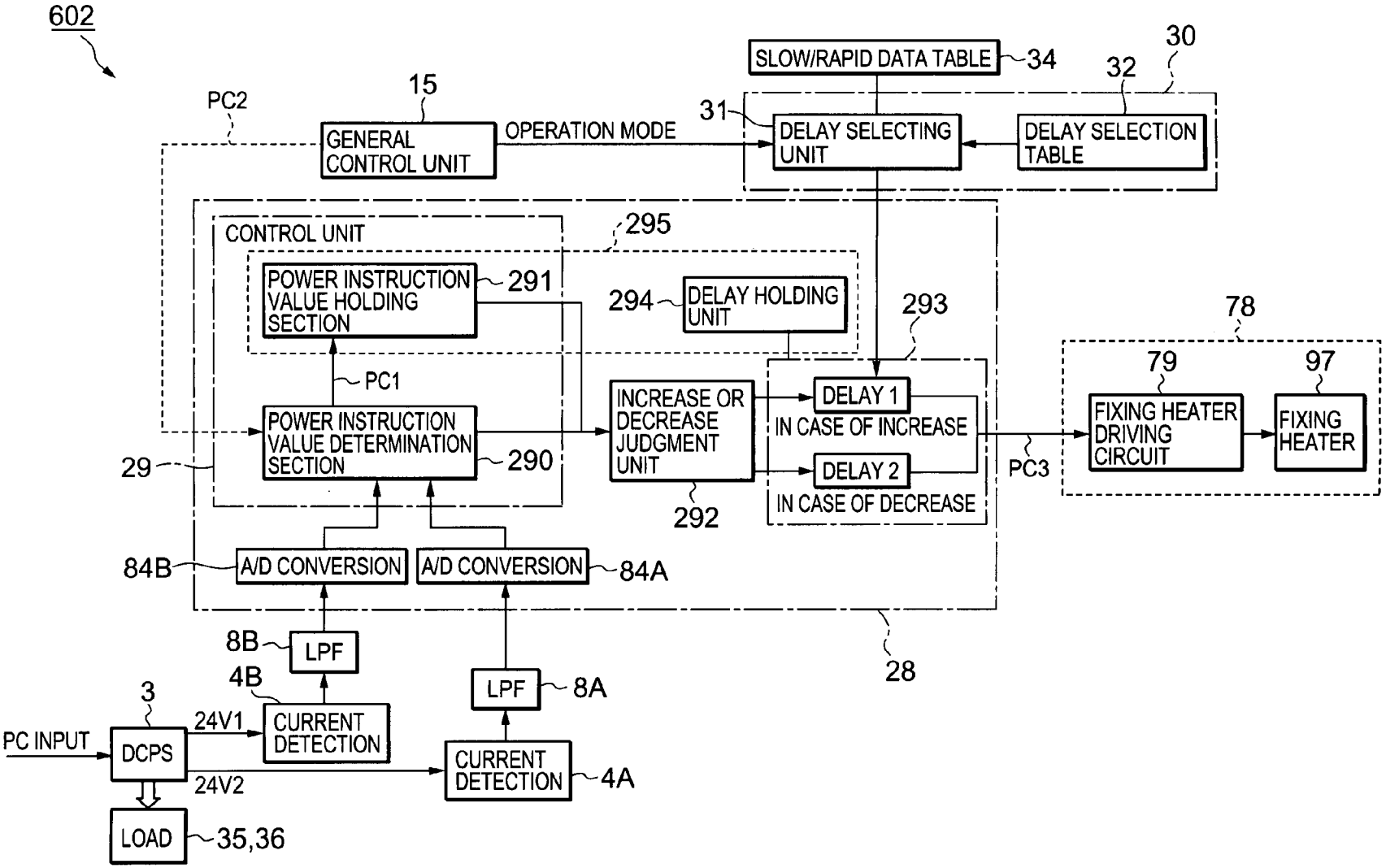
FIG. 26 is a block diagram showing a constitution example of a power control system according to a sixteenth embodiment of the present invention for a digital copying machine 602.

FIG. 26 is a block diagram showing a constitution example of a power control system according to a sixteenth embodiment of the present invention for a copying machine 602.

In this sixteenth embodiment, the delay selecting unit 31 is connected to a slow/rapid data table 34. It is to be noted that another constitution is similar to that of the fifteenth embodiment, and therefore the description is omitted. As to the slow/rapid data table 34, when magnitude of fluctuation of a load current is predicted in accordance with change of an operation mode, and a limit current largely decreases/fluctuates in accordance with the change of the operation mode, data is stored which shortens the delay DL2. When the increase/fluctuation of the load current is small, data is stored which extends the delay DL1. The length of the delay may be adjusted in a plurality of stages. In this case, an adjustment amount of the length may vary (eighth image forming apparatus).

The delay selecting unit 31 shown in FIG. 26 successively receives operation mode information from general control unit 15 to recognize the change of the operation mode. It is predicted that the increase/fluctuation is comparatively slow, or the decrease/fluctuation is comparatively rapid with respect to the secondary-side current detection signal S1 which reflects the secondary-side current in the change of this operation mode. In this case, shortening/extending data is acquired from the slow/rapid data table 34, and the lengths of the delays DL1, DL2 are adjusted corresponding to the original operation mode. The delays DL1, DL2 are output to the delay unit 293 in the same manner as in the fifteenth embodiment.

Next, a method will be described in which the lengths of the delays DL1, DL2 are adjusted to control the fixing power. FIGS. 27(A) to (F) are waveform diagrams showing control examples of the fixing power in the copying machine 602.

Figures 27A, 27B, 27C, 27D, 27E, 27F:
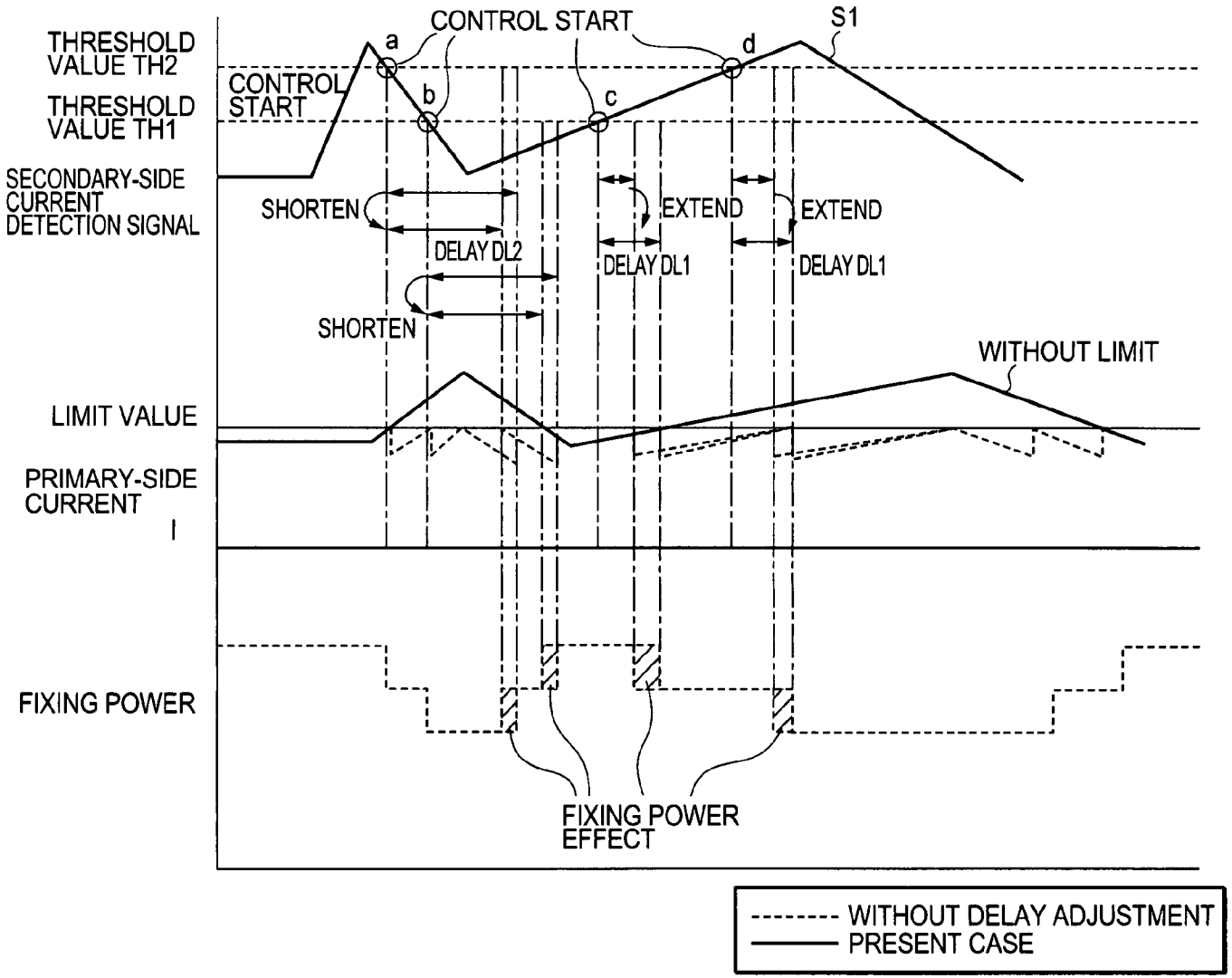
FIGS. 27(A) to (F) are waveform diagrams showing control examples of a fixing power in a digital copying machine 602.

In FIG. 27(C), a solid line shows a secondary-side current detection signal S1 which reflects a secondary-side current change, and a solid line in FIG. 27(E) shows a change of a primary-side current I. A solid line in FIG. 27(F) shows a change of the fixing power. In this example, threshold values TH1, TH2 are set beforehand as shown in FIGS. 27(A) and (B) in order to control a fixing current with respect to the secondary-side current detection signal S1. Even in this example, when the secondary-side current detection signal S1 reaches the threshold values TH1, TH2, the fixing current is changed/adjusted. A thin line in FIG. 27(D) shows a limit value of the primary-side current I, for example, 15 A.

In FIG. 27(C), when the secondary-side current detection signal S1 peaks out, decreases, and reaches the threshold value TH2 (point a) shown in FIG. 27(A), a power instruction value and delay DL2 are set based on the secondary-side current detection signal S1. In this case, when the secondary-side current detection signal S1 rapidly decreases, a shortened delay DL2 is set with respect to standard delay DL2.

Furthermore, when the secondary-side current detection signal S1 decreases, and reaches the threshold value TH1 (point b) shown in FIG. 27(B), the power instruction value and delay DL2 are set based on the secondary-side current detection signal S1. Also in this case, when the secondary-side current detection signal S1 rapidly decreases, the shortened delay DL2 is set with respect to the standard delay DL2. As a result, when the secondary-side current detection signal S1 rapidly decreases, as shown in FIG. 27(F), the increase of the fixing power is advanced, and a longer and larger fixing power can be supplied to fixing unit. In FIG. 27(F), a slanted-line portion shows an increase of the fixing power.

On the other hand, when the secondary-side current detection signal S1 increases, and reaches the threshold value TH1 (point c) shown in FIG. 27(B), the power instruction value and delay DL1 are set based on the secondary-side current detection signal S1. In this case, when the secondary-side current detection signal S1 slowly increases, an extended delay DL1 is set with respect to standard delay DL1.

Furthermore, when the secondary-side current detection signal S1 decreases, and reaches the threshold value TH2 (point d) shown in FIG. 27(A), the power instruction value and delay DL1 are set based on the secondary-side current detection signal S1. Also in this case, when the secondary-side current detection signal S1 slowly increases, the extended delay DL1 is set with respect to the standard delay DL1. As a result, when the secondary-side current detection signal S1 slowly increases, as shown in FIG. 27(F), the decrease of the fixing power is slowed, and a longer and larger fixing power can be supplied to fixing unit. Also in this case, a slanted-line portion in the figure shows an increase of the fixing power.

Moreover, also in this control, the primary-side current is controlled not to exceed the limit value shown in FIG. 27(D). It is to be noted that in this example the length of the delay is adjusted both at a rapid decrease time and a slow increase time of the secondary-side current detection signal S1. However, in the present invention, the delay may be adjusted at either time. Additionally, when the delay is adjusted at both the times, the power is more efficiently supplied.

Furthermore, it has been described above that the degree of the fluctuation of the current is predicted in accordance with the change of the power mode, and the length adjustment data of the delay is associated with the change of the power mode and held. In the present invention, a fluctuation amount of the secondary-side current detection signal S1 may be detected to adjust the length of the delay based on the detection result.

Moreover, when the fixing power instruction value is changed in accordance with the increase/decrease of the secondary-side current detection signal S1 as described above, the power instruction value is output based on the delay associated with each power instruction value. However, when the secondary-side current detection signal S1 increases/decreases frequently, a condition is sometimes generated that a newly set power instruction value is output before the previously set power instruction value depending on the value of the delay. In this case, even when the power instruction value is simply successively stored in the storage unit 295 for the waiting data row, it is difficult to appropriately output the value.

Next, an example will be described in which this disadvantage is avoided. FIGS. 28A to 28E are schematic diagrams showing a storage example and an output example (No. 1) of a power instruction value in the storage unit 295.

In this sixteenth embodiment, when data on the power instruction value and the delay DL1 or DL2 is stored in the storage unit 295, the output change of the power instruction value is newly determined. Furthermore, there is a condition that new power instruction value is output earlier than the power instruction value already stored in the storage unit 295 based on the delay DL1 or DL2 associated with the new power instruction value. In this case, all the data on the power instruction value and the delay DL1 or DL2 is cleared which has been already stored in the storage unit 295. Data on a new power instruction value and delay DL1 or DL2 is stored in a head of a waiting order in the waiting data row in the storage unit 295. That is, all the previously stored data is cleared, and the new power instruction value only is used in the control. This respect will be specifically described.

Figure 28A:
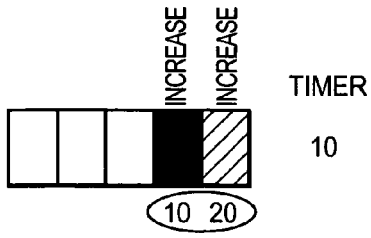
FIGS. 28A to 28E are schematic diagrams showing a storage example and an output example (No. 1) of a power instruction value in storage unit 295.
Figure 28B:
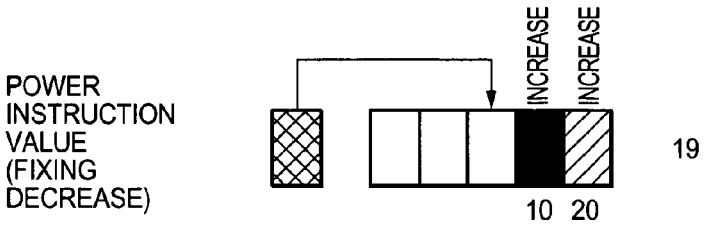
Figure 28C:
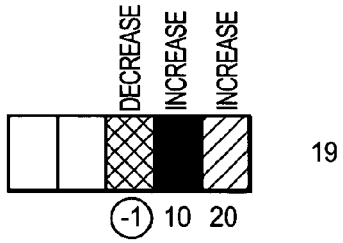

In FIG. 28A, two instruction values (delay DL1: timer time 20) are stored which increase the fixing power with the elapse of timer time 10, and timer times 20 and 10 are set as the delay to both the values. Thereafter, with the elapse of time, as shown in FIG. 28B, when reaching timer time 19, a new power instruction value (delay DL2: timer time 12) is set which decreases the power. Then, as shown in FIG. 28B, the delay value associated with the power instruction value is converted into the delay after outputting the power instruction value indicating the fixing increase, and stored.

Figure 28D:
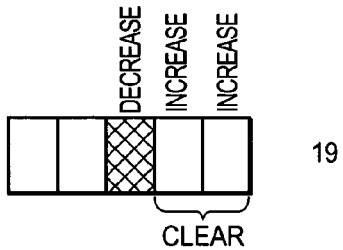

However, there is a condition that the new power instruction value is output before the power instruction value indicating the fixing increase in accordance with a relation between the respective delays so that the converted delay indicates a minus value. Therefore, the already stored power instruction value and the related delay are all cleared as shown in FIG. 28D, and the new power instruction value is stored together with the related delay in the top of the waiting data row as shown in FIG. 28E.

Figure 28E:
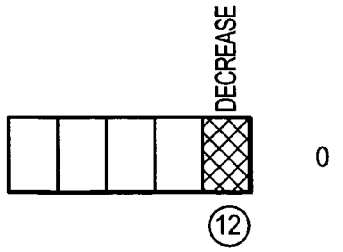

It is to be noted that in FIG. 28E, after storing new data indicating the fixing decrease in the tail of the row, the data on the power instruction value indicating the fixing increase and the delays DL1, DL2 is cleared, and the data is shifted. However, after clearing the data, new data may be stored. An output order of the power instruction value is appropriately adjusted by the above-described procedure.

Figure 29A:
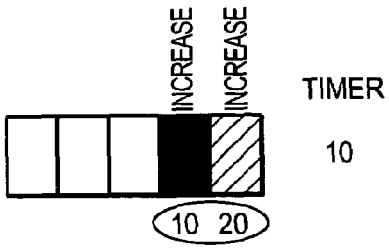
FIGS. 29A to 29E are schematic diagrams showing a storage example and an output example (No. 2) of a power instruction value in storage unit 295.
Figure 29B:
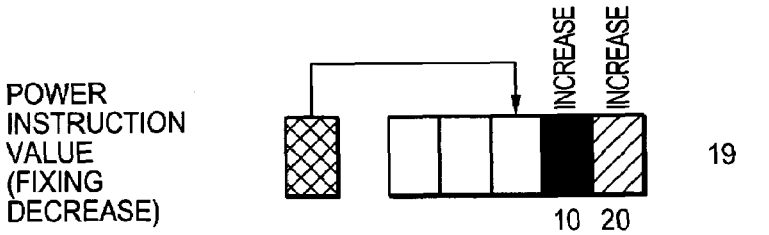
Figure 29C:
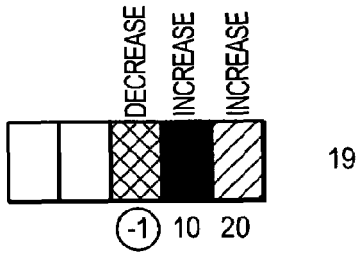
Figure 29D:
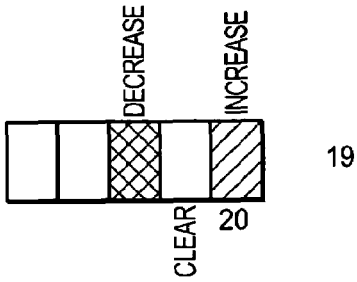
Figure 29E:
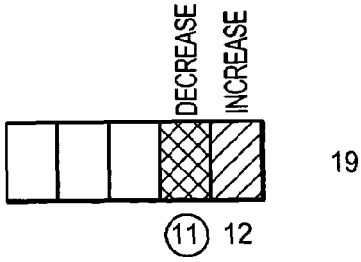
Figure 30:
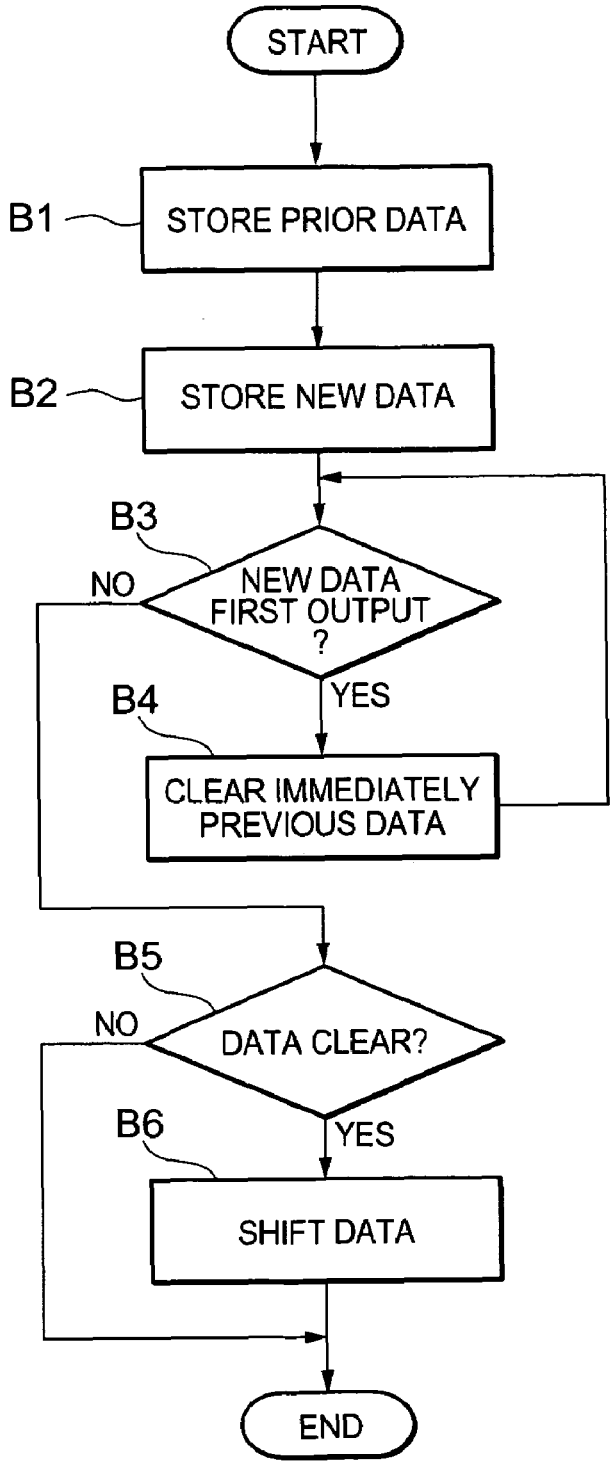
FIG. 30 is a flowchart showing a control example of a power instruction value in storage unit 295.

Subsequently, another example will be described in which the disadvantage is avoided. FIGS. 29A to 29E are schematic diagrams showing a storage example and an output example (No. 2) of the power instruction value in the storage unit 295. In this sixteenth embodiment, the immediately previously stored data is cleared on the above-described condition, and the clearing is repeated until a condition is generated that the new power instruction value is output after the already stored data. This will be described specifically with reference to a flowchart of FIG. 30. FIG. 30 is a flowchart showing a control example of the power instruction value in the storage unit 295.

In step B1 shown in FIG. 30, a plurality of power instruction values and associated delays are stored in the storage unit 295 for the waiting data row. Specifically, as shown in FIG. 29A, two instruction values (delay DL1: timer time 20) are stored which increase the power with the elapse of timer time 10, and timer times 20 and 10 are set as the delay to both the values.

Thereafter, with the elapse of time, a new power instruction value is set, and stored in the storage unit 295 for the waiting data row in step B2. In a specific example, as shown in FIG. 29B, when reaching timer time 19, a new power instruction value (delay DL2: timer time 12) is set which decreases the power. As shown in FIG. 29C, the delay value associated with the power instruction value is converted into the delay after outputting the power instruction value indicating the fixing increase, and stored.

When the new power instruction value is stored, in step B3, it is judged whether or not the new power instruction value is output before the already stored power instruction value. In a specific example, as shown in FIG. 29C, the converted delay indicates a minus value, and there is a condition that the new power instruction value is output before the power instruction value indicating the fixing increase. Therefore, the immediately previously stored data is cleared in step B4 among the already stored power instruction value and the related delay.

Moreover, it is repeatedly judged whether or not there is a condition that the new data is output after the already stored data. On a condition that the new data is still output before the already stored data, in steps B3 and B4, the immediately previous data is cleared as shown in FIG. 29D among the already stored data. These steps are repeated until a condition is obtained that the new data is output after the already stored data.

FIG. 29 shows that the immediately previous data is once cleared to thereby obtain a condition that new data is output later. On the condition that the new data is output after the already stored data, as shown in FIG. 29E, the new data is stored in the tail of the already stored data. In this case, if necessary, the data is shifted in steps B5 and B6. When the data shifts in the step B6, in the waiting data row, the delay value is stored which has been converted into the delay after outputting the immediately previous power instruction value.

Thus, according to the copying machine 602 of the sixteenth embodiment, the delay selecting unit 31 is connected to the slow/rapid data table 34. The magnitude of the fluctuation of the load current is predicted in accordance with the change of the operation mode. When the decrease/fluctuation of the load current is large in accordance with the change of the operation mode, the data for shortening the delay DL2 is stored. When the increase/fluctuation of the load current is small, the data for extending the delay DL1 is stored.

In the above-described example, the length of the delay is adjusted in a plurality of stages. In this case, the immediately previously stored data is cleared in such a manner that the length adjustment amount differs. The clearing is repeated until the condition is obtained that the new power instruction value is output after the already stored data. Therefore, as shown in steps B1 to B6, the output order of the power instruction value is appropriately adjusted, and the power can be controlled in accordance with the change of the secondary-side current detection signal S1 reflecting the secondary-side current.

Seventeenth Embodiment

Figure 31:
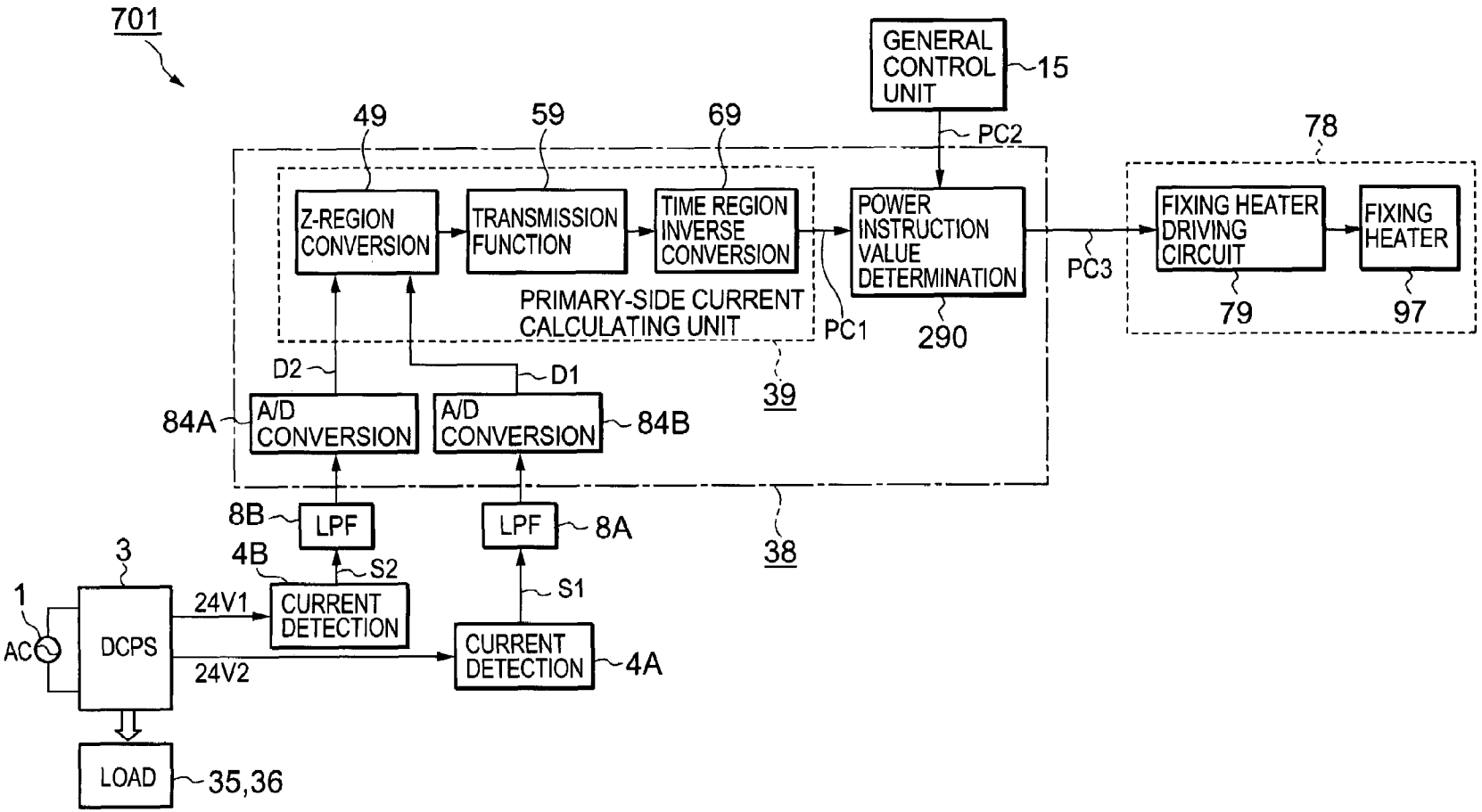
FIG. 31 is a block diagram showing a constitution example of a power control system according to a seventeenth embodiment of the present invention for a digital copying machine 701.

FIG. 31 is a block diagram showing a constitution example of a power control system according to a seventeenth embodiment of the present invention for a copying machine 701.

In the seventeenth embodiment, power control unit 38 comprises primary-side current calculating unit 39. The power control unit 38 is constituted in such a manner as to instantaneously control a power which can be supplied to fixing unit 78 based on a multiplied value of a secondary-side current detection signal S1 reflecting a secondary-side current of direct-current power supply 3, input from current detectors 4A, 4B, and a preset DC power supply transmission function f(t), before a current fluctuation on the secondary side of the direct-current power supply 3 influences the primary side. Moreover, the power can be supplied as much as possible to the fixing unit 78 from a alternating-current power supply 1 within the limit of a use current I (ninth image forming apparatus).

The copying machine 701 shown in FIG. 31 is one example of the image forming apparatus, and the power control unit 82 of the copying machine 201 described in the fourth embodiment has been replaced with the power control unit 38. A power control system of the copying machine 701 comprises a direct-current power supply (DCPS) 3, current detectors 4A, 4B, low pass filters 8A, 8B, general control unit 15, and power control unit 38.

The secondary side of the direct-current power supply (DCPS) 3 is connected to DC motors 35, 36 via the current detectors 4A, 4B. The primary side of the direct-current power supply (DCPS) 3 is connected to the fixing unit 78 having a fixing heater driving circuit 79 and a fixing heater 97. The fixing unit 78 is connected to the power control unit 38 as described above in each embodiment. Since components having the same names and reference numerals as those of the fifteenth and sixteenth embodiments have the same functions, the description is omitted.

In this seventeenth embodiment, the power control unit 38 comprises primary-side current calculating unit 39, A/D converters 84A, 84B, and power instruction value determining section 290, and controls a power which can be supplied to the fixing unit 78 based on a primary-side current Iin calculated by the primary-side current calculating unit 39. A CPU is used in the power instruction value determining section 290. The A/D converters 84A, 84B are connected to the primary-side current calculating unit 39. The primary-side current calculating unit 39 holds the DC power supply transmission function f(t) for calculating the primary-side current Iin of the direct-current power supply 3 based on the secondary-side current detection signals S1, S2 reflecting a secondary-side current Iout of the direct-current power supply 3, output from the current detectors 4A, 4B.

The primary-side current calculating unit 39 has a Z-region conversion unit 49, a transmission function multiplication unit 59, and a time region inverse conversion unit 69. The Z-region conversion unit 49 inputs current detection data D1, D2 output from the A/D converters 84A, 84B, and converts a secondary-side current Iout(t) depending on a time region into a Z-region (or the frequency region) such as a Laplace region which does not depend on the time region to output a secondary-side current Iout(Z).

The Z-region conversion unit 49 is connected to the transmission function multiplication unit 59, and the secondary-side current Iout(Z) converted into the Z-region is multiplied by a DC power supply transmission function f(Z) to output Iin(Z)=Iout(Z)×f(Z). As to the DC power supply transmission function f(Z), for example, a transmission function f(t) is obtained beforehand including a delay amount from a secondary-side load current waveform of the direct-current power supply 3 and a primary-side current waveform of the direct-current power supply 3. This DC power supply transmission function f(t) is held as a function equation table in the primary-side current calculating unit 39. A parameter of the DC power supply transmission function f(t) is either one or a plurality of parameters including secondary-side current detection signals S1, S2, a primary-side voltage Vin, temperature, power factor, and primary-side current frequency.

The transmission function multiplication unit 59 is connected to the time region inverse conversion unit 69, and Iin(Z) multiplied in the Z-region is inversely converted into the time region to output Iin(t) which depends on the time. The time region inverse conversion unit 69 is connected to a power instruction value determining section 290, and a power instruction value is determined with respect to the fixing unit 78 based on the primary-side current Iin(t) output from the time region inverse conversion unit 69. Even when the current detection data D1, D2 rapidly fluctuate reflecting the secondary-side current, a situation is avoided in which the current exceeds the limit value of the primary-side current Iin. For example, a power instruction value PC1 is input from the general control unit 15, the power instruction value PC1=primary-side current Iin(t) is input from the time region inverse conversion unit 69, and both the values are compared.

As a result of the above-described comparison, for example, the power instruction value determining section 290 selects a smaller value from the first and second power instruction values PC1, PC2, and controls power supply to the fixing unit 78 based on either the first or second power instruction value PC1 or PC2 selected here. When the power instruction value PC1 is smaller than the power instruction value PC2 in this example, the power instruction value PC1 is selected.

Moreover, when the power instruction value PC1 is larger than the power instruction value PC2, the power instruction value PC1 is selected. Thus, the power supply to the fixing unit 78 can be controlled by a third power instruction value PC3=PC1 or PC3=PC2 based on either the first or second power instruction value PC1 or PC2 newly determined by the power instruction value determining section 290 (another comparison determining method of the power instruction value).

Figure 32A:
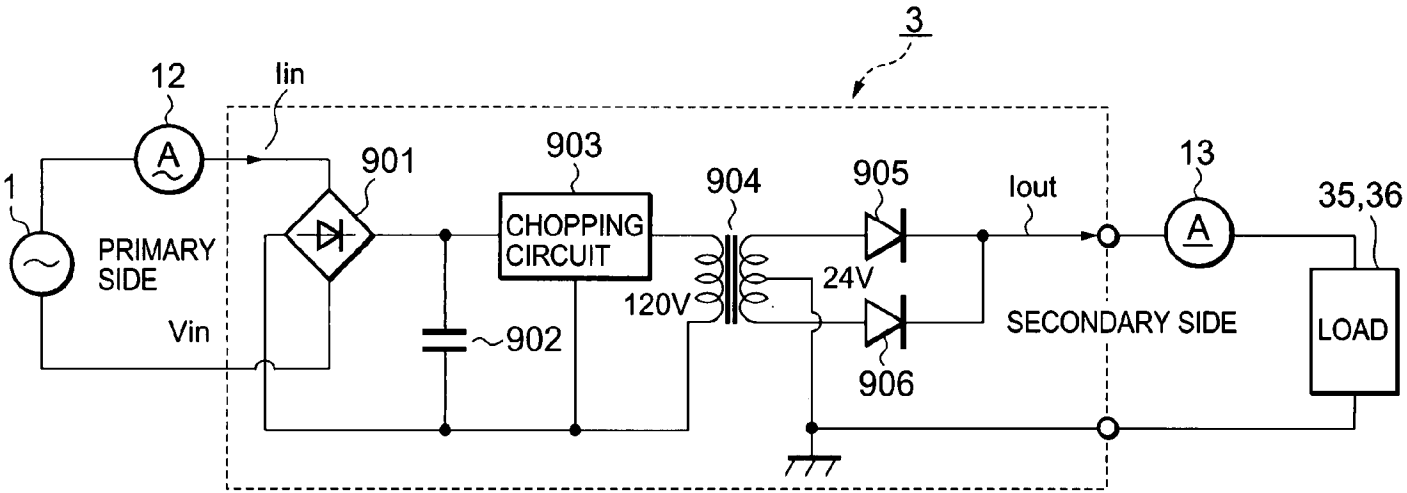
FIGS. 32A and 32B are constitution diagrams showing relation examples between a direct-current power supply 3 and a DC power supply transmission function.
Figure 32B:
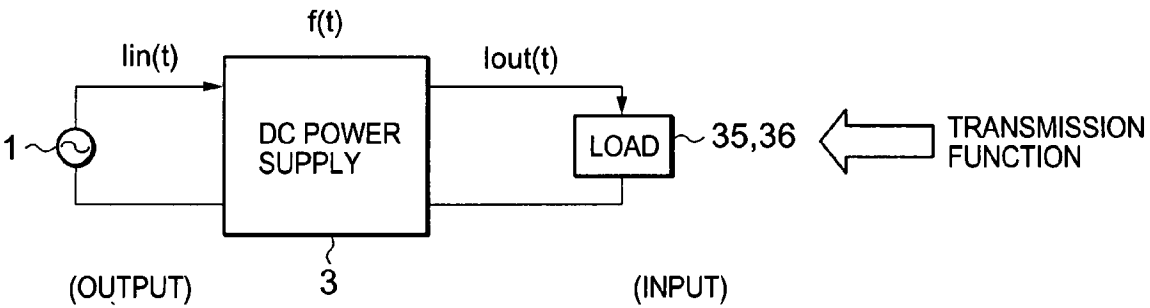

FIGS. 32A and 32B are constitution diagrams showing relation examples between a direct-current power supply 3 and a DC power supply transmission function.

The direct-current power supply 3 shown in 32A comprises a rectification circuit 901, an electrolytic capacitor 902, a chopping circuit 903, a transformer 904, and rectification diodes 905 and 906. The rectification circuit 901 is connected to an alternating-current power supply 1 via an alternating-current ammeter 12, and rectifies a primary-side voltage Vin to generate a direct-current voltage. The alternating-current ammeter 12 is constituted to measure the primary-side current Iin (effective value). The rectification circuit 901 is connected to the electrolytic capacitor 902, and a rectification output (pulsating flow) is smoothed to output, for example, a voltage of DC 120 V. The rectification circuit 901 and the electrolytic capacitor 902 are connected to the chopping circuit 903. The voltage of DC 120 V is chopped at a predetermined frequency to output an alternating-current voltage of AC 120 having a desired frequency.

The chopping circuit 903 is connected to the transformer 904 having, for example, a turn ratio of 5:1. The transformer 904 lowers the alternating-current voltage of AC 120 applied to the primary side into an alternating-current voltage of AC 24 V. The secondary side of the transformer 904 is connected to the diodes 905 and 906 for full-wave rectification. A neutral line is drawn from the secondary side of the transformer 904, and is grounded. The diodes 905 and 906 rectify the full wave of the alternating-current voltage of AC 24 V to supply a direct-current voltage of DC 24 V, for example, to loads of the motors 35, 36 and the like through a direct-current ammeter 13. The direct-current ammeter 13 is constituted to measure the secondary-side current Iout.

Here, a state will be considered in which the secondary-side current fluctuation of the direct-current power supply 3 influences the primary side. For example, when the secondary-side current is supplied to a certain load, and the load current increases with time, the currents flowing through the diodes 905 and 906 increase before the fluctuation influences the primary side. An AC voltage drops induced by the transformer 904 in accordance with the current increase, and this voltage drop influences the primary side of the transformer 904. The drop of the AC voltage on the primary side of the transformer 904 is propagated to the chopping circuit 903. Since a feedback circuit is usually incorporated in the chopping circuit 903, a correction function works in such a manner as to raise the drop of the AC voltage.

When the correction function works in the chopping circuit 903, the output current output from the rectification circuit 901 increases, and a terminal voltage of the electrolytic capacitor 902 drops. Therefore, the primary-side current flowing into the rectification circuit 901 increases. It is known that a propagation time of about 10 ms is usually required, depending on the load and power supply capacity, from when the secondary-side current increases until the primary-side current increases. In this example, assuming that the secondary side (load side) of the direct-current power supply 3 is a fluctuation input side, and the primary side (alternating-current power supply side) is a fluctuation output side, DC power supply transmission function=output/input can be defined.

FIG. 32B is a block diagram showing the DC power supply transmission function f(t). In FIG. 32B, assuming that the primary-side current flowing into the direct-current power supply 3 from the alternating-current power supply 1 is Iin(t), the direct-current power supply 3 comprises the rectification circuit 901, electrolytic capacitor 902, chopping circuit 903, transformer 904, and rectification diodes 905 and 906, the DC power supply transmission function is f(t), and the secondary-side current flowing into the load circuits 35, 36 and the like from the direct-current power supply 3 is Iout(t), the following equation (1) is established between the primary-side current Iin(t) and the secondary-side current Iout(t):

$$Iin(t)=f\{Iout(t)\} \tag{1}$$

It is possible to calculate the primary-side current Iin(t) following the secondary-side current Iout(t) even in the time region, but the calculation is high-order and complicated. Therefore, in this example, the region is once converted into a region which can be handled by multiplication. Here, when the time region is converted into the Z-region like Laplace region (frequency region is possible) in Equation (1), Equation (1) is given by Equation (2):

$$Iin(Z)=f(Z)\times Iout(Z) \quad (2).$$

The DC power supply transmission function is defined by output/input, and it is assumed in this example that the secondary side (load side) of the direct-current power supply 3 is the fluctuation input side, and the primary side (alternating-current power supply side) is the fluctuation output side. Therefore, when the DC power supply transmission function f(Z) is calculated from Equation (2), Equation (3) is given:

$$f(Z)=Iin(Z)/Iout(Z) \quad (3).$$

The DC power supply transmission function f(Z) of Equation (3) is held in a program of the transmission function multiplication unit 59. This program is used in calculating the primary-side current Iin based on the secondary-side current Iout(t).

Figures 33A, 33B:
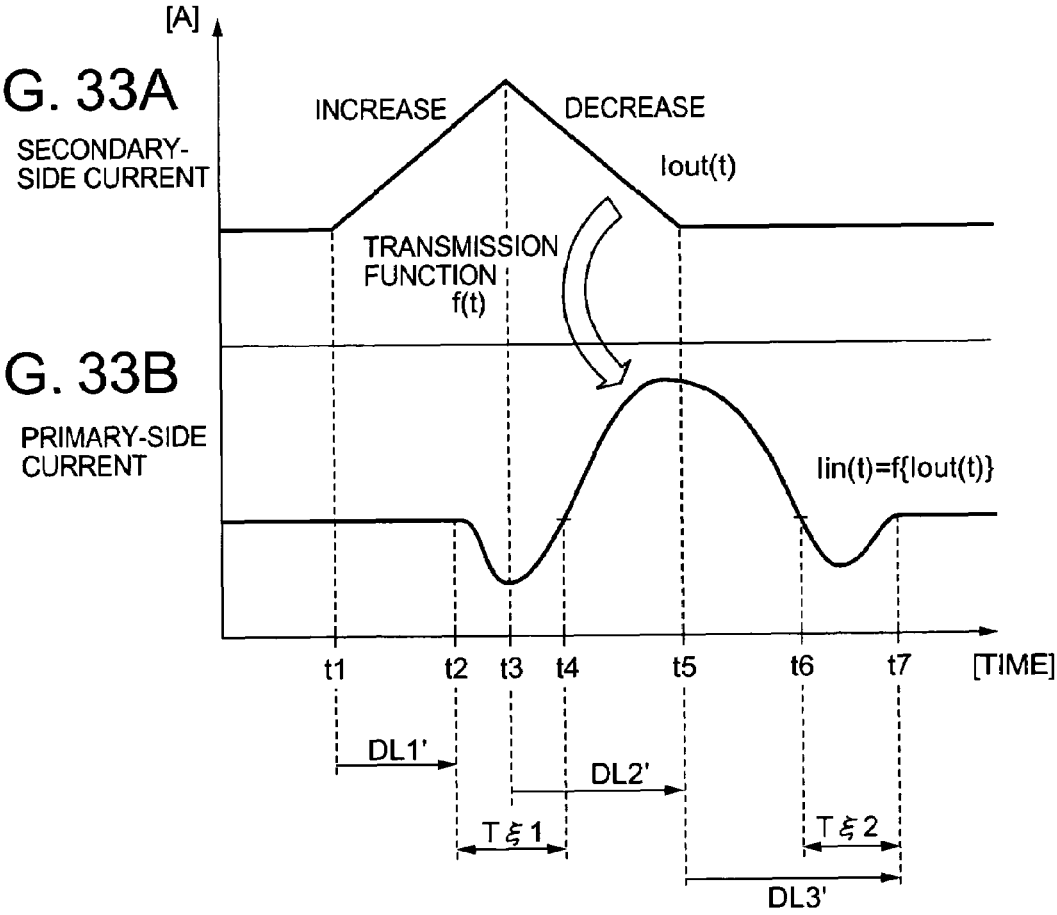
FIGS. 33(A) and (B) are waveform diagrams showing function examples of a DC power supply transmission function f(t)

FIGS. 33(A) and (B) are waveform diagrams showing function examples of the DC power supply transmission function f(t). According to the secondary-side current Iout(t) shown in FIG. 33(A), the current Iout(t) shifts to increase at time t1 from a state in which the direct-current power supply 3 supplies a certain current to the load circuit 35, 36 or the like. With the elapse of time, the current Iout(t) increases, and reaches a peak value at time t3. At the time t3 when the peak value is supplied, the current Iout(t) shifts to the decrease. With the elapse of time, the current Iout(t) decreases, and reaches an original certain current Iout(t) at time t5.

FIG. 33(B) shows a waveform of the primary-side current Iin(t). A relation with respect to the DC power supply transmission function f(t) is represented by the primary-side current Iin(t)=f{Iout(t)}. In this example, when the secondary-side current Iout(t) increases/decreases as shown in FIG. 33(A), the primary-side current Iin(t) is as shown in FIG. 33(B). At the time t2 delayed by a delay time DL1' from time t1 when the current Iout(t) shifts to the increase as shown in FIG. 33(A), the current once shifts to the decrease. Thereafter, at time t4 when the current shifts to increase, the value exceeds the original value, and the increase continues. That is, a vibration period Tξ1 is set between the times t2 and t4. This is because the vibration period Tξ1 includes inductance of the transformer 904, and a delay element of the electrolytic capacitor 902 connected to the chopping circuit 903.

Moreover, at time t5 delayed by a delay time DL2' from time t3 when the secondary-side current Iout(t) reaches the peak value, the primary-side current Iin(t) reaches the peak value, and thereafter shifts to the decrease. Even when the current exceeds the original value at time t6, the current continues decreasing, and thereafter shifts to the increase. At time t7 delayed by a delay time DL3' from time t5 when the secondary-side current Iout(t) returns to the original value, the current returns to the original value. Even in this example, a vibration period Tξ2 is set between the times t6 and t7. This is because the vibration period Tξ2 includes the inductance of the transformer 904, and the delay element of the electrolytic capacitor 902 connected to the chopping circuit 903. Thus, the DC power supply transmission function f(t) is given by a function which sets the delay times DL1', DL2', DL3', and the vibration periods Tξ1, Tξ2.

An amplifier embodying a vibration element such as inductance, delay element such as an electrostatic capacity, and increase function is combined with an attenuator embodying an attenuation function to model the direct-current power supply 3, and a transmission function may be obtained in the modeled DC power supply circuit.

Figure 34:
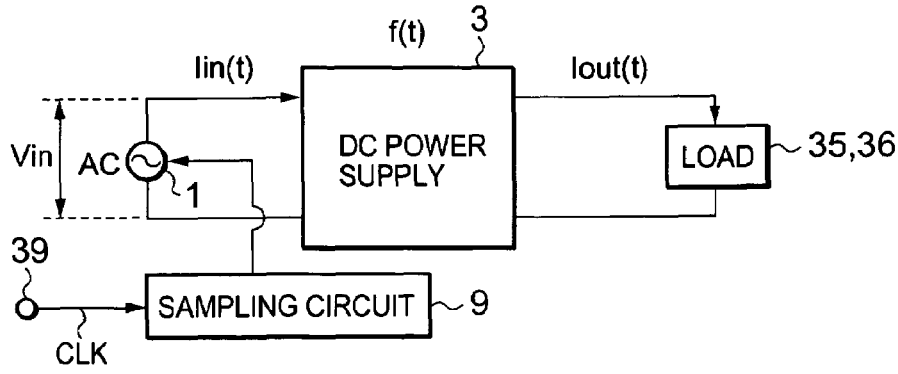
FIG. 34 is a constitution diagram showing a sampling circuit example of a primary-side current Vin of a direct-current power supply 3.

Next, a case will be described where the limit value of the use current I, for example, I=15 A according to domestic specifications is controlled by the primary-side current Iin(t) of the direct-current power supply 3. Furthermore, the limit value=15 A is controlled by a momentary value (i× sin ωt) of the primary-side current Iin obtained from the DC power supply transmission function. FIG. 34 is a constitution diagram showing a circuit example for sampling the primary-side current Vin of the direct-current power supply 3.

A sampling circuit 9 shown in FIG. 34 samples the primary-side voltage Vin of the direct-current power supply 3 based on a clock signal CLK having a predetermined frequency, for example, 16 MHz. The sampled primary-side voltage Vin is used as a parameter in the DC power supply transmission function f(t), and the momentary value of the primary-side current Iin(t) is calculated based on the primary-side voltage Vin.

Figure 35A:
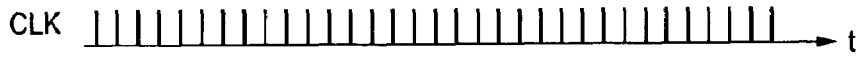
FIGS. 35A and 35B are waveform diagrams showing sampling examples of a primary-side voltage.
Figure 35B:
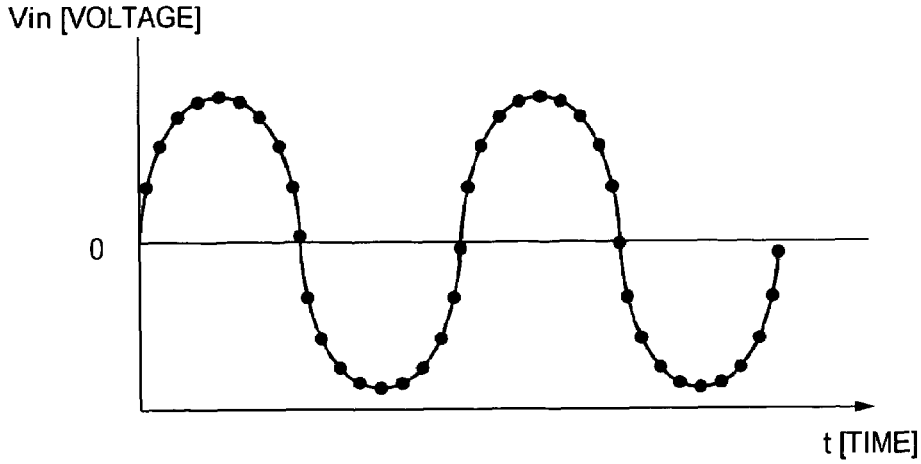

FIGS. 35A and 35B are waveform diagrams showing sampling examples of the primary-side voltage Vin. In each of the FIGS. 35A and 35B, the abscissa shows time t. In FIG. 35A, the ordinate shows a pulse amplitude of the clock signal CLK, and in FIG. 35B, the ordinate shows the amplitude of the primary-side voltage Vin.

The clock signal CLK shown in FIG. 35A is supplied to the sampling circuit 9 shown in FIG. 34. The primary-side voltage Vin shown in FIG. 35B is shown by a sinusoidal wave (Vin=v× sin ωt). Black dots in the voltage waveform indicate sampling points by the clock signal CLK. In this example, the momentary value of the converted primary-side current Iin(t) is obtained on the primary side of the direct-current power supply 3 based on the momentary value of the sampling point of the primary-side voltage Vin. Accordingly, the fixing current can be controlled by vector synthesis based on a difference between the momentary value of the use current I and that of the primary-side current Iin.

Figure 36A:
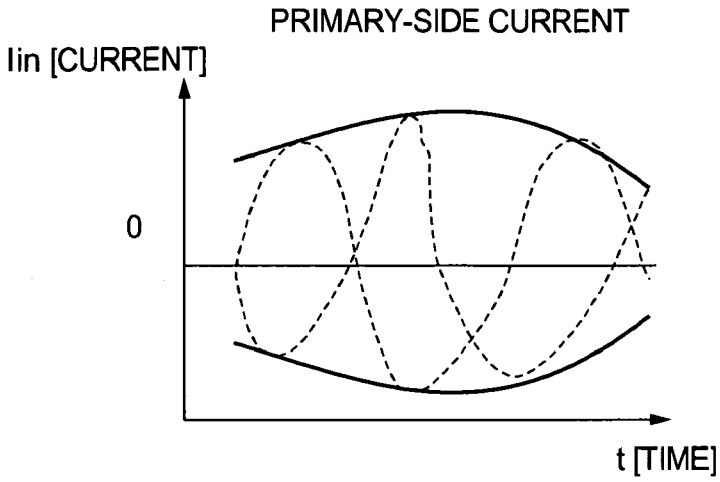
FIGS. 36A and 36B are diagrams showing current waveform examples of a primary-side current Iin which flows into the direct-current power supply 3.
Figure 36B:
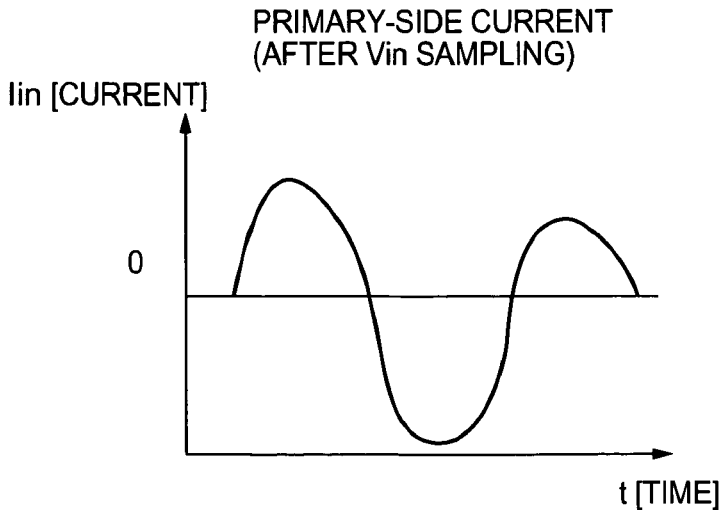

FIGS. 36A and 36B are diagrams showing current waveform examples of the primary-side current Iin which flows into the direct-current power supply 3. In each of FIGS. 36A and 36B, the abscissa shows time t. In FIGS. 36A and 36B, the ordinate shows the amplitude of the primary-side current Iin on the primary side of the direct-current power supply 3. In FIG. 36A, a waveform show by a broken line is a current waveform on the primary side which undergoes load fluctuation on the secondary side of the direct-current power supply 3. A waveform shown by a solid line is an envelope line connecting maximum amplitudes of the current waveforms on the primary side. When the primary-side voltage Vin is not used as the parameter, the envelope line is used as the primary-side current waveform which flows into the direct-current power supply 3.

A solid line shown in FIG. 36B is a waveform obtained by reproducing the primary-side current Iin undergoing the load fluctuation on the secondary side of the direct-current power supply 3 based on the sampling of the primary-side voltage Vin. According to the primary-side current waveform, the primary-side current Iin is indicated by the momentary value. Therefore, as compared with the primary-side current waveform which depends on the envelope line, the primary-side current waveform flowing into the direct-current power supply 3 can be reproduced in real time. Accordingly, the fixing current can be controlled with high precision based on the primary-side current Iin indicated by the momentary value.

FIGS. 37(A) to (D) are waveform diagrams showing control examples of the fixing power in the fixing control unit 38. In FIGS. 37(A) to (D), the abscissa shows time t, and the ordinate shows amplitude.

Figures 37A, 37B, 37C, 37D:
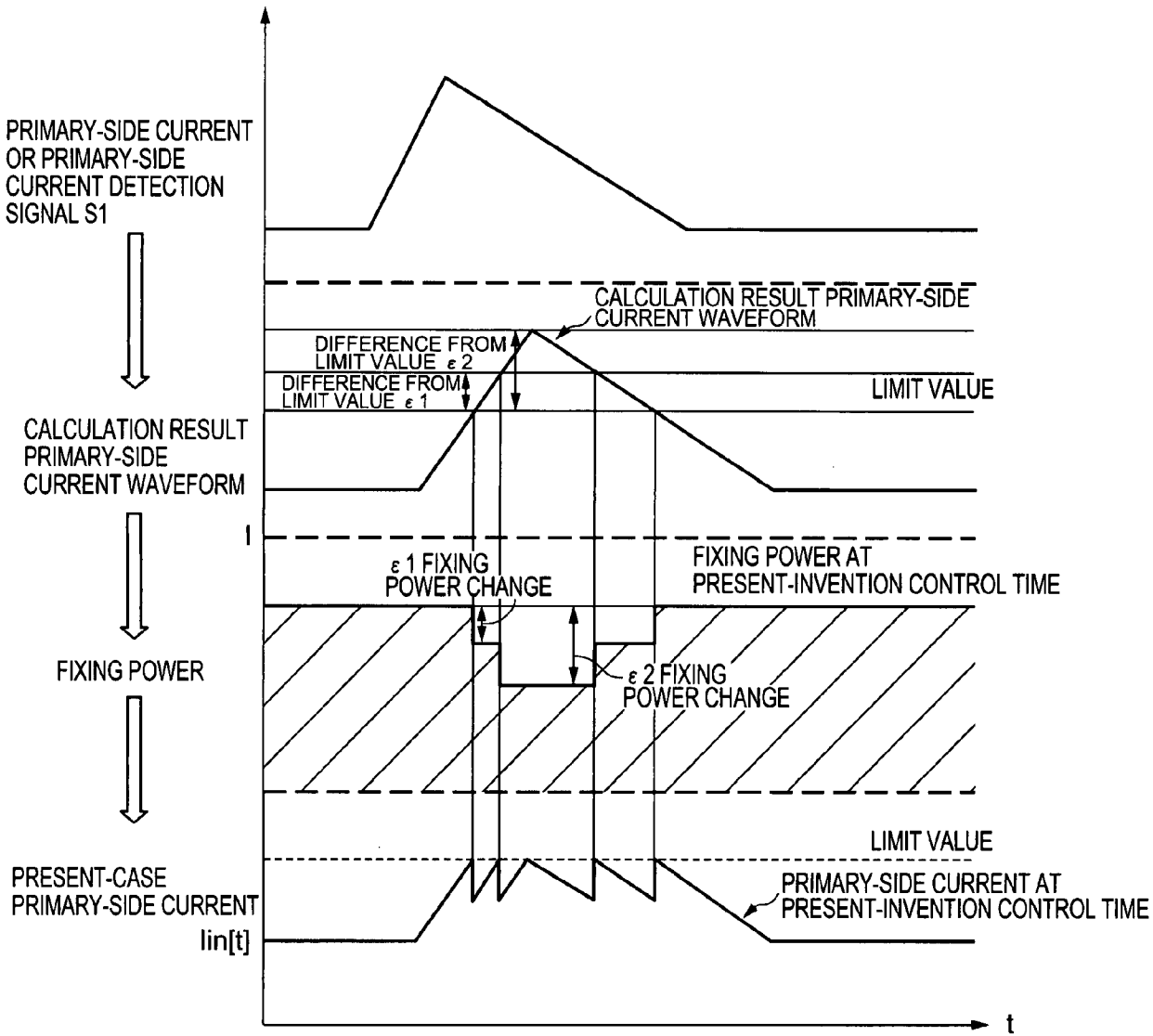
FIGS. 37(A) to (D) are waveform diagrams showing control examples of a fixing power in a fixing control unit 38.

A solid line shown in FIG. 37(A) shows a waveform of the current Iout(t) on the secondary side of the direct-current power supply 3 and the secondary-side current detection signal S1 reflecting the current. In this example, the secondary-side current waveform changes by the load fluctuation of the motor 35, 36 or the like in such a manner that the secondary-side current increases and decreases.

A solid line shown in FIG. 37(B) shows a primary-side current waveform based on calculation result at a non-control time. The waveform of the primary-side current Iin(t) is obtained using the secondary-side current Iout(t) and the DC power supply transmission function f(t) based on the secondary-side current detection signal S1. The primary-side current waveform rises with delay by a delay period as compared with the secondary-side current shown in FIG. 37(A). Since the primary-side current waveform exceeds the limit value shown by a broken line in the figure, the circuit breaker 22 operates without being controlled.

Upper/lower broken lines shown in FIG. 37(C) show power amount usable by the copying machine 701. This power amount includes a fixing power which is usable by the fixing unit, and load powers of the motors 35, 36 and the like. A portion shown by slanted lines in FIG. 37(C) shows a fixing power at a control time in the present invention.

A solid line shown in FIG. 37(D) shows the primary-side current Iin(t), and shows a waveform at the control time according to the present invention.

In this example, when the secondary-side current increases, and the primary-side current Iin exceeds the control value from the calculation result of the primary-side current Iin based on the secondary-side current detection signal S1 shown in FIG. 37(A), the fixing power is changed based on the difference between the primary-side current Iin and the control value. For example, the control is executed based on the difference between the primary-side current Iin and the control value in multiple stages (rising multi-stage control).

In this rising multi-stage control, when a difference $\epsilon 1$ is made between the control value and the amplitude of the primary-side current waveform in the first stage shown in FIG. 27(B), first, a rising first stage control is executed. In the rising first stage control, the fixing power amount is changed based on the difference $\epsilon 1$ between the primary-side current Iin and the control value. For example, the fixing power is reduced which is supplied to the fixing unit 78 with the full control value. Thereafter, the secondary-side current further increases, and a difference $\epsilon 2$ is made between the control value and the peak value of the amplitude of the primary-side current waveform in the second stage. In this case, a rising second stage control is executed. In the rising second stage control, the fixing power amount is changed based on the difference $\epsilon 2$ between the primary-side current Iin and the control value. For example, the fixing power changed in the first stage is further reduced.

Thereafter, even when the secondary-side current decreases, and the primary-side current Iin returns to the control value from the calculation result of the primary-side current Iin, the control is executed based on the difference between the primary-side current Iin and the control value in multiple stages (descending multi-stage control). In this descending multi-stage control, when a difference $\epsilon 1$ is made between the control value and the amplitude of the primary-side current waveform in the first stage, first, a descending first stage control is executed.

In the descending first stage control, the fixing power amount is changed based on the difference $\epsilon 1$ between the primary-side current Iin and the control value. For example, the fixing power is increased which is supplied to the fixing unit 78 in the rising second stage control. Thereafter, the secondary-side current decreases, and the difference is eliminated between the control value and the amplitude of the primary-side current waveform in the second stage. In this case, a descending second stage control is executed. In the descending second stage control, the fixing power amount is changed based on a difference "0" between the primary-side current Iin and the control value. For example, the fixing power is further increased which is supplied to the fixing unit 78 changed in the descending first stage control, and the fixing unit 78 is driven with the full limit value.

Thus, the fixing control can be performed like a use current I−Iin(t) based on the primary-side current Iin(t) at the control time of the present invention shown by a thin line of FIG. 37(D). The fixing power assigned by a usable power amount in upper/lower broken lines shown in FIG. 37(C) is usable by the fixing unit 78 up to the full limit value.

Figure 38:
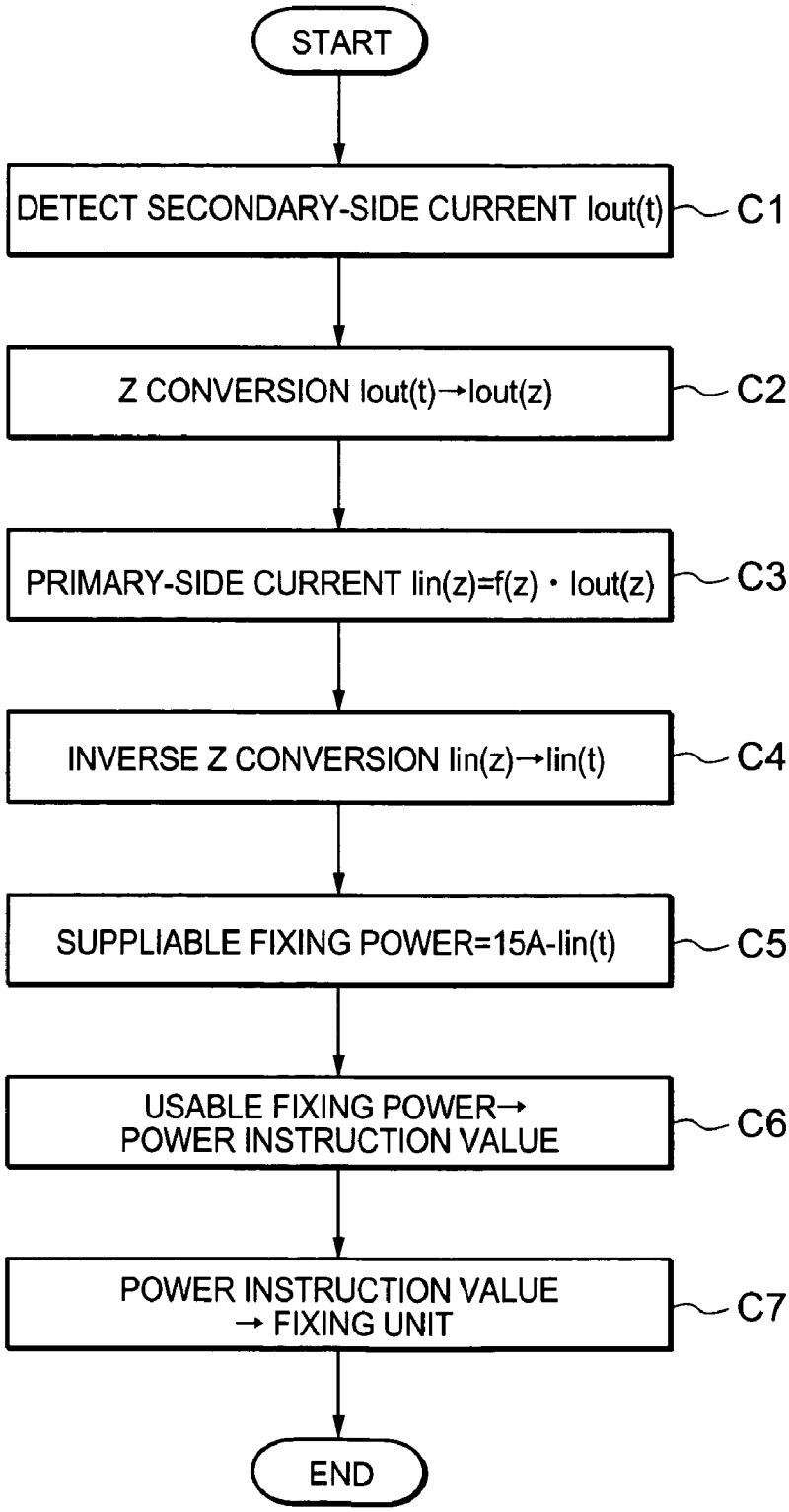
FIG. 38 is a flowchart showing a control example of a fixing power in a digital copying machine 701.
Figure 39:
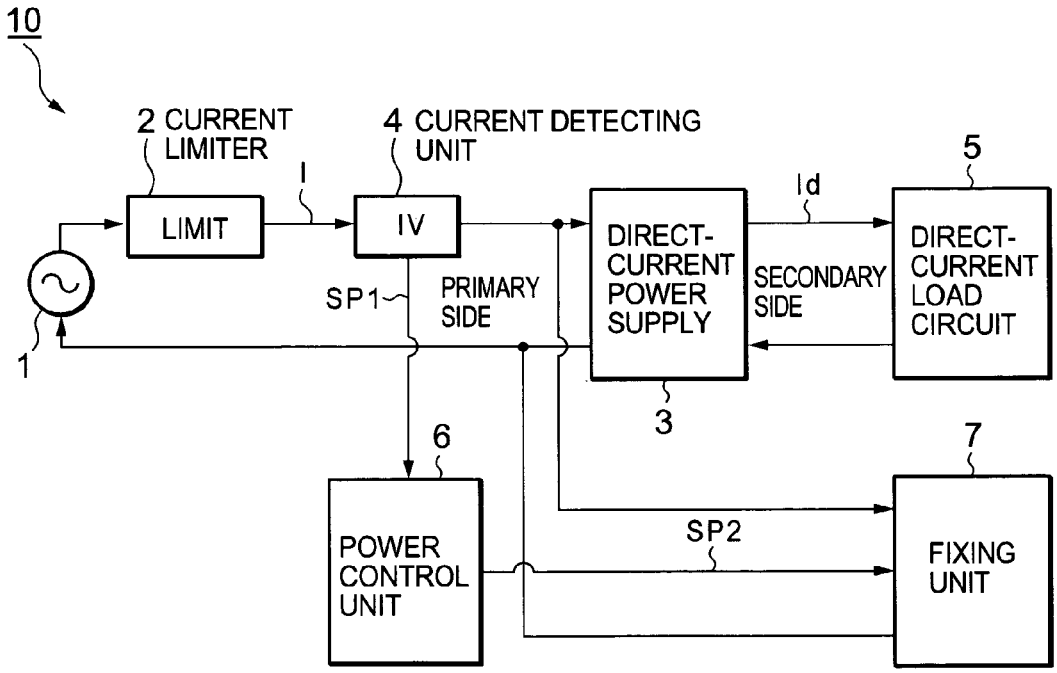
FIG. 39 PRIOR ART
FIG. 39 is a block diagram showing a constitution example of a power supply system 10 mounted on a digital copying machine or the like according to one conventional example.
Figure 40:
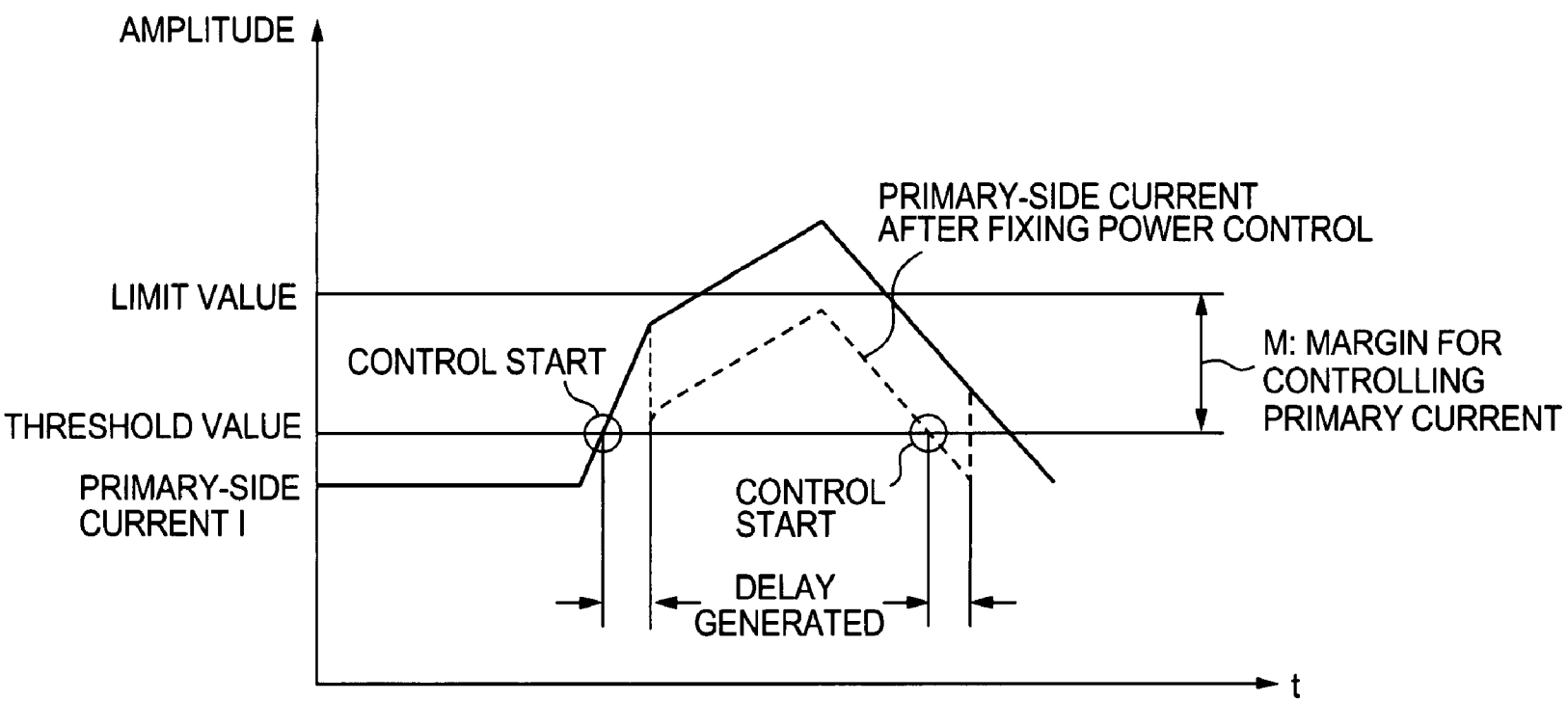
FIG. 40 PRIOR ART
FIG. 40 is a waveform diagram showing a control example of a current (primary-side current I) supplied from an alternating-current power supply 1.

Next, an example will be described in which the fixing power is controlled in the copying machine 701. FIG. 38 is a flowchart showing a control example of the fixing power in the copying machine 701.

In this seventeenth embodiment, the power control unit 38 comprises the primary-side current calculating unit 39. The power control unit 38 is controlled based on a multiplied value of the secondary-side current detection signal S1 reflecting the secondary-side current of the direct-current power supply 3, input from the current detectors 4A, 4B, and the preset DC power supply transmission function f(t), before the current fluctuation on the secondary side of the direct-current power supply 3 influences the primary side. A case will be described where the use current I is 15 A.

On these control conditions, the power control unit 38 detects the secondary-side current Iout(t) in a step C1 of the flowchart shown in FIG. 38. At this time, the primary-side current calculating unit 39 detects the secondary-side current Iout of the direct-current power supply 3 based on the secondary-side current detection signals S1, S2 output from the current detectors 4A, 4B. The current detection data D1 indicating the secondary-side current Iout is output to the Z-region conversion unit 49 from the A/D converter 84A, and current detection data D2 is output to the Z-region conversion unit 49 from the A/D converter 84B.

Next, in step C2, the Z-region conversion unit 49 inputs the current detection data D1, D2 output from the A/D converters 84A, 84B, and converts the secondary-side current Iout(t) depending on the time region into the Z-region (or the frequency region) like the Laplace region which does not depend on the time region. The Z-converted secondary-side current Iout(Z) is output to the transmission function multiplication unit 59.

Moreover, in step C3, the transmission function multiplication unit 59 multiplies the secondary-side current Iout(Z) converted into the Z-region by a DC power supply transmission function f(Z). The DC power supply transmission function f(t) is read from the function equation table held beforehand in the primary-side current calculating unit 39. The multiplied Iin(Z)=Iout(Z)·f(Z) is output to the time region inverse conversion unit 69.

Moreover, in step C4, the time region inverse conversion unit 69 inversely converts the Iin(Z) multiplied in the Z-region into the time region. The inversely-converted Iin(t)

depending on the time is output to the power instruction value determining section 290.

Next, in step C5, the power instruction value determining section 290 determines the power instruction value with respect to the fixing unit 78 based on the primary-side current Iin(t) output from the time region inverse conversion unit 69. In this example, the power instruction value determining section 290 calculates a suppliable fixing power=15 A−Iin(t).

Furthermore, in step C6, the power instruction value determining section 290 determines the power instruction value with respect to the fixing unit 78 from the suppliable fixing power=15 A−Iin(t). The power instruction value is determined in order to avoid a situation in which the current exceeds the limit value of the primary-side current Iin even in a case where the secondary-side current rapidly fluctuates. For example, the power instruction value PC1 is input from the general control unit 15, and compared with the power instruction value PC1=primary-side current Iin(t) from the time region inverse conversion unit 69.

As a result of the above-described comparison, the power instruction value determining section 290 selects a smaller value from the first and second power instruction values PC1, PC1. For example, when the power instruction value PC1 is smaller than the power instruction value PC1, the power instruction value PC1 is selected. When the power instruction value PC1 is smaller than the power instruction value PC1, the power instruction value PC1 is selected.

To control the power supply to the fixing unit 78 based on the selected first or second power instruction value PC1 or PC1, the process shifts to step C7, and the power instruction value determining section 290 sets the power instruction value to the fixing unit 78. At this time, the power instruction value determining section 290 sets a third power instruction value PC3=PC1 or PC3=PC1 based on either the first or second power instruction value PC1, PC1 newly determined with respect to the fixing unit 78 to execute the supply control of the fixing power.

In this example, when the secondary-side current increases, and the primary-side current Iin exceeds the control value from the calculation result of the primary-side current Iin based on the secondary-side current detection signal S1, and the primary-side current Iin exceeds the control value, the rising multi-stage control is executed. When the secondary-side current decreases, and the primary-side current Iin returns to the control value from the calculation result of the primary-side current Iin, the descending multi-stage control is executed (see FIGS. 37(A) to (D)).

Thus, according to the copying machine 701 of the seventeenth embodiment, the power control unit 38 comprises the primary-side current calculating unit 39. The power control unit 38 is controlled based on a multiplied value of the secondary-side current detection signal S1 reflecting the secondary-side current of the direct-current power supply 3, and the preset DC power supply transmission function f(t), before the current fluctuation on the secondary side of the direct-current power supply 3 influences the primary side.

Therefore, the fixing control can be performed like the use current I−Iin(t) based on the primary-side current Iin(t) at the control time of the present invention shown by the thin line of FIG. 37(D), before the current fluctuation on the secondary side of the direct-current power supply 3 influences the primary side. The power which can be supplied to the fixing unit 78 can be instantaneously controlled. Accordingly, the fixing power assigned by the usable power amount in the upper/lower broken lines shown in FIG. 37(C) is usable by the fixing unit 78 up to the full limit value.

In the first to seventeenth embodiments, the image forming apparatus has been described in accordance with the monochromatic copying machine, but the present invention is not limited to the machine. A similar effect is obtained even in a case where the power supply system and the image forming apparatus of the present invention are applied to a color printer, facsimile apparatus, copying machine, a complex machine of them or the like.

The present invention has the following nine aspects.

According to a first aspect of the present invention, there is provided an image forming apparatus (hereinafter referred to simply as the apparatus) which is usable when connected to an alternating-current power supply, the apparatus comprising: an image forming unit for forming an image on a predetermined recording medium; a fixing unit connected to the alternating-current power supply in such a manner as to thermally fix the image formed on the recording medium by the image forming unit; a general control unit for controlling the whole image forming apparatus including the image forming unit and the fixing unit; and a power supply system which supplies power to the image forming unit, the fixing unit, and the general control unit, the power supply system comprising: a direct-current power supply whose primary side is connected to the alternating-current power supply and whose secondary side is connected to a load and which supplies a direct-current power; a power control unit for controlling power supply of the fixing unit; and a current detector for detecting a current on the secondary side of the direct-current power supply to output a secondary-side current detection signal to the power control unit, the power control unit being constituted in such a manner as to control the power to be supplied to the fixing unit based on the secondary-side current detection signal of the direct-current power supply, output from the current detector.

According to the apparatus described in the first aspect, in a case where the apparatus is connected to the alternating-current power supply and used, the direct-current power supply of the power supply system has the primary side connected to the alternating-current power supply, and has the secondary side connected to the load to supply the direct-current power. The power control unit controls the power supply of the fixing unit connected to the alternating-current power supply. On this assumption, the power supply system supplies the power to the image forming unit, fixing unit, and general control unit. The general control unit controls the whole image forming apparatus including the image forming unit and the fixing unit. The image forming unit forms the image on the predetermined recording medium. The fixing unit thermally fixes the image formed on the recording medium by the image forming unit. Moreover, the current detector detects the current on the secondary side of the direct-current power supply to output the secondary-side current detection signal to the power control unit. The power control unit controls the power which can be supplied to the fixing unit based on the secondary-side current detection signal of the direct-current power supply, output from the current detector. Therefore, the power control unit can instantaneously control the power which can be supplied to the fixing unit based on the secondary-side current detection signal of the direct-current power supply, input from the current detector, before the load fluctuation of the motor or the like on the secondary side of the direct-current power supply influences the primary side, that is, the alternating-current power supply side connected to the fixing unit. Accordingly, the power can be supplied as much as possible to the fixing unit from the alternating-current power supply within the limit of the use current.

An image forming apparatus according to a second aspect of the present invention is the apparatus described in the first aspect, wherein the power control unit continuously permits decrease at a time when a fixing power is decreased, and limits increase control of the fixing power until a predetermined time elapses after the fixing power is decreased in a case where the fixing power to be supplied to the fixing unit is controlled based on the secondary-side current detection signal of the direct-current power supply, output from the current detector.

According to the apparatus described in the second aspect, the increase control of the fixing power can be prohibited until the predetermined time elapses after once decreasing the fixing power accompanying the increase of the secondary current detection signal of the direct-current power supply. This fixing power increase control is prohibited only for a certain time. Therefore, even when the secondary-side detection current rapidly fluctuates, it is possible to avoid a situation in which the current exceeds the limit value (15 A in Japan) of the primary-side current, and as much power as possible can be supplied to the fixing unit within the limit of the current supplied from the alternating-current power supply.

An image forming apparatus according to a third aspect of the present invention is the apparatus described in the first aspect, wherein the power control unit compares a first power instruction value for controlling the power supply of the fixing unit, determined based on the secondary-side current detection signal obtained by the current detector, with a second power instruction value for controlling the power supply of the fixing unit, determined by the general control unit, the power control unit selects a smaller value from the first and second power instruction values, and the power control unit controls the power supply of the fixing unit based on either of the first and second power instruction values.

According to the apparatus described in the third aspect, the power which can be supplied to the fixing unit can be instantaneously controlled by either of the first power instruction value determined based on the secondary-side current detection signal of the direct-current power supply, input from the current detector, and the second power instruction value determined by the general control unit before the load fluctuation of the motor or the like on the secondary side of the direct-current power supply influences the primary side, that is, the alternating-current power supply side connected to the fixing unit. Accordingly, the power can be supplied as much as possible to the fixing unit from the alternating-current power supply within the limit of the use current.

An image forming apparatus according to a fourth aspect of the present invention is the apparatus described in the third aspect, wherein the power control unit continuously permits decrease at a time when a fixing power is decreased, and limits increase control of the fixing power until a predetermined time elapses after the fixing power is decreased in a case where the fixing power to be supplied to the fixing unit is controlled based on either of the first and second power instruction values.

According to the apparatus described in the fourth aspect, by either of the first power instruction value determined based on the secondary current detection signal of the direct-current power supply and the second power instruction value determined by the general control unit, the increase control of the fixing power can be prohibited until the predetermined time elapses after the fixing power is once decreased.

An image forming apparatus according to a fifth aspect of the present invention is the apparatus described in any one of the third and fourth aspects, wherein the power control unit sets beforehand a threshold value which determines a control start time with respect to the secondary-side current detection signal obtained by the current detector, a predetermined first delay is set from a time when a rising waveform of the secondary-side current detection signal crosses the threshold value, a predetermined second delay is set from a time when a falling waveform of the secondary-side current detection signal crosses the threshold value, and the first delay is set to be not more than the second delay.

According to the apparatus described in the fifth aspect, the delays 1, 2 are adjusted in accordance with the fluctuation of the current on the secondary side of the direct-current power supply, and the power can be efficiently supplied to the fixing unit to increase an average power supplied to the fixing.

An image forming apparatus according to a sixth aspect of the present invention is the apparatus described in the fifth aspect, wherein the power control unit sets a fixing power increase prohibiting period between end of the first delay and that of the second delay.

According to the apparatus described in the sixth aspect, even when the secondary-side detection current rapidly fluctuates, it is possible to avoid a situation in which the current exceeds the limit value (15 A in Japan) of the primary-side current, and as much power as possible can be supplied to the fixing unit within the limit of the current supplied from the alternating-current power supply.

An image forming apparatus according to a seventh aspect of the present invention is the apparatus described in the fifth aspect, further comprising: a storage unit for a waiting data row, for storing the first or second power instruction value, the first delay, or the second delay as data, wherein on determining an output change of the first or second power instruction value, data on the output-changed power instruction value and the first or second delay is successively stored in the storage unit, and the first or second power instruction value associated with the first or second delay is output to the fixing unit after elapse of the first or second delay stored in the storage unit.

In the apparatus described in the seventh aspect, for example, the first delay is set between supply time when the fixing power determined based on the secondary-side current detection signal is supplied to the fixing unit, and a current detection time based on which the fixing power is determined in a case where the current on the secondary side of the direct-current power supply increases. The second delay is set between supply time when the fixing power determined based on the secondary-side current detection signal is supplied to the fixing unit, and a current detection time based on which the fixing power is determined in a case where the current on the secondary side decreases. Moreover, in one or both of the first and second delays, the first delay is set to be relatively long in a case where increase fluctuation of the current on the secondary side is slower than predetermined fluctuation. The second delay is set to be relatively short in a case where decrease fluctuation of the current on the secondary side is rapider than the predetermined fluctuation.

In the apparatus described in the seventh aspect, the current detection time based on which the fixing power is determined by current detection on the secondary side of the direct-current power supply is, for example, time when the secondary-side current detection signal indicates a predetermined set current value. The set current values can be disposed in such a manner as to correspond to each other at the increase and decrease times of the secondary-side current. Furthermore, even when fluctuation tendency of the secondary-side current is the same, a plurality of set values can be disposed.

According to the apparatus described in the seventh aspect, the power control unit can calculate the fixing power which can be supplied to the fixing unit based on the secondary-side current detection signal and a whole allowable maximum use power, and determine the power instruction value with respect to the fixing unit. The power control unit may comprise, for example, a CPU, program for operating the CPU and the like. The fixing unit receives the power instruction value to supply the fixing power to the fixing heater based on the instruction value. The fixing unit may comprise a fixing heater driving circuit which drives a heating unit such as a fixing heater.

In the supply of the fixing power, the first delay is disposed in case of the current increase, and the second delay is disposed in case of the current decrease before the current detection time. Accordingly, power use is appropriately controlled in the whole image forming apparatus in consideration of a timing at which the fluctuation of the load on the secondary side influences the primary side based on a characteristic of a DC power supply.

Furthermore, in one or both of the first and second delays, the first delay is set to be comparatively long in a case where current increase is slow, and the second delay is set to be comparatively short in a case where current decrease is rapid. When the length of either or both of the first and second delays is adjusted/set in accordance with magnitude of the current fluctuation, power supply time to the fixing unit is further lengthened, and power is efficiently usable.

For example, the fluctuation on the primary side is also slow in a case where the increase of the secondary current is slow. Therefore, the first delay can be lengthened in order to delay a time to decrease the fixing power. On the other hand, in a case where the decrease of the secondary current is rapid, the fluctuation on the primary side is also rapid, and the second delay can be shortened in order to accelerate a time to increase the fixing power.

In the above-described image forming unit, the image is formed on the recording medium. The image on the recording medium is thermally fixed by the fixing unit to which the fixing power is efficiently supplied as described above. The first and second delays are appropriately stored in recording mediums such as RAM, ROM, and flash memory, and read out.

Moreover, according to the seventh aspect apparatus, to determine the power instruction value with respect to the fixing unit, a first power instruction value PC set by the general control unit is compared with the second power instruction value PC determined based on the secondary-side current detection signal, and a smaller value is set as the power instruction value. The power instruction value is determined by a power instruction value determining unit. Consequently, in addition to the above-described function of the seventh apparatus, a situation is avoided in which the value exceeds the limit value of the primary-side current even in a case where the secondary-side current detection signal reflecting the secondary-side current rapidly fluctuates. The general control unit may comprise a CPU and program for operating the CPU. The general control unit may contain the above-described power control unit or the like. It is to be noted that every time the output change of the power instruction value is determined in the waiting data row storage unit, the power instruction value and the first or second delay are successively stored as the data, and the power instruction value is output in accordance with the delay of the stored first and second delays. As the waiting data row storage unit, an appropriately writable RAM or the like is used.

An image forming apparatus according to an eighth aspect of the present invention is the apparatus described in the fifth aspect, wherein the power control unit outputs the power instruction value to the fixing unit after elapse of the first or second delay accompanying the current fluctuation on the secondary side of the direct-current power supply.

According to the apparatus described in the eighth aspect, the power control unit can calculate the fixing power which can be supplied to the fixing unit based on the secondary-side current detection signal and the whole allowable maximum use power, and determines the power instruction value with respect to the fixing unit. The fixing unit receives the power instruction value to supply the fixing power to the fixing heater based on the instruction value. In the supply of the fixing power, the first delay is disposed in case of the current increase, and the second delay is disposed in case of the current decrease before the current detection time. Moreover, accompanying the fluctuation of the secondary-side current, the power instruction value is output to the fixing unit, and the fixing power is efficiently supplied to the fixing heater in accordance with the elapse of the first and second delays.

Furthermore, as a function different from the above-described function, the apparatus described in the eighth aspect has a function of comparing the first power instruction value PC set by the general control unit with the second power instruction value PC determined based on the secondary-side current detection signal to set a smaller value as the power instruction value in determining the power instruction value with respect to the fixing unit. The power instruction value is determined by the power instruction value determining unit. Accordingly, in addition to the function of the apparatus described in the seventh aspect, a situation is avoided in which the value exceeds the limit value of the primary-side current even in a case where the secondary-side current rapidly fluctuates.

In the apparatus described in the eighth aspect, the output change of the power instruction value is newly determined in storing the data on the power instruction value and the first or second delay in the storage unit for the waiting data row, and the new power instruction value is output based on the first or second delay associated with the new power instruction value earlier than the power instruction value already stored in the storage unit. On these conditions, all the data on the power instruction value already stored in the storage unit and the first or second delay is cleared, and data on the new power instruction value and the first or second delay is stored in a top of the waiting data row in the storage unit in a waiting order. According to this apparatus, an appropriate fixing power instruction value is held in such a manner as to be output even with respect to frequent fluctuation of the current value.

In the apparatus described in the eighth aspect, the output change of the power instruction value is newly determined in storing the data on the power instruction value and the first or second delay in the storage unit for the waiting data row, and the new power instruction value is output based on the first or second delay associated with the new power instruction value earlier than the power instruction value already stored in the storage unit. On these conditions, the data on the power instruction value stored before the new power instruction value and the first or second delay is cleared. Furthermore, the data on the previously stored power instruction value and the first or second delay is repeatedly cleared until the new power instruction value is output later than the power instruction value in the waiting data row in the storage unit. When the new power instruction value is output later than the power instruction value in the waiting data row of the storage unit, the data on the new power instruction value and the first or second delay is stored in the last of the waiting data row in the storage unit.

Moreover, according to the apparatus described in the eighth aspect, on the conditions that the power instruction value is output before the power instruction value previously stored in the waiting data row storage unit in storing the data of the power instruction value and the first or second delay in the waiting data row storage unit by the determination of the output change of the power instruction value, a process to clear the power instruction value immediately before the stored data is repeated. This eliminates a state in which new data is output prior to the stored data. When the data on the new power instruction value and the delay 1 or 2 is stored in the last of the waiting data row in this state, a more appropriate fixing power instruction value is held in such a manner as to be output even with respect to the frequent fluctuation of the current value.

In the apparatus described in the seventh or eighth aspect, in response to the output of the power instruction value, the data of the power instruction value, and the data of the first or second delay associated with the power instruction value are cleared from the storage unit for the waiting data row, and another data of the power instruction value and the first or second delay, stored in the storage unit, is shifted in the waiting data row in accordance with a storage order.

In the apparatus described in the seventh or eighth aspect, the first and second delays are stored in the storage unit in accordance with an operation mode of the image forming unit. For example, the values of the first and second delays can be determined in accordance with the operation mode of the image forming unit. To indicate an inherent load current in each operation mode, the first and second delays corresponding to the load current are determined, and accordingly the fixing power can be more appropriately controlled. It is to be noted that the operation mode differs with the apparatus constitution of the image forming unit, but is determined, for example, by a single operation of one-sided printing, double-sided printing, stapling, punching, sorting, automatic original reading, or tray stage positioning, or a combination of the operations.

The first and second delays associated with the operation mode are stored in the storage unit like RAM. When the operation mode of the image forming apparatus is recognized, the first and second delays in the storage unit can be read and acquired. The operation mode can be recognized by a delay determining unit.

The apparatus described in the seventh or eighth aspect further comprises: the delay determining unit for recognizing an operation mode of the image forming unit, and reading data on the first and second delays from the storage unit in accordance with the operation mode to select the first and second delays. The delay determining unit may comprise, for example, a CPU and program for operating this CPU. The delay determining unit may be constituted alone, or constituted in such a manner as to be contained in the general control unit or another control unit (power control unit, etc.).

Moreover, in the apparatus described in the seventh or eighth aspect, lengths of the first and second delays are adjusted in accordance with magnitude of current fluctuation on the secondary side of the direct-current power supply, which is predicted based on the operation mode of the fixing unit. For example, an increase/decrease degree of the load current which fluctuates in accordance with the operation mode, and the operation mode is associated with the first and second delays whose lengths have been adjusted, and stored as data in the storage unit. The operation mode can be recognized by the above-described delay determining unit. Based on the recognition result, necessary data of the first and second delays is read from the storage unit, and the first and second delays whose lengths have been adjusted can be set. It is to be noted that a DC power supply of the present invention may emit a single output or a plurality of outputs. When the plurality of outputs are emitted, the load currents are detected with respect to the respective outputs by the current detector.

An image forming apparatus according to a ninth aspect of the present invention is the apparatus described in the first aspect, wherein the power control unit comprises: a primary-side current calculating unit which holds a DC power supply transmission function for calculating a primary-side current of the direct-current power supply from the secondary-side current detection signal of the direct-current power supply, output from the current detector, and the power control unit controls the power to be supplied to the fixing unit based on the primary-side current calculated by the primary-side current calculating unit.

For example, the DC power supply transmission function is obtained beforehand from a secondary-side load current waveform of the direct-current power supply and a primary-side current waveform of the direct-current power supply, and the DC power supply transmission function is held as a function equation table in the primary-side current calculating unit. The primary-side current calculating unit converts the secondary-side current detection signal from a time region into a Z-region or a frequency region, and multiplies the secondary-side current detection signal converted into the Z-region or the frequency region by the DC power supply transmission function. Moreover, the primary-side current calculating unit inversely converts the primary-side current obtained by multiplying the secondary-side current detection signal by the DC power supply transmission function into the time region.

According to the image forming apparatus described in the ninth aspect, the power control unit can instantaneously control the power which can be supplied to the fixing unit based on a multiplied value of the secondary-side current detection signal of the direct-current power supply, input from the current detector, and the preset DC power supply transmission function before the current fluctuation on the secondary side of the direct-current power supply influences the primary side. Accordingly, the power can be supplied as much as possible to the fixing unit from the alternating-current power supply within the limit of the use current.

The image forming apparatus described above in each aspect has the following effects.

The image forming apparatus described in the first aspect comprises: the current detector for detecting the current on the secondary side of the direct-current power supply whose primary side is connected to the alternating-current power supply and whose secondary side is connected to the load and which supplies the direct-current power. The current detector outputs the secondary-side current detection signal to the power control unit. The power control unit is constituted in such a manner as to control the power which can be supplied to the fixing unit based on the secondary-side current detection signal of the direct-current power supply. The signal is output from the current detector.

According to this constitution, the power control unit can quickly control the power which can be supplied to the fixing unit based on the secondary-side current detection signal of the direct-current power supply, input from the current detector, before the load fluctuation of the motor or the like on the secondary side of the direct-current power supply influences the primary side, that is, the alternating-current power supply side connected to the fixing unit. Accordingly, the power can be supplied as much as possible to the fixing unit from the alternating-current power supply within the limit of the supplied current.

According to the image forming apparatus described in the second aspect, when the fixing power that can be supplied to the fixing unit is controlled based on the secondary-side current detection signal of the direct-current power supply, the decrease is continuously permitted at a time when the fixing power is decreased. After the fixing power is decreased, the increase control of the fixing power is restricted until the predetermined time elapses.

By this constitution, after once decreasing the fixing power accompanying the increase of the secondary current detection signal of the direct-current power supply, the increase control of the fixing power can be prohibited until the predetermined time elapses. The power can be supplied to the fixing unit as much as possible within the limit of the current supplied from the alternating-current power supply.

According to the image forming apparatus described in the third aspect, the first power instruction value determined based on the secondary-side current detection signal is compared with the second power instruction value determined by the general control unit to select a smaller value from the first and second power instruction values, and the power supply is controlled based on either of the first and second power instruction values selected here.

By this constitution, the power which can be supplied to the fixing unit can be instantaneously controlled by either of the first power instruction value determined based on the secondary-side current detection signal of the direct-current power supply, input from the current detector, and the second power instruction value determined by the general control unit before the load fluctuation of the motor or the like on the secondary side of the direct-current power supply influences the primary side, that is, the alternating-current power supply side connected to the fixing unit. Accordingly, the power can be supplied as much as possible to the fixing unit from the alternating-current power supply within the limit of the use current.

According to the image forming apparatus described in the fourth aspect, to control the fixing power which can be supplied to the fixing unit based on either of the first and second power instruction values, the decrease is continuously permitted at the time when the fixing power is decreased, and the increase control of the fixing power is restricted until the predetermined time elapses.

By this constitution, by either of the first power instruction value determined based on the secondary current detection signal of the direct-current power supply and the second power instruction value determined by the general control unit, the increase control of the fixing power can be prohibited until the predetermined time elapses after the fixing power is once decreased.

According to the image forming apparatus described in the fifth aspect, the threshold value which determines the control start time is preset with respect to the secondary-side current detection signal, the predetermined first delay is set from the time when the rising waveform of the secondary-side current detection signal crosses the threshold value, and the predetermined second delay is set from the time when the falling waveform of the secondary-side current detection signal crosses the threshold value. The first delay is set to be not more than the second delay.

By this constitution, the first and second delays are adjusted in accordance with the fluctuation of the current on the secondary side of the direct-current power supply, and the power can be efficiently supplied to the fixing unit to increase the average power supplied to the fixing.

According to the image forming apparatus described in the sixth aspect, the fixing power increase prohibiting period is set between the end of the first delay and that of the second delay.

By this constitution, even when the secondary-side detection current rapidly fluctuates, it is possible to avoid the situation in which the current exceeds the limit value (15 A in Japan) of the primary-side current, and as much power as possible can be supplied to the fixing unit within the limit of the current supplied from the alternating-current power supply.

According to the image forming apparatus described in the seventh aspect, when the current on the secondary side of the direct-current power supply increases, the first delay is set between the supply time when the fixing power determined based on the secondary-side current detection signal is supplied to the fixing unit, and the current detection time based on which the fixing power is determined. When the current on the secondary side decreases, the second delay is set between the time when the fixing power determined based on the secondary-side current detection signal is supplied to the fixing unit, and the current detection time based on which the fixing power is determined. Moreover, in one or both of the first and second delays, the first delay is set to be relatively long in a case where the increase fluctuation of the current on the secondary side is slower than the predetermined fluctuation. The second delay is set to be relatively short in a case where the decrease fluctuation of the current on the secondary side is rapider than the predetermined fluctuation.

By this constitution, the situation can be avoided in which the value exceeds the limit value of the primary-side current even in a case where the current on the secondary side of the direct-current power supply rapidly fluctuates.

According to the image forming apparatus described in the eighth aspect, the storage unit for the waiting data row is disposed in which the power instruction value and the first or second delay are stored as the data.

By this constitution, when the power instruction value is changed accompanying the fluctuation of the current on the secondary side of the direct-current power supply, the smoothly changed power instruction value can be output to control the fixing power.

The image forming apparatus described in the ninth aspect comprises: the primary-side current calculating unit which holds the DC power supply transmission function for calculating the primary-side current of the direct-current power supply from the secondary-side current detection signal of the direct-current power supply, and the power which can be supplied to the fixing unit is controlled based on the primary-side current calculated by this primary-side current calculating unit.

By this constitution, the power which can be supplied to the fixing unit can be instantaneously controlled based on a multiplied value of the secondary-side current detection signal of the direct-current power supply, input from the current detector, and the preset DC power supply transmission function before the current fluctuation on the secondary side of the direct-current power supply influences the primary side. Accordingly, the power can be supplied as much as possible to the fixing unit from the alternating-current power supply within the limit of the use current.

The present invention is remarkably preferably applied to a monochromatic or color printer having a fixing function of thermally fixing a toner image formed on a sheet, a facsimile apparatus of the same type, a copying machine of the same type, a complex machine of them or the like.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus usable when connected to an alternating-current power supply, comprising:

an image forming unit to form an image on a predetermined recording medium;

a fixing unit connected to the alternating-current power supply in such a manner as to thermally fix the image formed on the recording medium by the image forming unit;

a general control unit to control the whole image forming apparatus including the image forming unit and the fixing unit; and a power supply system which supplies power to the image forming unit, the fixing unit, and the general control unit, the power supply system comprising:

a direct-current power supply whose primary side is connected to the alternating-current power supply and whose secondary side is connected to a load and which supplies a direct-current power;

a power control unit for to control power supply of the fixing unit; and a current detector to detect a current on the secondary side of the direct-current power supply to output a secondary-side current detection signal to the power control unit, the power control unit being constituted in such a manner as to control the power to be supplied to the fixing unit based on the secondary-side current detection signal of the direct-current power supply, the signal being output from the current detector.

2. The image forming apparatus according to claim 1, wherein the power control unit continuously permits decrease at a time when a fixing power is decreased, and limits increase control of the fixing power until a predetermined time elapses after the fixing power is decreased in a case where the fixing power to be supplied to the fixing unit is controlled based on the secondary-side current detection signal of the direct-current power supply, the signal being output from the current detector.

3. The image forming apparatus according to claim 2, wherein the power control unit compares a first power instruction value for controlling the power supply of the fixing unit, determined based on the secondary-side current detection signal obtained by the current detector, with a second power instruction value for controlling the power supply of the fixing unit, determined by the general control unit, the power control unit selects a smaller value from the first and second power instruction values, and the power control unit controls the power supply of the fixing unit based on either of the first and second power instruction values.

4. The image forming apparatus according to claim 3, wherein the power control unit continuously permits decrease at a time when a fixing power is decreased, arid limits increase control of the fixing power until a predetermined time elapses after the fixing power is decreased in a case where the fixing power to be supplied to the fixing unit is controlled based on either of the first and second power instruction values.

5. The image forming apparatus according to claim 3, wherein, further comprising:

a storage unit for a waiting data row, for storing the first or second power instruction value, and a first delay, or a second delay as data, wherein the power control unit sets beforehand a threshold value which determines a control start time with respect to the secondary-side current detection signal obtained by the current detector, a predetermined first delay is set from a time when a rising waveform of the secondary-side current detection signal crosses the threshold value, a predetermined second delay is set from a time when a falling waveform of the secondary-side current detection signal crosses the threshold value, and the first delay is set to be not more than the second delay, and wherein on determining an output change of the first or second power instruction value, data on the output-changed power instruction value and the first or second delay is successively stored in the storage unit, and the first or second power instruction value associated with the first or second delay is output to the fixing unit after elapse of the first or second delay stored in the storage unit.

6. The image forming apparatus according to claim 3, wherein a first delay is set between supply time when a fixing power determined based on the secondary-side current detection signal is supplied to the fixing unit, and a current detection time based on which the fixing power is determined in a case where the current on the secondary side of the direct-current power supply increases, a second delay is set between supply time when the fixing power determined based on the secondary-side current detection signal is supplied to the fixing unit, and a current detection time based on which the fixing power is determined in a case where the current on the secondary side decreases, in one or both of the first and second delays, the first delay is set to be relatively long in a case where increase fluctuation of the current on the secondary side is slower than predetermined fluctuation, and the second delay is set to be relatively short in a case where decrease fluctuation of the current on the secondary side is rapider than the predetermined fluctuation.

7. The image forming apparatus according to claim 6, wherein the current detection time based on which the fixing power is determined by current detection on the secondary side of the direct-current power supply is a time when the secondary-side current detection signal indicates a predetermined set current value.

8. The image forming apparatus according to claim 1, wherein the power control unit compares a first power instruction value for controlling the power supply of the fixing unit, determined based on the secondary-side current detection signal obtained by the current detector, with a second power instruction value for controlling the power supply of the fixing unit, determined by the general control unit, the power control unit selects a smaller value from the first and second power instruction values, and the power control unit controls the power supply of the fixing unit based on either of the first and second power instruction values.

9. The image forming apparatus according to claim 8, wherein the power control unit continuously permits decrease at a time when a fixing power is decreased, and limits increase control of the fixing power until a predetermined time elapses after the fixing power is decreased in a case where the fixing power to be supplied to the fixing unit is controlled based on either of the first and second power instruction values.

10. The image forming apparatus according to claim 8, wherein, further comprising:

a storage unit for a waiting data row, for storing the first or second power instruction value, and a first delay, or a second delay as data, wherein the power control unit sets beforehand a threshold value which determines a control start time with respect to the secondary-side current detection signal obtained by the current detector, the first delay is set from a time when a rising waveform of the secondary-side current detection signal crosses the threshold value, the second delay is set from a time when a falling waveform of the secondary-side current detection signal crosses the threshold value, and the first delay is set to be not more than the second delay, and wherein on determining an output change of the first or second power instruction value, data on the output-changed power instruction value and the first or second delay is successively stored in the storage unit, and the first or second power instruction value associated with the first or second delay is output to the fixing unit after elapse of the first or second delay stored in the storage unit.

11. The image forming apparatus according to claim 8, wherein a first delay is set between supply time when a fixing power determined based on the secondary-side current detection signal is supplied to the fixing unit, and a current detection time based on which the fixing power is determined in a case where the current on the secondary side of the direct-current power supply increases, a second delay is set between supply time when the fixing power determined based on the secondary-side current detection signal is supplied to the fixing unit, and a current detection time based on which the fixing power is determined in a case where the current on the secondary side decreases, in one or both of the first and second delays, the first delay is set to be relatively long in a case where increase fluctuation of the current on the secondary side is slower than predetermined fluctuation, and the second delay is set to be relatively short in a case where decrease fluctuation of the current on the secondary side is rapider than the predetermined fluctuation.

12. The image forming apparatus according to claim 11, wherein the current detection time based on which the fixing power is determined by current detection on the secondary side of the direct-current power supply is a time when the secondary-side current detection signal indicates a predetermined set current value.

13. The image forming apparatus according to claim 1, wherein the power control unit sets beforehand a threshold value which determines a control start time with respect to the secondary-side current detection signal obtained by the current detector, a first delay is set from a time when a rising waveform of the secondary-side current detection signal crosses the threshold value, a second delay is set from a time when a falling waveform of the secondary-side current detection signal crosses the threshold value, and the first delay is set to be not more than the second delay.

14. The image forming apparatus according to claim 13, wherein the power control unit sets a fixing power increase prohibiting period between end of the first delay and that of the second delay.

15. The image forming apparatus according to claim 13, wherein the power control unit outputs a power instruction value to the fixing unit after the elapse of the first delay or the second delay in accordance with the current fluctuation on the secondary side of the direct-current power supply.

16. The image forming apparatus according to claim 15, further comprising a storage unit for a waiting data row, for storing at least one of the power instruction value and the first or second delay, wherein the output change of the power instruction value is newly determined in storing the data on the power instruction value and the first or second delay in the storage unit, and the new power instruction value is output based on the first or second delay associated with the new power instruction value earlier than the power instruction value already stored in the storage unit, on these conditions, all the data on the power instruction value and the first or second delay, already stored in the storage unit, is cleared, and data on the new power instruction value and the first or second delay is stored in a top of a waiting order of the waiting data row in the storage unit.

17. The image forming apparatus according to claim 16, wherein the output change of the power instruction value is newly determined in storing the data on the power instruction value and the first or second delay in the storage unit, and the new power instruction value is output based on the first or second delay associated with the new power instruction value earlier than the power instruction value already stored in the storage unit, on these conditions, all the data on the power instruction value and the first or second delay, stored before the new power instruction value, is cleared, the data on the previously stored power instruction value and the first or second delay is repeatedly cleared until the new power instruction value is output later than the power instruction value in the waiting data row in the storage unit, and the data on the new power instruction value and the first or second delay is stored in the last of the waiting data row in the storage unit, when the new power instruction value is output later than the power instruction value in the waiting data row of the storage unit.

18. The image forming apparatus according to claim 13, further comprising a storage unit for a waiting data row, for storing at least one of a power instruction value and the first or second delay, wherein the power control unit outputs the power instruction value to the fixing unit, in response to the output of the power instruction value, the data of the power instruction value, and the data of the first or second delay associated with the power instruction value are cleared from the storage unit for the waiting data row, and another data of the power instruction value and the first or second delay, stored in the storage unit, is shifted in the waiting data row in accordance with a storage order.

19. The image forming apparatus according to claim 13, further comprising a storage unit for a waiting data row, for storing at least one of a power instruction value and the first or second delay, wherein the first and second delays are stored in the storage unit in accordance with an operation mode of the image forming unit.

20. The image forming apparatus according to claim 19, further comprising: delay determining unit to recognize an operation mode of the image forming unit, and reading data on the first and second delays from the storage unit in accordance with the operation mode to select the first and second delays.

21. The image forming apparatus according to claim 20, wherein lengths of the first and second delays are adjusted in accordance with magnitude of current fluctuation on the secondary side of the direct-current power supply, which is predicted based on the operation mode of the fixing unit.

22. The image forming apparatus according to claim 1, wherein the power control unit comprises: primary-side current calculating unit which holds a DC power supply transmission function for calculating a primary-side current of the direct-current power supply from the secondary-side current detection signal of the direct-current power supply, output from the current detector, and the power control unit controls the power to be supplied to the fixing unit based on the primary-side current calculated by the primary-side current calculating unit.

23. The image forming apparatus according to claim 22, wherein the DC power supply transmission function is obtained beforehand from a secondary-side load current waveform of the direct-current power supply and a primary-side current waveform of the direct-current power supply, and the DC power supply transmission function is held as a function equation table in the primary-side current calculating unit.

24. The image forming apparatus according to claim 22, wherein the primary-side current calculating unit converts the secondary-side current detection signal from a time region into a Z-region or a frequency region, the primary-side current calculating unit multiplies the secondary-side current detection signal converted into the Z-region or the frequency region by the DC power supply transmission function, and the primary-side current calculating unit inversely converts the primary-side current obtained by multiplying the secondary-side current detection signal by the DC power supply transmission function into the time region.

25. The image forming apparatus according to claim 22, wherein a parameter of the DC power supply transmission function is any one or a plurality of parameters selected from a group consisting of a secondary-side current detection signal, primary-side voltage, temperature, power factor, and primary-side current frequency.

26. The image forming apparatus according to claim 22, wherein a primary-side voltage is sampled by the secondary-side current detection signal and in a predetermined period, the sampled primary-side voltage is used as the parameter in the DC power supply transmission function, and a momentary value of the primary-side current is calculated based on the primary-side voltage.

27. The image forming apparatus according to claim 1, wherein direct-current powers are individually supplied to a plurality of loads connected to the direct-current power supply, the current detector is disposed for each of the loads connected to the direct-current power supply, and outputs, to the power control unit, the secondary-side current detection signal obtained by detecting the current on the secondary side of the direct-current power supply for each load, and the power control unit controls power supply of the fixing unit based on the plurality of secondary-side current detection signals.

28. The image forming apparatus according to claim 1, wherein a noise reducing unit is connected between the current detector and the power control unit.

29. The image forming apparatus according to claim 1, wherein an electromagnetic induction heater is used in the fixing unit.

30. The image forming apparatus according to claim 1, wherein the power control unit estimates a current supplied from the alternating-current power supply by calculation or with reference to a table, and controls the power supply to the fixing unit in such a manner that the estimated current does not exceed a predetermined value.

* * * * *